US007775945B2

(12) United States Patent
Smith

(10) Patent No.: US 7,775,945 B2
(45) Date of Patent: Aug. 17, 2010

(54) ARM ASSEMBLY FOR EXERCISE DEVICES

(75) Inventor: Robert J. Smith, Louisville, CO (US)

(73) Assignee: Nautilus, Inc., Vancouver, WA (US)

( * ) Notice: Subject to any disclaimer, the term of this patent is extended or adjusted under 35 U.S.C. 154(b) by 1165 days.

(21) Appl. No.: 11/301,119

(22) Filed: Dec. 12, 2005

(65) Prior Publication Data

US 2006/0128535 A1 Jun. 15, 2006

Related U.S. Application Data

(60) Provisional application No. 60/635,807, filed on Dec. 13, 2004.

(51) Int. Cl.
*A63B 21/062* (2006.01)
*A63B 21/00* (2006.01)

(52) U.S. Cl. ..... 482/100; 482/138

(58) Field of Classification Search ..... 482/93–103, 482/135–138

See application file for complete search history.

(56) References Cited

U.S. PATENT DOCUMENTS

| | | | |
|---|---|---|---|
| 3,567,219 | A | 3/1971 | Foster |
| 4,240,626 | A | 12/1980 | Lambert, Jr. |
| 4,296,924 | A | 10/1981 | Anzaldua et al. |
| 4,387,893 | A | 6/1983 | Baldwin |
| 4,456,245 | A | 6/1984 | Baldwin |
| 4,500,089 | A | 2/1985 | Jones |
| 4,511,137 | A | 4/1985 | Jones |
| 4,627,614 | A | 12/1986 | de Angeli |
| 4,666,152 | A | 5/1987 | Jones |
| 4,709,920 | A | 12/1987 | Schnell |
| 4,711,448 | A | 12/1987 | Minkow et al. |
| 4,733,860 | A | 3/1988 | Steffee |
| 4,749,182 | A | 6/1988 | Duggan |
| 4,772,015 | A | 9/1988 | Carlson et al. |
| 4,773,398 | A | 9/1988 | Tatom |

(Continued)

FOREIGN PATENT DOCUMENTS

| | | |
|---|---|---|
| SU | 1 720 666 A1 | 3/1992 |

(Continued)

OTHER PUBLICATIONS

Cybex International, Inc., Commercial Strength Systems brochure, 4535 Arm Curl, 5255 Rear Delt, 5281 Arm Curl, pp. 9 and 36 (Apr. 2000).

(Continued)

*Primary Examiner*—Fenn C Mathew
(74) *Attorney, Agent, or Firm*—Dorsey & Whitney LLP

(57) ABSTRACT

Aspects of the present invention involve an exercise device with an arm assembly that provides linear, converging, and/or diverging hand grip motions during use and also has an adjustable starting position. The arm assemblies described and depicted herein include arm members that are pivotally coupled with a frame of an exercise device. During exercise, the arm members engage an arcuate surface defining the arm path. The arcuate surfaces which guide the converging and/or diverging hand grip motions as the arms pivot relative to the frame. Some embodiments of the present invention include a releasable locking mechanism that allows a user to pivot the arm members to a desired starting position without altering the relative positions of the hand grips.

20 Claims, 38 Drawing Sheets

U.S. PATENT DOCUMENTS

| | | | | |
|---|---|---|---|---|
| 4,799,671 | A | 1/1989 | Hoggan et al. | |
| 4,840,373 | A | 6/1989 | Maag | |
| 4,872,668 | A | 10/1989 | McGillis et al. | |
| 4,949,951 | A | 8/1990 | Deola | |
| 4,986,538 | A | 1/1991 | Ish, III | |
| 5,039,089 | A | 8/1991 | Lapcevic | |
| 5,056,779 | A | 10/1991 | Webb | |
| 5,080,351 | A | 1/1992 | Rockwell | |
| 5,102,121 | A | 4/1992 | Solow et al. | |
| 5,104,121 | A | 4/1992 | Webb | |
| 5,120,289 | A | 6/1992 | Yu | |
| 5,282,776 | A | 2/1994 | Dalebout | |
| 5,290,214 | A | 3/1994 | Chen | |
| 5,342,270 | A | 8/1994 | Jones | |
| 5,354,248 | A | 10/1994 | Rawls et al. | |
| 5,437,589 | A | 8/1995 | Habing | |
| 5,456,644 | A | 10/1995 | Hecox et al. | |
| 5,470,299 | A | 11/1995 | Yeh | |
| 5,486,150 | A | 1/1996 | Randolph | |
| 5,562,577 | A | 10/1996 | Nichols, Sr. et al. | |
| 5,580,341 | A | 12/1996 | Simonson | |
| 5,582,564 | A | 12/1996 | Nichols, Sr. et al. | |
| 5,597,257 | A | 1/1997 | Habing | |
| 5,597,375 | A | 1/1997 | Simonson | |
| 5,616,111 | A | 4/1997 | Randolph | |
| 5,620,402 | A | 4/1997 | Simonson | |
| 5,632,710 | A | 5/1997 | England et al. | |
| 5,665,036 | A | 9/1997 | Hsieh | |
| 5,667,464 | A | 9/1997 | Simonson | |
| 5,674,167 | A | 10/1997 | Piaget et al. | |
| 5,709,633 | A | 1/1998 | Sokol | |
| 5,769,757 | A | 6/1998 | Fulks | |
| 5,788,616 | A | 8/1998 | Polidi | |
| 5,810,698 | A | 9/1998 | Hullett et al. | |
| 5,810,701 | A | 9/1998 | Ellis et al. | |
| 5,897,467 | A | 4/1999 | Habing et al. | |
| 5,967,954 | A | 10/1999 | Habing | |
| 5,971,895 | A | 10/1999 | Habing | |
| 5,989,165 | A | 11/1999 | Giannelli et al. | |
| 6,004,247 | A | 12/1999 | Webber | |
| 6,056,678 | A | 5/2000 | Giannelli et al. | |
| 6,090,020 | A | 7/2000 | Webber | |
| 6,217,493 | B1 | 4/2001 | Spletzer | |
| 6,238,323 | B1 | 5/2001 | Simonson | |
| D444,190 | S | 6/2001 | Webber | |
| 6,277,056 | B1 | 8/2001 | McBride et al. | |
| 6,387,020 | B1 | 5/2002 | Simonson | |
| 6,394,937 | B1 | 5/2002 | Voris | |
| 6,443,874 | B1 * | 9/2002 | Bennett | 482/44 |
| 6,443,877 | B1 | 9/2002 | Hoecht et al. | |
| 6,471,624 | B1 | 10/2002 | Voris | |
| 6,488,612 | B2 | 12/2002 | Sechrest et al. | |
| 6,491,609 | B2 | 12/2002 | Webber | |
| 6,500,106 | B1 | 12/2002 | Fulks | |
| 6,561,960 | B2 | 5/2003 | Webber | |
| 6,579,213 | B1 | 6/2003 | Webber et al. | |
| 6,592,498 | B1 | 7/2003 | Trainor | |
| 6,605,022 | B2 | 8/2003 | Webber | |
| 6,689,023 | B2 | 2/2004 | Baumler | |
| 6,712,740 | B2 | 3/2004 | Simonson | |
| 6,746,385 | B1 | 6/2004 | Habing | |
| 7,029,427 | B2 | 4/2006 | Vuurmans et al. | |
| 7,083,554 | B1 * | 8/2006 | Lo Presti | 482/137 |
| 7,090,623 | B2 | 8/2006 | Stewart et al. | |
| 7,108,641 | B2 | 9/2006 | Pertegaz-Esteban | |
| 7,179,209 | B2 | 2/2007 | Sechrest et al. | |
| 7,255,665 | B2 | 8/2007 | Ish, III | |
| 2002/0077230 | A1 | 6/2002 | Lull et al. | |
| 2002/0198087 | A1 | 12/2002 | Mitchell et al. | |
| 2003/0017918 | A1 | 1/2003 | Webb et al. | |
| 2003/0022767 | A1 | 1/2003 | Webber | |
| 2003/0078141 | A1 | 4/2003 | Webber | |
| 2003/0092540 | A1 * | 5/2003 | Gillen | 482/99 |
| 2003/0092541 | A1 * | 5/2003 | Giannelli | 482/99 |
| 2003/0092543 | A1 | 5/2003 | Giannelli | |
| 2003/0100413 | A1 | 5/2003 | Huang | |
| 2003/0176261 | A1 | 9/2003 | Simonson et al. | |
| 2004/0005966 | A1 | 1/2004 | Chen | |
| 2005/0124470 | A1 | 6/2005 | Schopf | |
| 2006/0063650 | A1 | 3/2006 | Francis | |
| 2006/0100069 | A1 | 5/2006 | Dibble et al. | |
| 2006/0116249 | A1 | 6/2006 | Dibble et al. | |
| 2007/0010383 | A1 | 1/2007 | Pertegaz-Esteban | |
| 2008/0176722 | A1 * | 7/2008 | Steffee | 482/98 |

FOREIGN PATENT DOCUMENTS

| | | |
|---|---|---|
| SU | 1743620 | 6/1992 |
| TW | 210014 | 7/1993 |
| TW | 317755 | 10/1997 |

OTHER PUBLICATIONS

Cybex International, Inc., Cybex Eagle Premier Strength brochure, 11080 Arm Extension, p. 8 (May 2002).

Cybex World, "New Products Prove Passion for Human Performance," vol. 10, Issue 2 (Jul. 2000).

Nautilus® Home Gyms 2001 brochure, 12 pages (2001).

Nautilus, The Next Generation catalog, 49 pages (undated).

Nautilus catalog, 92 pages (undated).

* cited by examiner

142'''
380
378
234'''
308'''
388
384, 386
370

142''', 234'''
380
378
308'''
384
388

142''', 234'''
388
378
308'''
380
390
384
386
370

ARM ASSEMBLY FOR EXERCISE DEVICES

CROSS-REFERENCE TO RELATED APPLICATIONS

This application claims the benefit of U.S. Provisional Application No. 60/635,807, filed Dec. 13, 2004, which is hereby incorporated herein by reference.

FIELD OF THE INVENTION

This invention relates to exercise devices, and more particularly, to exercise devices utilizing various pivotal arm assemblies with selectable starting positions and providing for converging and/or diverging hand grip motions during exercise.

BACKGROUND

The benefits of regular exercise, such as strength training, aerobic training, flexibility training, etc., are well known. Various types of training, especially strength and flexibility training, may be performed without any external resistance, such as through performing push-up, pull-ups, yoga, or the like. Additionally, strength and flexibility training may be performed either with free weights, e.g., dumbbells and resistance bands, or with exercise machines ranging in complexity. One advantage of not using any resistance or free weights, is that the exercise motion is not constrained by any mechanical structure. In an attempt to operate in a less constrained manner and emulate non-exercise machine training, many exercise machines have been devised to eliminate or lessen the constraint on exercise motion. Some of these machines, however, are not well suited for both pulling and pushing motions. Additionally, some of these machines cannot be adjusted, adjustment options are limited, or adjustment is difficult. For example, some machines can not be easily adjusted for use by people of varying height, arm length, shoulder width, strength, etc. In another example, some machines cannot be easily configured to allow for varying starting and ending orientations. It is with this background in mind, as well as other issues, that some of the aspects of the embodiments described below were conceived and developed.

SUMMARY

Aspects of the present invention involve arm assemblies pivotally coupled with exercise devices that provide for converging and/or diverging hand-grip motion during use while also providing for a selectable starting position.

In one aspect of the present invention, an exercise device includes: a frame, a resistance system operably associated with the frame, a drive shaft rotatably connected with the frame and adapted to engage the resistance system, a first arm rotatably supported on the drive shaft, a second arm rotatably supported on the drive shaft, a transmission member coupled with the drive shaft, the transmission member defining at least two arm member orientation coupling points, and a locking member positioned to engage one of the coupling points to adjust a starting position of the arms relative to the frame.

In another form of the present invention, an exercise device includes: a frame, a resistance system operably associated with the frame, a drive shaft rotatably connected with the frame and adapted to engage the resistance system, a first arm pivotally connected with the drive shaft; a second arm pivotally connected with the drive shaft, a transmission member coupled with the drive shaft, the transmission member defining at least two arm member orientation coupling points, and a locking member positioned to engage one of the coupling points to adjust a starting position of the arms relative to the frame.

In yet another form of the present invention, an exercise device includes: a frame, a resistance system operatively associated with the frame, a drive shaft rotatably connected with the frame and adapted to actuate the resistance system, a cam housing selectively coupled with the frame, the cam housing defining at least one aperture defining at least one arm path, a collar rotatably supported on the drive shaft, a first arm pivotally coupled with the collar, the first arm positioned through the at least one aperture to follow the arm path, a second arm pivotally coupled with the collar, the second arm positioned through the at least one aperture to follow the arm path, a transmission member coupled with the drive shaft, the transmission member defining at least two orientation coupling points, a first locking member positioned to engage one of the coupling points to adjust a starting position of the arms relative to the frame, and a second locking member releasably coupling the cam housing to the frame to align the cam housing with the starting position of the arms relative to the frame.

In still another form of the present invention, an exercise device includes: a frame, a resistance system operatively associated with the frame, a drive shaft rotatably connected with the frame and adapted to actuate the resistance system, a cam housing selectively coupled with the frame, the cam housing defining at least one aperture defining at least one arm path, a collar rotatably supported on the drive shaft, a first arm pivotally coupled with the collar, the first arm positioned through the at least one aperture to follow the arm path, and a second arm pivotally coupled with the collar, the second arm positioned through the at least one aperture to follow the arm path.

In still another form of the present invention, an exercise device includes: a frame, a resistance system operably associated with the frame, a drive shaft rotatably connected with the frame and adapted to engage the resistance system, a first arm rotatably supported on the drive shaft, a second arm rotatably supported on the drive shaft, a means for guiding movement of the first arm relative to the second arm, a means for selectively coupling the first arm and the second arm with the drive shaft, and a means for selectively coupling the means for guiding with the frame and the drive shaft.

In still another form of the present invention, an exercise device includes: a frame, a resistance system operably associated with the frame, a drive shaft rotatably connected with the frame, a first arm, a second arm, a means for pivotally connecting the first arm and the second arm with the drive shaft, a means for guiding movement of the first arm relative to the second arm, a means for selectively coupling the drive shaft with the resistance system, and a means for selectively coupling the means for guiding with the frame and the drive shaft.

The features, utilities, and advantages of various embodiments of the invention will be apparent from the following more particular description of embodiments of the invention as illustrated in the accompanying drawings and defined in the appended claims.

DETAILED DESCRIPTION OF EMBODIMENTS

Aspects of the present invention involve an exercise device with an arm assembly that provides linear, converging, and/or diverging hand grip motions during use. More particularly, the arm assemblies described and depicted herein include arm members that are pivotally coupled with a frame of an exercise device. During exercise, the arm members engage arcuate surfaces on a cam housing defining the arm path. The arcuate surfaces guide the converging and/or diverging hand grip motions as the arms pivot relative to the frame. In a bench press exercise, for example, the arm assembly moves to allow a users hands to converge as he presses outward. Although the arm members are described and depicted herein as engaging arcuate surfaces that define converging or diverging arm paths, it is to be appreciated that the arm members can engage straight surfaces to provide a linear arm path.

The arm assembly can also provide an adjustable starting position. In some embodiments, the arm assembly includes first and second arms connected with a drive shaft. The drive shaft is rotatably connected with a frame of an exercise device and is operably coupled with a resistance system. The arms are selectively connected with the drive shaft, and as such, can be decoupled from the drive shaft and rotate relative thereto to adjust the starting position for a particular exercise. Some embodiments of the present invention include a releasable locking mechanism that allows a user to disconnect the arm members from the drive shaft and disconnect the cam housing from the frame, allowing the arm members and the cam housing to pivot together. As such, a user can pivot the arm members to a desired starting position without altering the relative positions of the hand grips. More particularly, the locking mechanism is operable to allow the arm members and the cam housing to simultaneously pivot relative the frame when selecting a desired starting position of the arm members. Because the arm members do not move relative to the cam housing, the starting positions of the arm members and associated hand grips relative to each other do not change when selecting the starting position of the arm members.

Figure 1A:
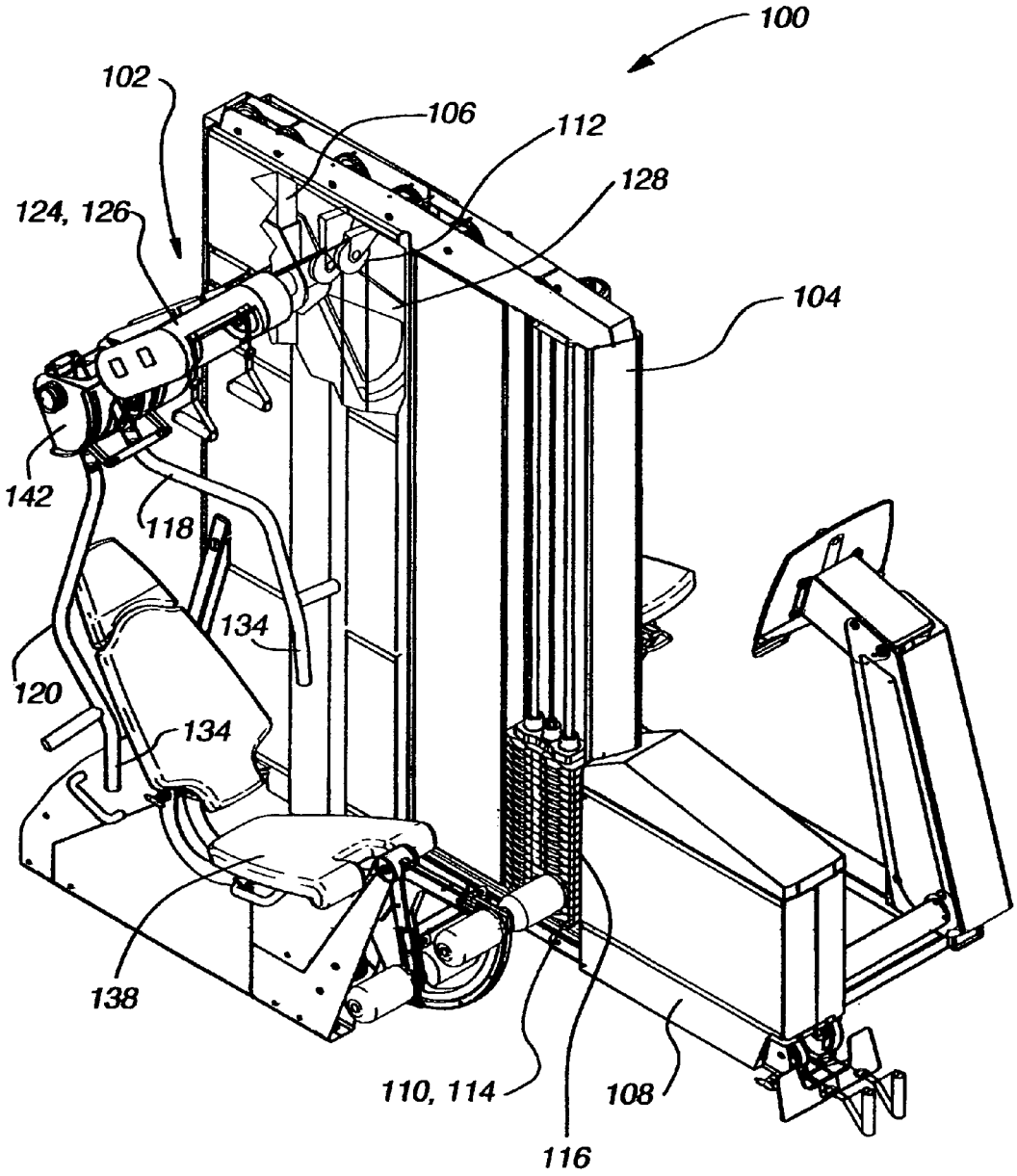
FIG. 1A is front isometric view of a first embodiment of an arm assembly connected with an exercise device.
Figure 1B:
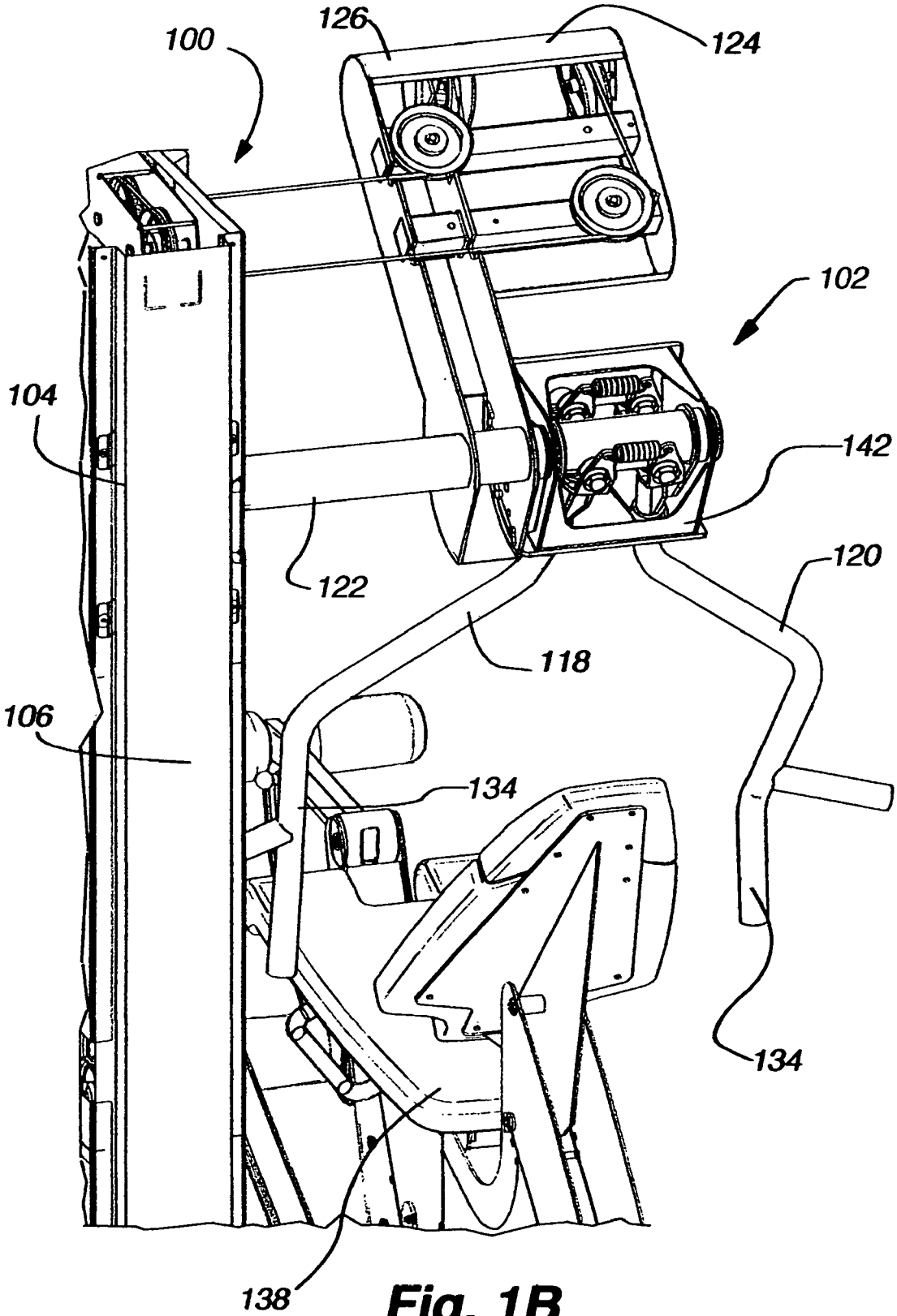
FIG. 1B is a detailed rear isometric view of the first embodiment of the arm assembly shown in FIG. 1A connected with the exercise device.

FIGS. 1A-1B illustrate one embodiment of an exercise device 100 including an arm assembly 102 conforming to aspects of the invention. The exercise device 100 includes a frame 104 having a plurality of upright members 106 extending upwardly from a base structure 108. The exercise device also includes a resistance system 110 operably coupled with the arm assembly 102 through a cable-pulley system 112 supported by the frame 104. In one embodiment, the resistance system 110 includes a weight stack 114 with a plurality of selectable weight plates 116. It is to be appreciated, however, that the arm assembly can be applied to work with exercise devices utilizing different kinds of resistance systems, such as torsional springs, linear springs, and other types of resiliently flexible elements. One example of linear springs includes Bowflex® Power Rod® technology. One example of torsional springs includes SpiraFlex® plates. The term "resistance system" is meant to be interpreted broadly to include any known or future exercise resistance systems. It is also to be appreciated that embodiments of the arm assembly can be utilized with various types of exercise devices other than what is described and depicted herein.

As shown in FIGS. 1A-3A, the arm assembly 102 includes a first arm 118 and a second arm 120 both connected with one of the upright members 106 of the frame 104 through a cylindrically-shaped arm support member 122. Although the arm support member 122 is shown as being connected with the upright member 106 in a substantially cantilevered fashion, it is to be appreciated that additional upright members can be connected with the arm support member and the base structure 108 of the frame 104 to provide additional support to the arm support member. The arm support member 122 is also shown to support a housing 124 for a pull-down exercise station 126. The arm assembly 102 is connected with the cable-pulley assembly 112, and in turn, the resistance system 110 through a sector member 128 connected with a drive shaft 130. More particularly, a resistance cable 132 is connected with the sector member 128 and is routed through the cable-pulley system 112 to connect with the weight stack 114. As described in more detail below, the drive shaft 130 is rotatably supported by and extends through the arm support member 122. During exercise, a user exerts forces on gripping portions 134 of the first arm 118 and second arm 120, which causes the drive shaft 130 and the sector member 128 to pivot relative to the arm support member 122. As the sector member pivots, a portion of the resistance cable 132 wraps onto an arced portion 136 of the sector member, which in turn, pulls against the resistance system 110, providing resistance to the user.

As shown in FIGS. 1A and 1B, the exercise device 100 includes a seat 138 positioned below the arm assembly 102. In the configuration shown in FIGS. 1A and 1B, the arms 118, 120 are configured for a user positioned on the seat to perform a bench press exercise. With reference to FIGS. 1A-3A, the arms 118, 120 extend in a generally downward direction from the drive shaft 130 through arcuate cam slots 140, 141 in a cam housing 142. The cam housing 142 is selectively connected with the frame 104 through the arm support member 122 and guides the arms in a converging or diverging motion during exercise. More particularly, as the first and second arms 118, 120 pivot relative to the cam housing 142, the arms move along cam surfaces 144 on the cam slots 140, 141 shown in FIG. 4A and others, which guide the arms in a converging or diverging motion.

As previously mentioned, the cam housing 142 shown in FIGS. 1A-3A is adapted to provide a converging motion as the user pushes gripping portions 134 of the arms 118, 120 away from his body during a press exercise. To perform the press exercise, the user sits in the seat 138 and grasps the gripping portions 134 of the first and second arms 118, 120. The user then pushes the arms in a direction away from his body, which causes the arms 118, 120, the drive shaft 130, and the sector member 128 to pivot relative to the arm support member 122. As the sector member 128 pivots, a portion of the resistance cable 132 is wrapped onto the arced portion 136 of the sector member 128, which in turn, lifts selected weight plates 116 from the weight stack 114. As the user pushes the arms away from his body, the arms 118, 120 engage the cam surfaces 144 on the cam housing 142, which guide the gripping portions 134 of the arms in a converging motion. As the user allows the arms to move back toward his body, the cam surfaces guide the gripping portions of the arms in a diverging motion.

As previously mentioned, the arm assembly 102 also allows a user to select a desired starting position of the gripping portions 134 of the arms 118, 120. As described in more detail below with reference to FIGS. 3A-4A and others, the arm assembly 102 includes a releasable locking or adjustment mechanism 146 that allows a user to simultaneously decouple the cam housing 142 from the arm support member 122 or frame 104, and the first and second arms 118, 120 from the drive shaft 130. Once decoupled, the arms and cam housing can be rotated together to a desired starting position. After pivoting the arms to the desired starting position, the locking mechanism 146 recouples the cam housing 142 with the arm support member 122 or frame 104 and the arms with the drive shaft 130. Because the arms 118, 120 pivot with the cam housing 142, the cam housing does not cause the gripping portions 134 of the arms to converge or diverge. As such, the distance between the gripping portions do not change when the arms are placed into a desired starting position. Therefore, the pivotal position of the arms 118, 120 relative to the drive shaft 130 can be changed to select different starting positions of the gripping portions 134 on the arms without substantially altering the distance between the gripping portions. In other words, the arm assembly provides the same degree of convergence or divergence during exercise no matter where the starting position of the arms is set.

Figure 2A:
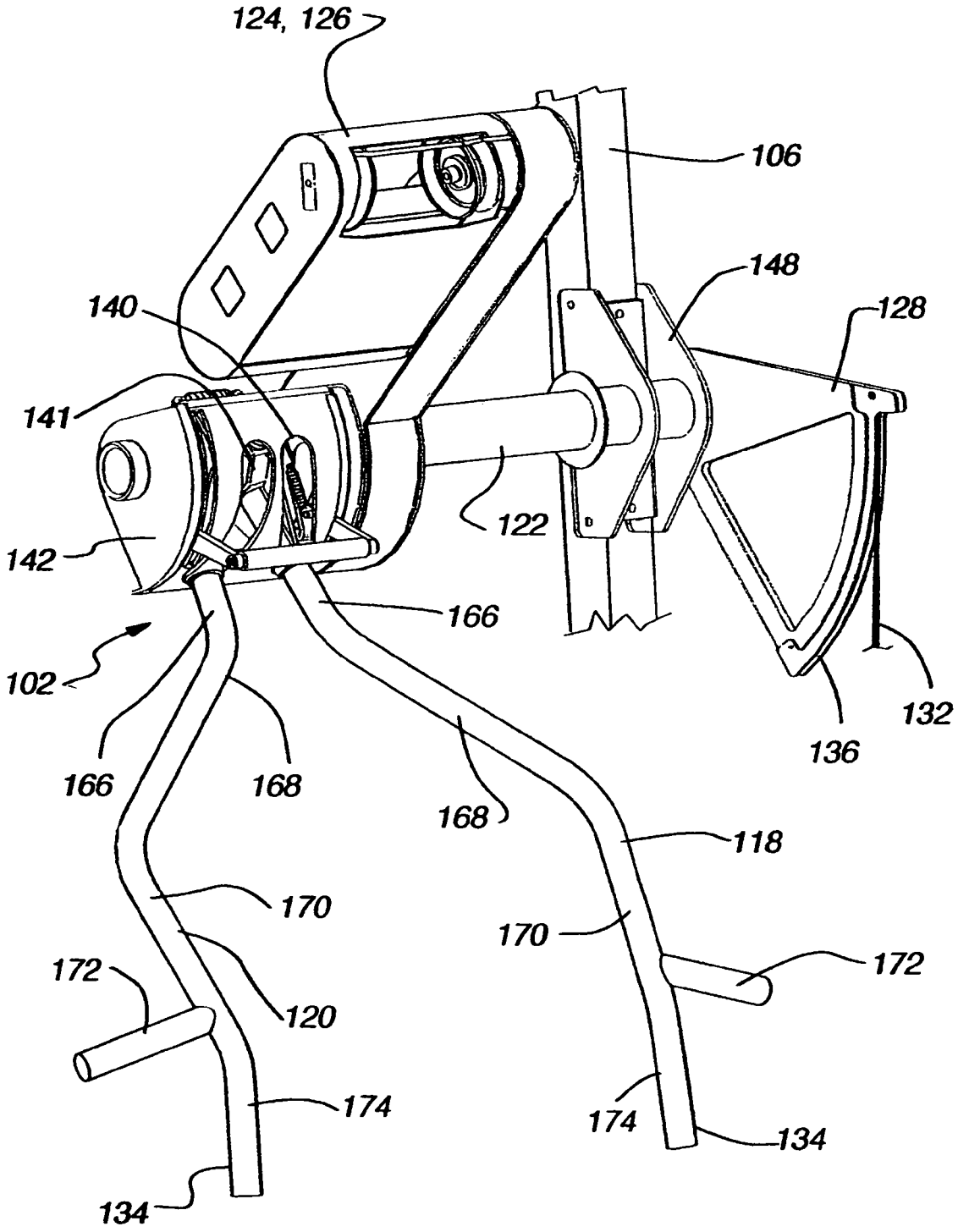
FIG. 2A is a detailed front isometric view of the arm assembly shown in FIG. 1A.

FIGS. 1A-2A show one implementation of the arm assembly 102 with the arm support member 122 coupled with the frame 104 by way of a bracket assembly 148. The housing 124 of the pull-down exercise station 126 is supported by the arm support member 122. It is to be appreciated that other embodiments of the exercise device and arm assembly do not include the pull-down exercise station. As shown in FIG. 1A, 2A, 3A, and others, the drive shaft 130 is rotatably supported by and extends through the arm support member 122. A first end portion 150 of the drive shaft 130 extends outward from inside a first end portion 152 of the arm support member 122. The sector member 128 is connected with the first end portion 150 of the drive shaft 130 adjacent the first end portion 152 of the arm support member 122. The resistance cable 132 is connected with the sector member 128 and extends through the cable-pulley system 112 to connect with the weight stack 114.

Figure 3A:
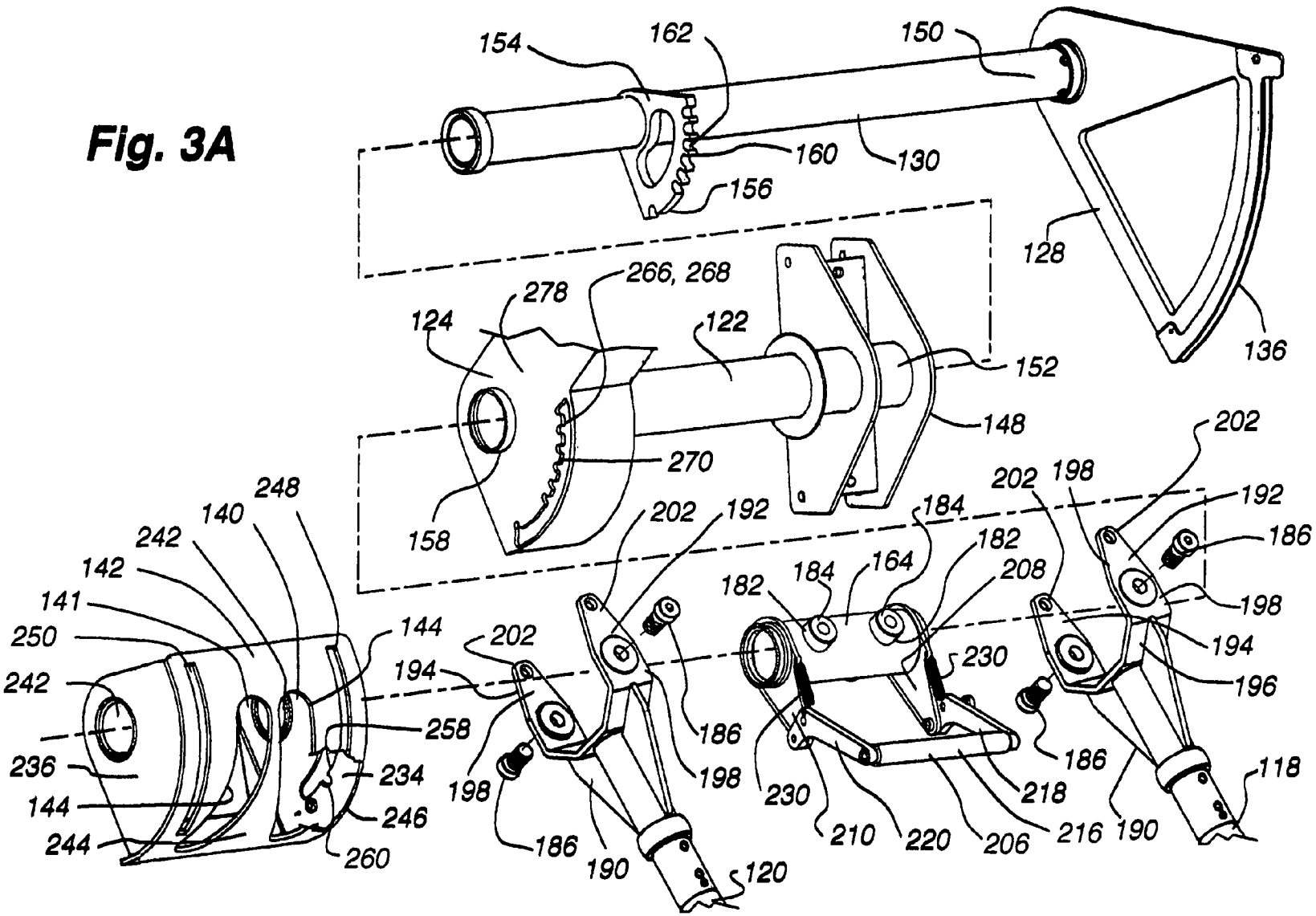
FIG. 3A is an exploded view of the arm assembly shown in FIG. 2A.
Figure 3B:
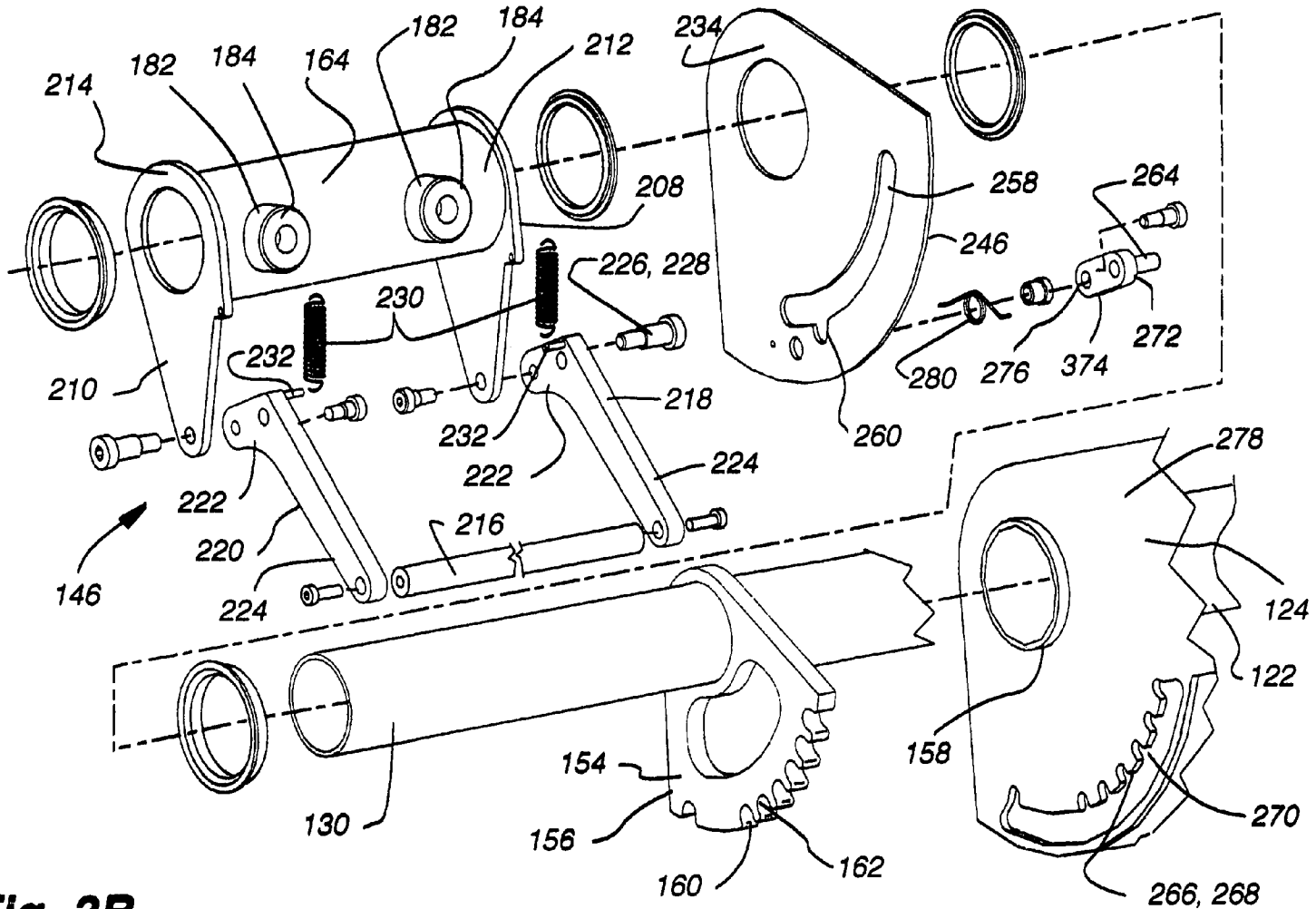
FIG. 3B is a detailed exploded view of the arm assembly showing various components of a releasable locking mechanism.

During exercise, the arms 118, 120, the drive shaft 130, and the sector member 128 pivot together relative to the arm support member 122. As discussed in more detail below, the locking mechanism 146 is adapted to engage a first transmission member 154 to connect the arms with the drive shaft 130. As shown in FIGS. 3A-3B and others, the first transmission member 154, in the form of a first sector gear 156, is connected with the drive shaft 130 adjacent to a second end portion 158 of the arm support member 122. The first sector gear 156 includes a plurality of teeth 160 extending outward from an arced edge 162. The locking mechanism 146 is adapted to engage the teeth 160 on the first sector gear 156 to selectively connect the arms 118, 120 with the drive shaft 130. Although the first transmission member 154 is depicted and described as a sector gear, it is to be appreciated that the first transmission member can be configured in other ways. For example, in one embodiment, the first transmission member is in the form of an arcuate plate having a plurality of circumferentially spaced apertures. In another embodiment, the first transmission member is in the form of a disk having a plurality of circumferentially spaced and radially extending apertures.

Figure 2B:
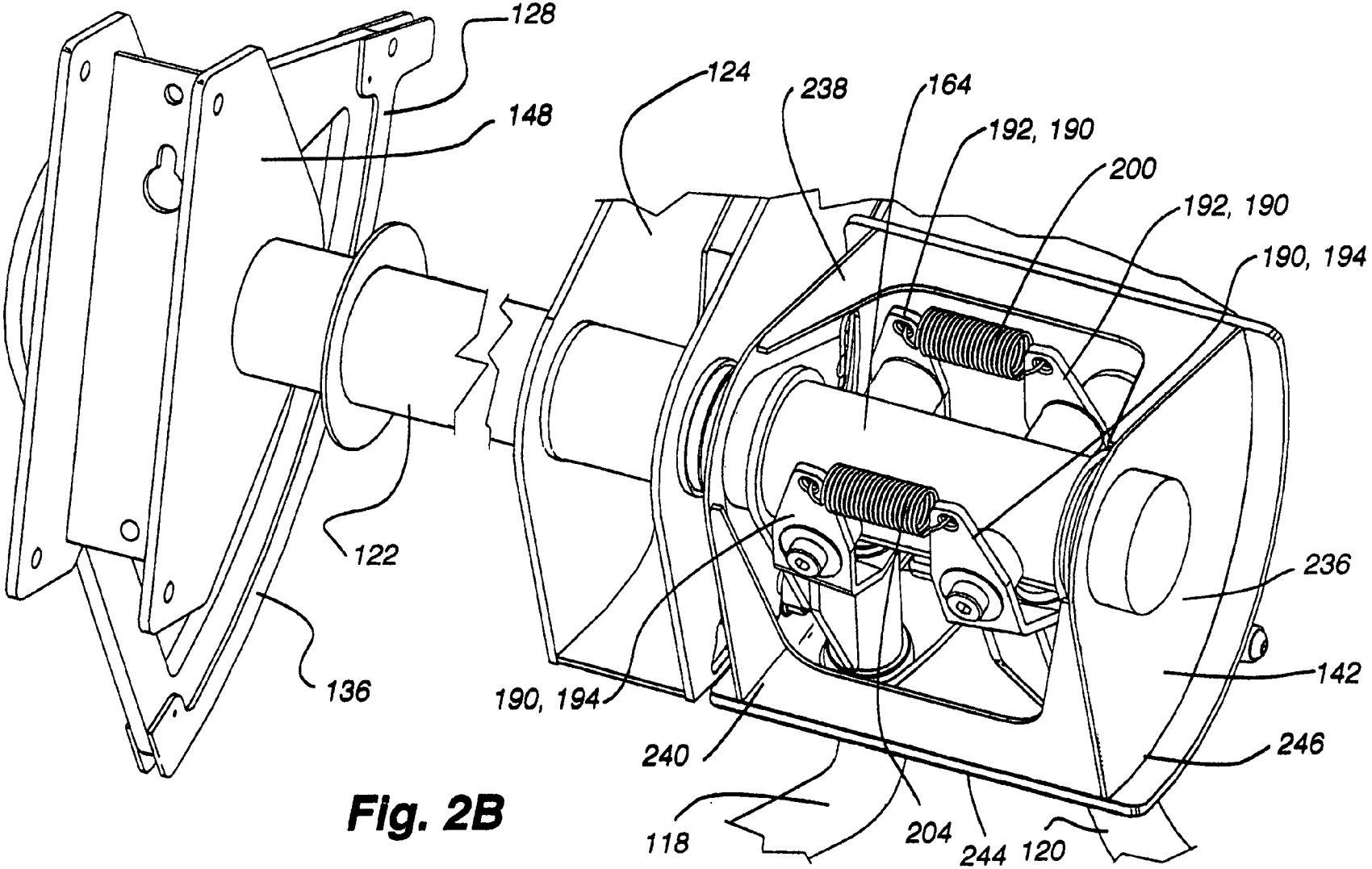
FIG. 2B is a detailed rear isometric view of the arm assembly shown in FIG. 1A.

As shown in FIGS. 2A-2B and others, the first and second arms 118, 120 are pivotally connected with a collar 164. As discussed in more detail below, the collar 164 is selectively connected with the drive shaft 130 through the locking mechanism 146 and first sector gear 156. From first end portions 166, the first and second arms 118, 120 extend from the collar 164 and through the arcuately-shaped cam slots 140, 141 in the cam housing 142. The first end portions 166 of the first and second arms 118, 120 transition to angularly offset mid portions 168 outside of the cam housing 142. From the mid portions 168 outside the cam housing 142, the first and second arms 118, 120 extend in diverging relation to each other to angularly offset second end portions 170 that extend in converging relation to each other. Outwardly extending first grip members 172 and downwardly angled second grip members 174 are connected with the second end portions 170 of the arms 118, 120, defining the gripping portions 134 of the arms. It is to be appreciated that other embodiments of the arm assembly may utilize arms having different features than what are depicted and described herein, such as different lengths, shapes, cross sections, and diameters.

Figure 4A:
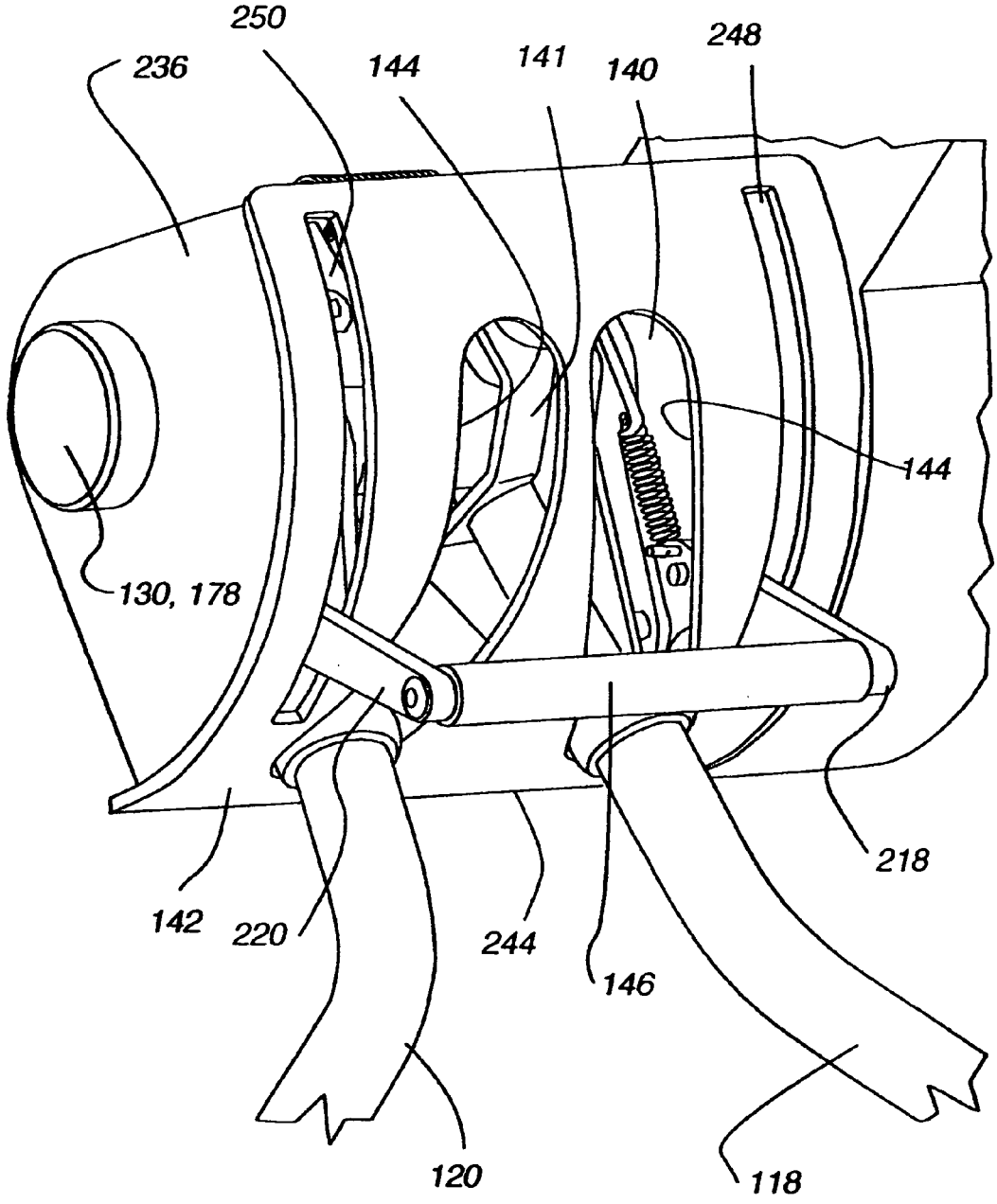
FIG. 4A is detailed isometric view of the arm assembly shown in FIG. 1A.
Figure 4B:
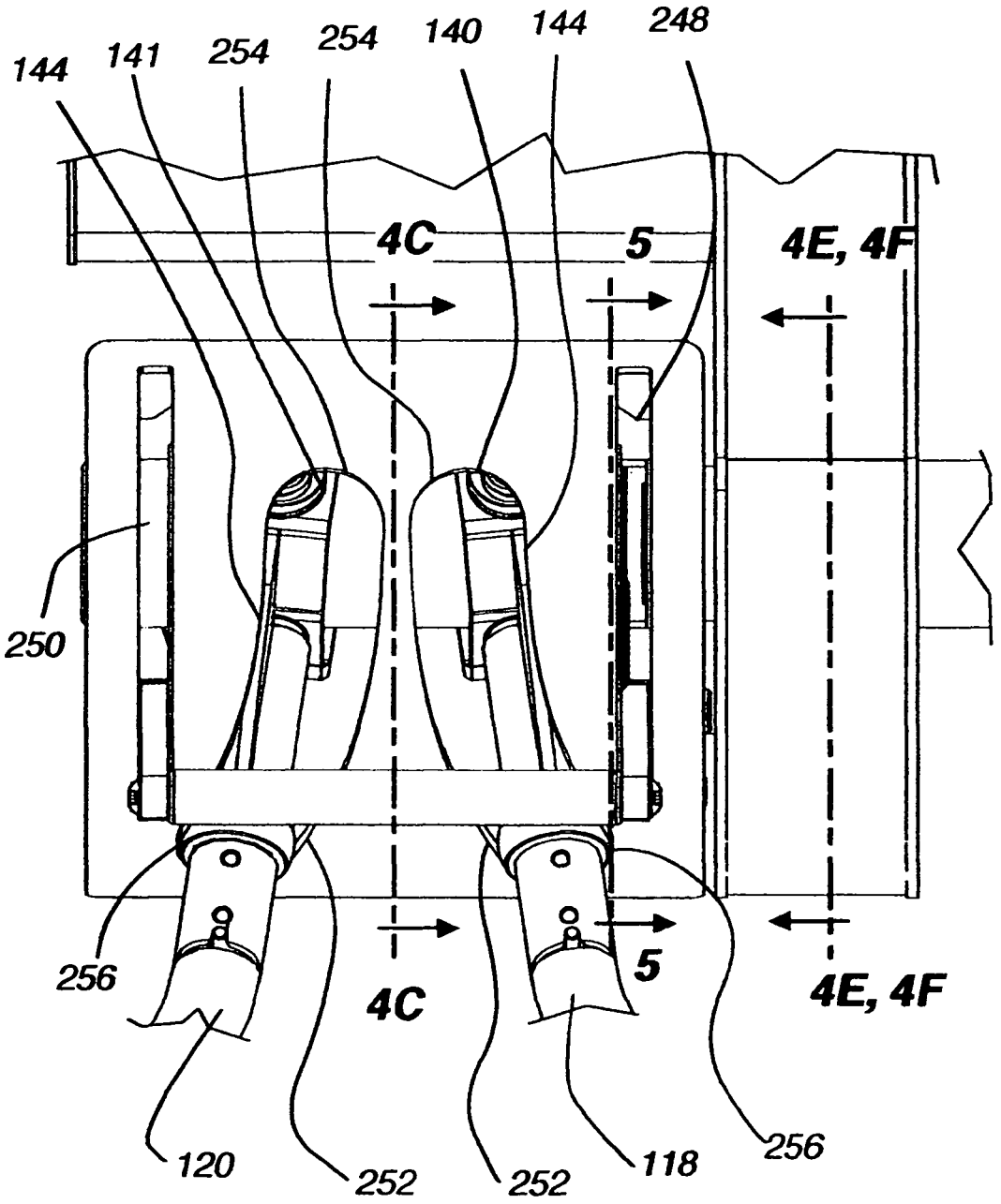
FIG. 4B is a front view of the arm assembly shown in FIG. 4A.
Figure 4C:
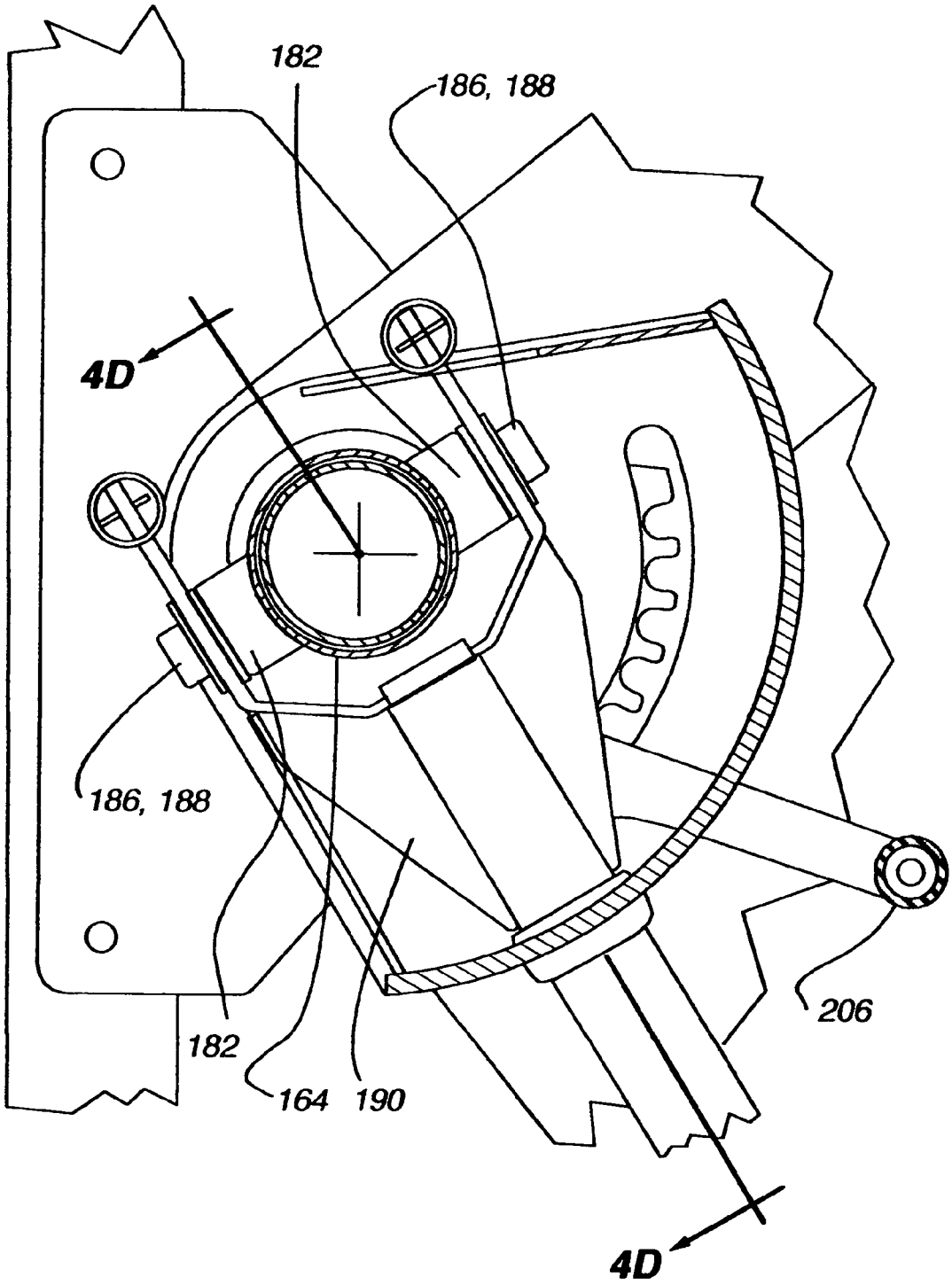
FIG. 4C is a cross-sectional view of the arm assembly shown in FIG. 4B, taken along line 4C-4C.
Figure 4D:
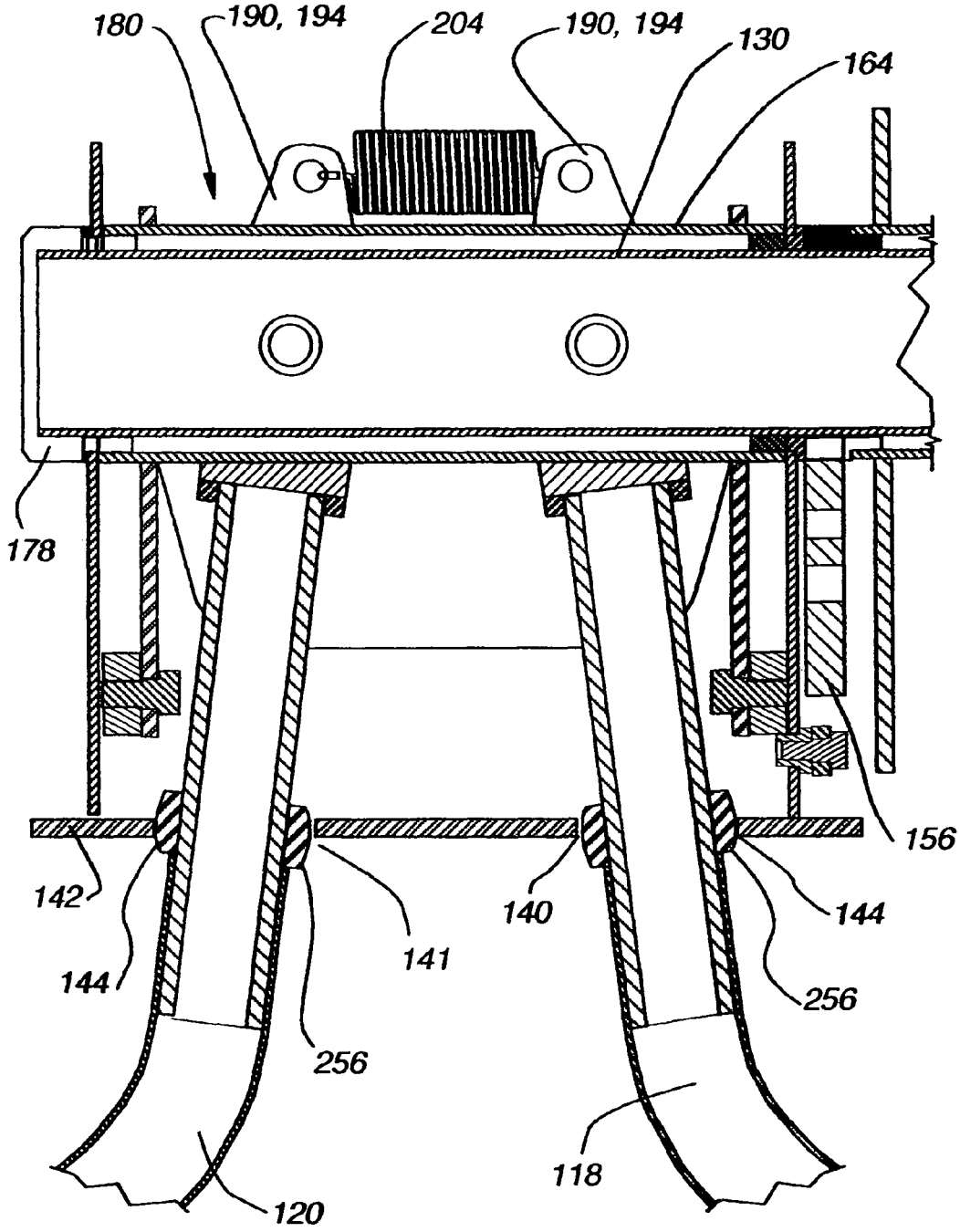
FIG. 4D is a cross-sectional view of the arm assembly shown in FIG. 4C, taken along line 4D-4D.

As previously mentioned, the first and second arms 118, 120 are selectively connected with the drive shaft 130 through the collar 164. As shown in FIGS. 3B, 4C, 4D, and others, the collar 164 is cylindrically-shaped and is adapted to rotate about a second end portion 176 of the drive shaft 130 when adjusting the starting orientation of the arms. The collar 164 is also adapted to connect with the drive shaft 130 to activate the weight stack 114 during exercise. As shown in FIG. 4C, the collar 130 extends between an end cap 178 on the drive shaft 130 and the first sector gear 156 connected with the drive shaft 130. With reference to FIGS. 3A, 3B, 4C, and 4D, the first arm 118 and the second arm 120 are pivotally connected with the collar 164 through a pivot assembly 180 utilizing diametrically opposed pivot mounts 182 on the collar. The pivot mounts 182 are cylindrically-shaped and extend radially outward from the outer surface of the collar 164 to define substantially flat circular bearing surfaces 184. The pivot assembly also includes axle bolts 186 defining pivot axles 188 to pivotally connect C-shaped pivot brackets 190 with the collar 164.

As shown in FIG. 3A, the C-shaped pivot brackets 190 each include first and second pivot plates 192, 194 extending from opposing ends of a base portion 196. Substantially flat mid portions 198 of the pivot plates 192, 194 are adapted to engage the circular bearing surfaces 184 on the pivot mounts 182. The axle bolts 186 extend through the pivot plates and threadedly engage the pivot mounts 182 acting to pivotally connect the pivot plates 192, 194 with the pivot mounts 182. The pivotal connections between C-shaped brackets and the collar allow the arms to pivot relative to the collar during use as the hand grip portions move in a converging and/or diverging relationship to each other. As shown in FIGS. 2B and 3A, a first spring 200 is connected with end portions 202 of the first pivot plates 192, and a second spring 204 is connected with end portions 202 of the second pivot plates 194. The first and second springs 200, 204 are tension springs that pull the end portions 202 of the pivot plates 192, 194 toward each other. As such, the first and second springs are biased to force the arms to pivot about the axle bolts in a direction that forces the gripping portions 134 of the first and second arms 118, 120 away from each other. It is to be appreciated that other embodiments of the arm assembly do not include first and second springs.

As previously mentioned, the releasable locking mechanism 146 allows a user to simultaneously disconnect the arm members 118, 120 from the drive shaft 130 and the cam housing 142 from the arm support member 122, allowing the arm members and the cam housing to pivot together. As shown in FIGS. 3A and 3B, the locking mechanism 146 includes a handle assembly 206 to connect and disconnect the collar 164 from the drive shaft 130, and to connect and disconnect the cam housing 142 from the frame 104 or arm support member 122. The handle assembly 206 is connected with the collar 164. More particularly, the handle assembly 206 is pivotally connected with first and second switch support plates 208, 210 extending radially from first and second end portions 212, 214 of the collar 164, respectively. The handle assembly 206 includes a handle member 216 connected with first and second side members 218, 220. The side members 218, 220 are generally L-shaped and are defined by a relatively short portion 222 and a relatively long portion 224. The handle member 216 is rotatably supported between the relatively long portions 224 of the side members 218, 220. The relatively short portions 222 of the side members 218, 220 are each pivotally supported by respective switch support plates 208, 210.

As shown in FIG. 3B and others, the releasable locking mechanism 146 also includes a first locking member 226 shown in the form of a first pin 228 to selectively connect the handle assembly 206 with the first transmission member 154, shown in the form of the first sector gear 156. It is to be appreciated that the first locking member 226 can be configured in different ways depending upon how the first transmission member 154 is configured. For example, in various embodiments, the first locking member can be configured as a pop-pin, a latch, a pawl, a hook, a collar, a gear wheel, or a clamp. The first pin 228 extends outwardly from the first side member 218 of the handle assembly 206 and is adapted to engage the teeth 160 on the first sector gear 156. As shown in FIGS. 3A and 3B, handle springs 230 are connected between the switch support plates 208, 210 and spring pins 232 extending inwardly from the first and second side members 218, 220. As such, the handle springs 230 pull on the handle assembly 206, which acts to maintain the first pin 228 in engagement with the first sector gear 156. Although two handle springs 230 are shown, it is to be appreciated that the locking mechanism can also be configured with a single handle spring.

When the handle assembly 206 is pivoted to place the first pin 228 into engagement (direction arrow A in FIG. 4E) with the first sector gear 156, the collar 164 is connected with the drive shaft 130 so that the collar and the drive shaft rotate together. To adjust the gripping portions 134 of the arms 118, 120 from a first starting position to a second starting position, the handle assembly 206 is pivoted to disengage the first pin 228 from the first sector gear 156 (direction arrow B in FIG. 4F), which disconnects the collar 164 from the drive shaft 130 such that the collar can rotate relative to the drive shaft. As discussed in more detail below, the cam housing 142 is also disconnected from the arm support member 122 and is connected with the collar 164. The user then pivots the arms up or down to move the arms into the second starting position. Because the cam housing is connected with the collar, the cam housing pivots along with the arms. Once the arms are placed in the desired second starting position, the handle 206 is pivoted in direction A shown in FIG. 4E to reengage the first pin 228 with the first sector gear 156, which reconnects the collar with the drive shaft. The movement of the handle assembly also simultaneously reconnects the cam housing with the arm support member.

A previously mentioned, the cam housing 142 includes arcuately-shaped cam slots 140, 141 that guide the first and second arms 118, 120 through a converging path or diverging path depending on the direction of arm movement. As shown in FIGS. 2B, 3A, 4A, and others, the cam housing 142 includes a first sector-shaped side 234 and a second sector-shaped side 236 connected with and separated by a top side 238 and a bottom side 240. The first side 234 and the second side 236 of the cam housing each have an aperture 242 adapted to receive the drive shaft 130. Ring bearings may also be interposed between the drive shaft 130 and the apertures 242 to rotatably support the cam housing 142 on the drive shaft. As discussed in more detail below, the cam housing 142 can rotate about the drive shaft 130 when the locking mechanism 146 is used to disconnect the cam housing from the arm support member 122. The cam housing 142 also includes a cover or face plate 244 connected with arced edges 246 of the first and second sector-shaped sides 234, 236. The face plate 244 includes first and second handle slots 248, 250 located adjacent to and extending along the arced edges of the first and second sides 234, 236, respectively. As shown in FIG. 4A, the first and second side members 218, 220 of the handle assembly 206 extend through the first and second handle slots 248, 250, respectively, on the face plate 244 of the cam housing 142.

As shown in FIG. 4C and others, the first and second arcuately-shaped cam slots 140, 141 are located in the cover plate 244 inwardly from the handle slots 248, 250. From bottom end portions 252, the cam slots 140, 141 extend upwardly toward top end portions 254 while at the same time curving inwardly toward each other. As previously mentioned, the first and second arms 118, 120 extend from the collar 164 and through the arcuately-shaped cam slots 140, 141, the shape of which guide the arms in converging or diverging motions during exercise. More particularly, as the user presses on the arms, interface members 256, shown in detail in FIGS. 4B and 4D, on the first and second arms 118, 120 roll along the cam surfaces 144 defined by edges of the arcuately-shaped cam slots 140, 141 of the cam housing 142. It is to be appreciated that the interface members can be made from various types of materials, such as plastic. For example, in one embodiment, the interface members are made from a high molecular weight polyethylene. It is also to be appreciated that the interface members can also be connected with the arms such that the interface members slide along the cam surfaces as opposed to rolling. The shape of the of the cam surface guides the first and second arms in a converging motion as the arms are pushed away from the user.

As shown in FIGS. 3A, 3B and others, an arcuate slot 258 is located in the first side 234 of the cam housing 142. The arcuate slot 258 extends circumferentially along with and inwardly from the arced edge 246 of the first side 234. As discussed in more detail below, the first pin 228 extends through the arcuate slot 258. As such, during exercise, the first pin 228 travels back and forth along the arcuate slot 258 as the arms 118, 120, the collar 164, and the drive shaft 130 pivot back and forth. A notch 260 is located in an upper edge of the arcuate slot 258. The notch 260 is adapted to receive a portion of the first pin 228 when the handle assembly 206 is moved to disengage the first pin from the first sector gear 156. As discussed below, moving the handle assembly to place the first pin 228 in engagement with the notch 260 on the arcuate slot 258 connects the collar 164 with the cam housing 142.

As previously mentioned, during exercise, the cam housing 142 is held in a fixed position relative to the arm support member 122. However, the cam housing 142 can also be disconnected from the arm support member to rotate relative to the drive shaft 130 to allow a user to change the desired starting position of the arms 118, 120. As described in more detail below with reference to FIGS. 3B, 4E, and 4F, the cam housing 142 is selectively coupled with the arm support member 122 through a second locking member 262, shown in the form of a second pin 264, adapted to engage a second transmission member 266, shown in the form of a second sector gear 268 fixedly connected with the arm support member 122. The second sector gear 268 includes a plurality of teeth 270, and the second pin 264 is adapted to selectively engage the teeth 270 to connect the cam housing 142 with the arm support member 122. Although the second transmission member 266 is depicted and described as a second sector gear, it is to be appreciated that the second transmission member, can be configured in other ways. For example, in one embodiment, the second transmission member is in the form of an arcuate plate having a plurality of circumferentially spaced apertures. In another embodiment, the second transmission member is in the form of a disk having a plurality of circumferentially spaced and radially extending apertures. Further, it is to be appreciated that the second locking member 262 can be configured in different ways depending upon how the second transmission member is configured. For example, in various embodiments, the second locking member can be configured as a pop-pin, a latch, a pawl, a hook, a collar, a gear wheel, or a clamp.

As discussed in more detail below, the handle assembly 206 is configured such that when the user moves the handle member 216 to disengage the first pin 228 from the first sector gear 156 (direction arrow B in FIG. 4F), the second pin 264 simultaneously disengages from the second sector gear 268. When the first pin is disengaged from the first sector gear and when the second pin is disengaged from the second sector gear, the collar 164 and the cam housing 142 can pivot about the drive shaft 130. In addition, when the first pin 228 is disengaged from the first sector gear 156, the first pin engages the notch 260 in the arcuate slot 258 in the cam housing 142 to connect the cam housing with the collar 164. As such, when a user pivots the arms to the desired starting position, the cam housing 142 rotates with collar 164.

As shown in FIGS. 3A and 3B, the second pin 264 is connected with a first end portion 272 of an elongated member 274. A second end portion 276 of the elongated member is pivotally connected with the first side 234 of the cam housing 142. The second pin 264 extends outward from the elongated member 274 to engage the second sector gear 268 connected with the arm support member 122. As illustrated, the second sector gear 268 is formed in a side 278 of the housing 124 of the pull-down exercise station 126. It is to be appreciated that the second sector gear can be configured as an individual member connected with the arm support member on embodiments that do not include the pull-down exercise station. A coil spring 280 is also connected with the elongated member 274 and the first side 234 of the cam housing 142. The coil spring 280 is biased to pivot the elongated member 274 (direction arrow A' shown in FIG. 4E) to force the second pin 264 into engagement with the second sector gear 268.

Figure 4E:
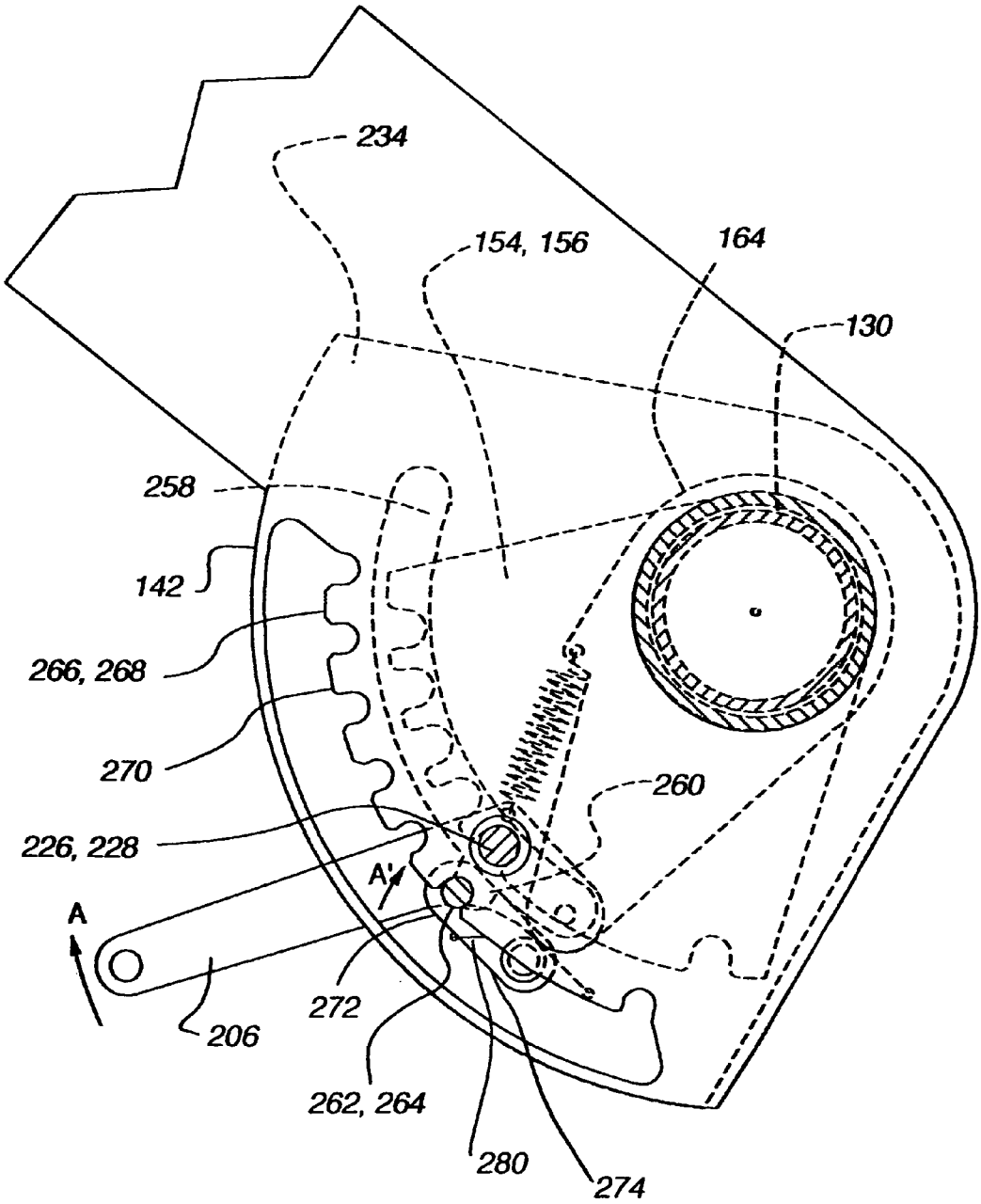
FIG. 4E is a cross-sectional view of the arm assembly shown in FIG. 4B, taken along line 4E-4E through a second sector gear and showing a first pin engaged with a first sector gear and a second pin engaged with the second sector gear.
Figure 4F:
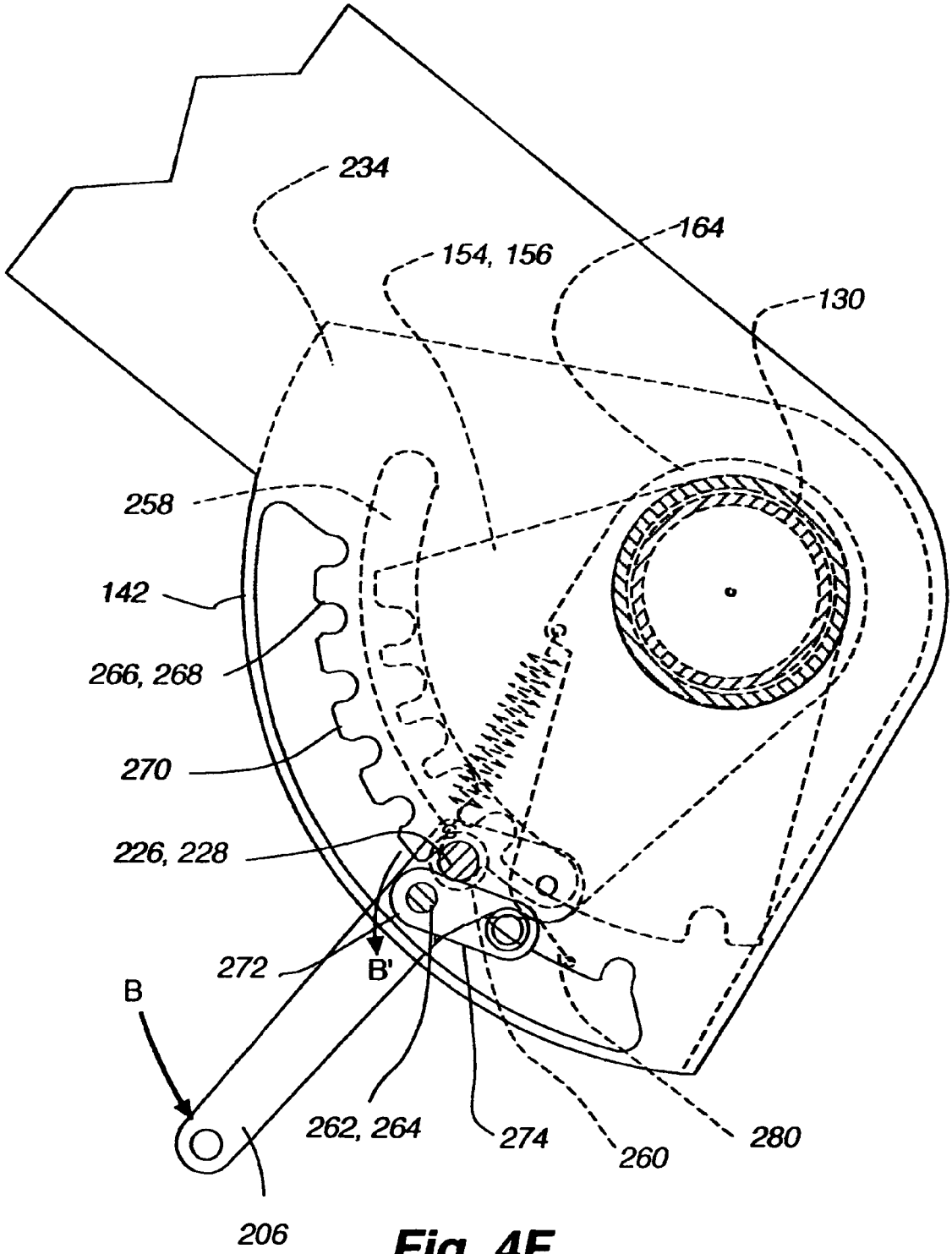
FIG. 4F is a cross-sectional view of the arm assembly shown in FIG. 4B, taken along line 4F-4F through the second sector gear and showing the first pin engaged with the a notch in a cam housing and the second pin disengaged from the second sector gear.

As shown in FIGS. 4E and 4F, the first pin 228 extends through the arcuate slot 258 located in the first side 234 of the cam housing 142. The first pin 228 is located adjacent to the first end portion 272 of the elongated member 274 supporting the second pin 264 when the arms 118, 120 are located in the bottom end portions 152 of the arcuate cam slots 140, 141, as shown for example in FIG. 4B. As shown in FIG. 4F, moving the handle assembly 206 in direction B moves the first pin 228 into the notch 260 on the arcuate slot 258, which connects the collar 164 with the cam housing 142. Further, placing the first pin 228 in engagement with the notch 260 also causes the first pin to engage the first end portion 272 of the elongated member 274, causing the elongated member to pivot about the second end portion 276 in direction B', causing the second pin 264 to disengage from the second sector gear 268. When the second pin is disengaged from the second sector gear, the cam housing 142 can pivot relative to the arm support member 122.

As previously discussed with reference to the components identified in FIGS. 1A-4F, a user can pivot the handle assembly 206 on the releasable locking mechanism 146 to simultaneously decouple the cam housing 142 from the arm support member 122 and decouple the collar 164 and the first and second arms 118, 120 from the drive shaft 130. Once decoupled, the arms and cam housing can be rotated together to a desired starting position. After pivoting the arms to the desired starting position, the handle assembly 206 can be released to allow the handle springs 230 to pivot the handle assembly and recouple the cam housing 142 with the arm support member 122 and recouple the collar and arms with the drive shaft 130. When moving the arms and cam housing to the desired starting position, the arms 118, 120 pivot with the cam housing 142. As such, the cam housing does not cause the gripping portions 134 of the arms to converge or diverge. Therefore, the distance between the gripping portions do not change when the arms are placed into a desired starting position.

Figure 5A:
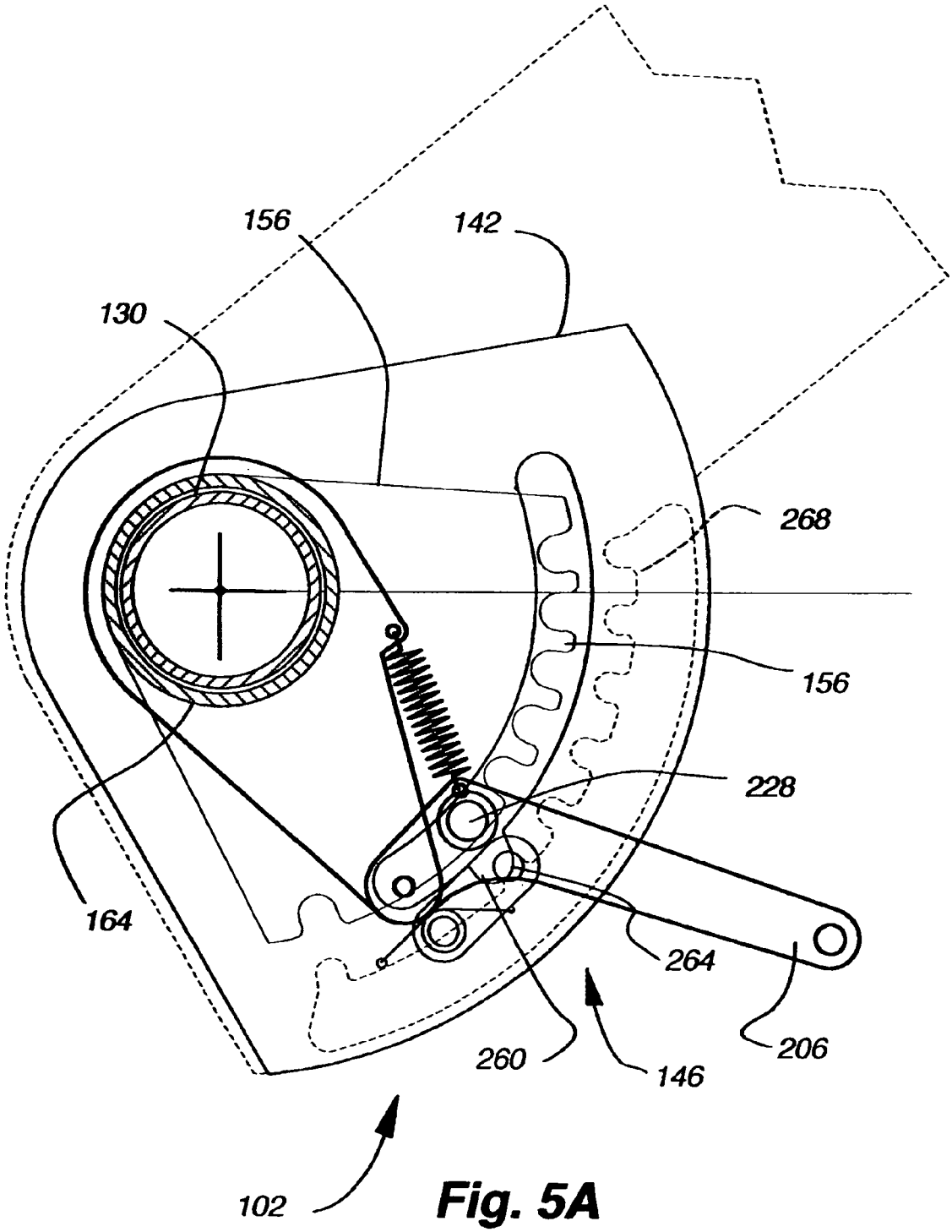
FIG. 5A is a cross-sectional view of the arm assembly shown in FIG. 4B, taken along line 5-5, schematically representing the cam housing, collar, and releasable locking mechanism with the first pin engaged with the first sector gear and the second pin engaged with the second sector gear.

The operation of the arm assembly when positioning the arms and cam housing from a first starting position to second starting position is described below with reference to FIGS. 5A-5D. FIG. 5A shows the arm assembly 102 in a first starting position. More particularly, FIG. 5A is a cross-sectional view of the arm assembly 102 shown in FIG. 4B, taken along line 5-5, schematically representing the cam housing 142, collar 164, and handle assembly 206 with the first pin 228 engaged with the first sector gear 156 and the second pin engaged 264 with the second sector gear 268. Although the arms 118, 120 are not shown in FIGS. 5A-5D, it is to be appreciated that the arms are connected with and pivot with the collar.

Figure 5B:
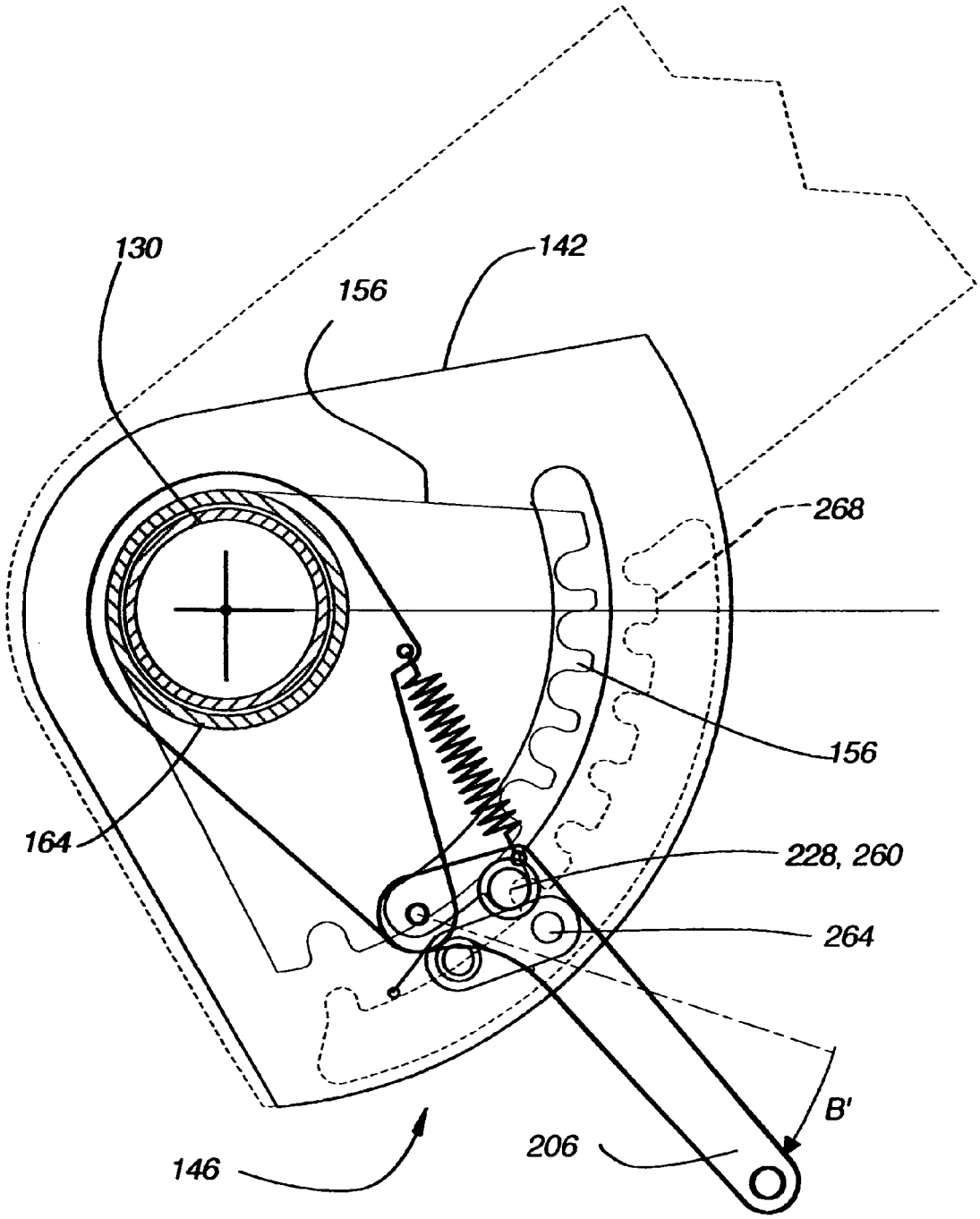
FIG. 5B is a view of the arm assembly shown in FIG. 5A with the releasable locking mechanism activated to disengage the first pin from the first sector gear and the second pin from the second sector gear.

Before pivoting the arms 118, 120, collar 164, and cam housing 142 from the first starting position of FIG. 5A, the releasable locking mechanism 146 is activated to decouple the collar and arms from the drive shaft 130 and to decouple the cam housing from the arm support member 122. At the same time, the releasable locking mechanism is activated to couple the cam housing with the collar. For example, FIG. 5B is a view of the arm assembly shown in FIG. 5A with the releasable locking mechanism 146 activated to disengage the first pin 228 from the first sector gear 156 and the second pin 264 from the second sector gear 268. More particularly, as shown in FIG. 5B, the handle assembly 206 is pivoted in direction B' relative to the collar 164 so that the first pin 228 is disengaged from the first sector gear 156 and engaged the notch 260 in the cam housing 142 to connect the cam housing with the collar 164. As such, a user may now pivot the arms 118, 120 and collar 164 relative to the drive shaft 130 in order to select a desired second starting position of the arms. Further, pivoting the first pin 228 out of engagement with the first sector gear 156 disengages the second pin 264 from the second sector gear 268 which decouples the cam housing 142 from the arm support member 122 and allows the cam housing to pivot relative to the drive shaft 130.

Figure 5C:
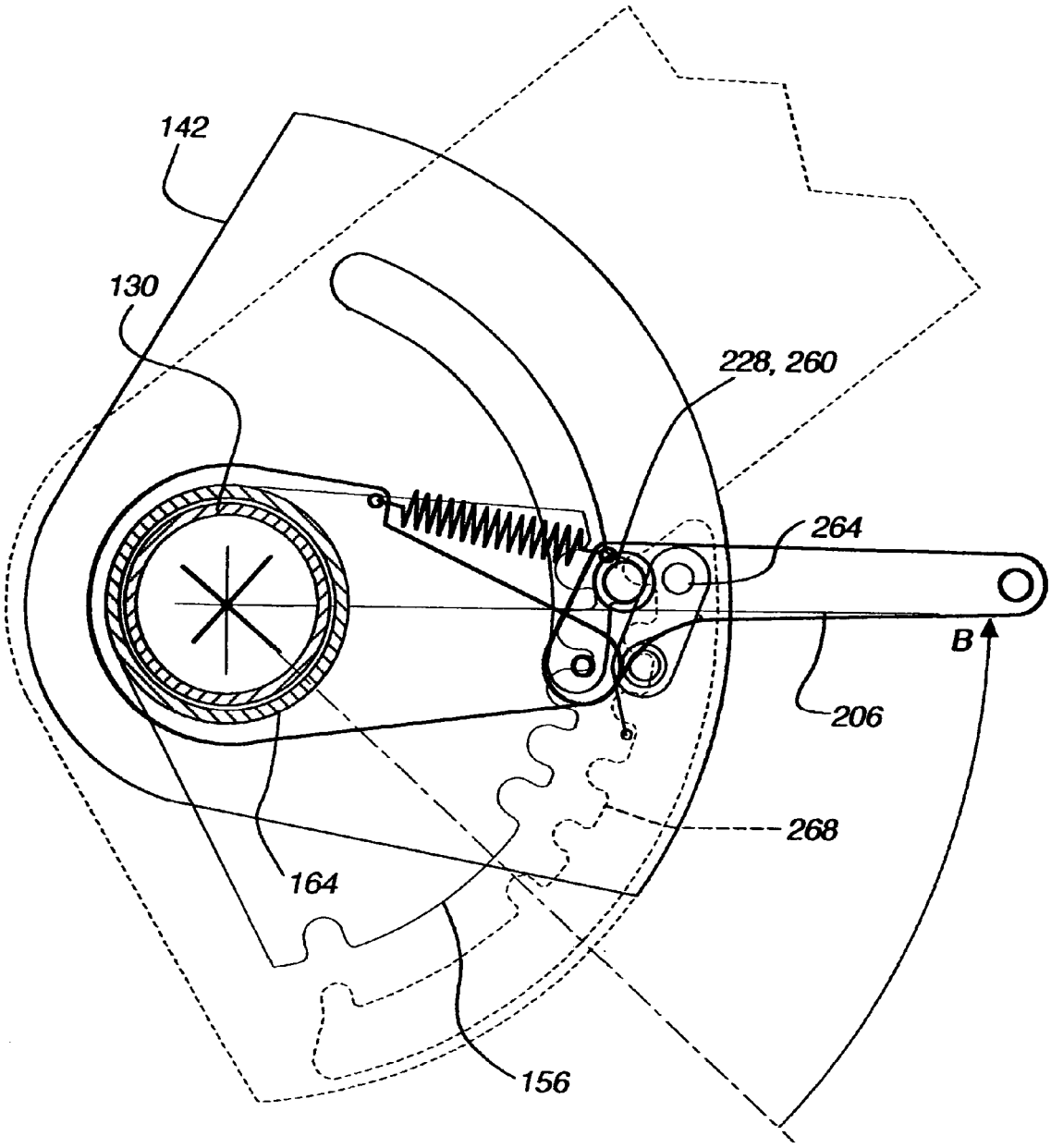
FIG. 5C is a view of the arm assembly shown in FIG. 5B showing the cam housing, collar and arms being pivoted to place the arms in a new starting position.
Figure 5D:
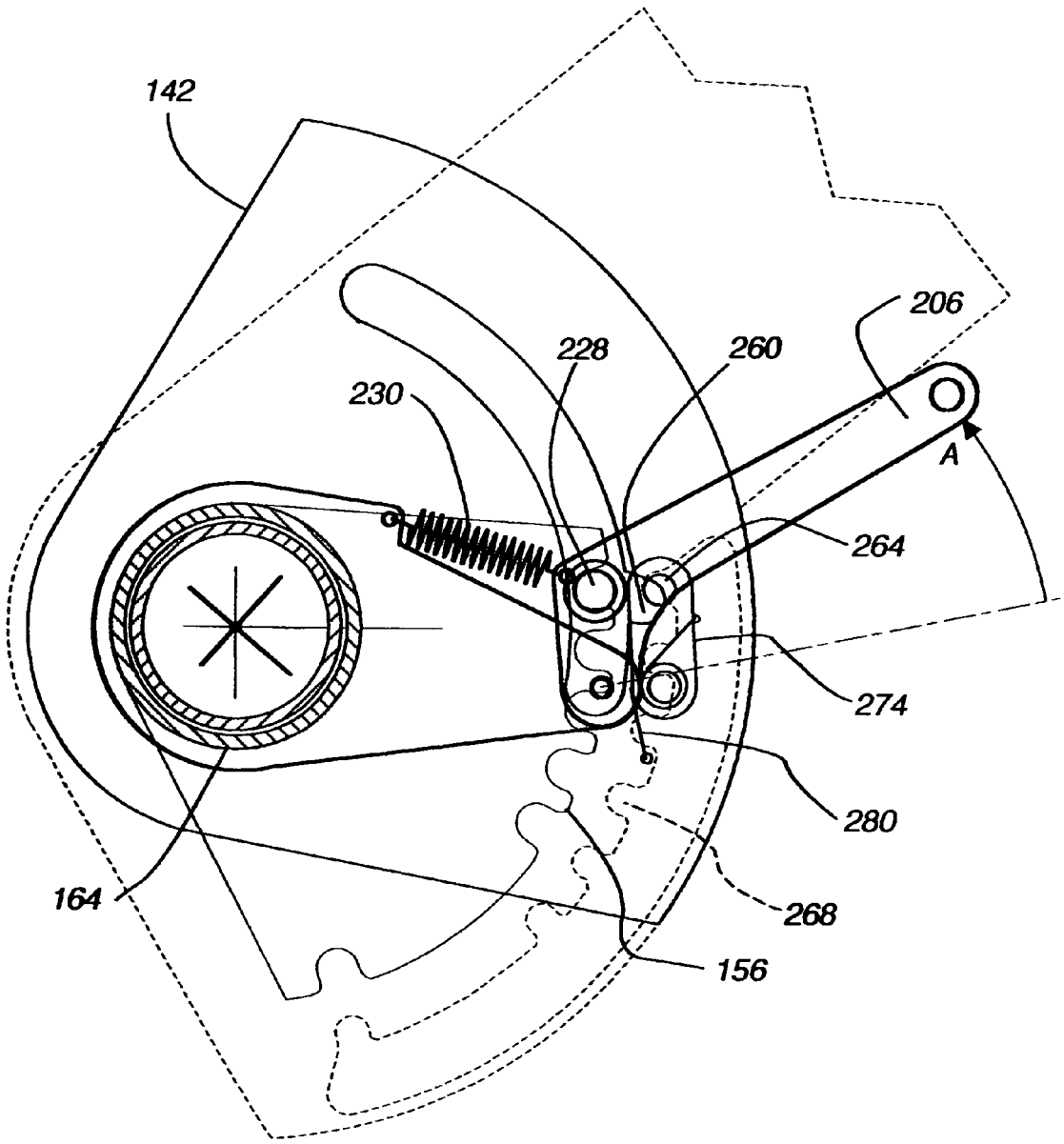
FIG. 5D is a view of the arm assembly shown in FIG. 5C showing the collar and cam housing placed in a new starting position and the first pin re-engaged with the first sector gear and the second pin re-engaged with the second sector.

FIG. 5C is a view of the arm assembly shown in FIG. 5B showing the cam housing 142 and collar 164 being pivoted as represented by direction arrow B to place the arms 118, 120, cam housing 142, and collar 164 in a desired second starting position. Once in the desired starting position, the handle assembly 206 can be released, which allows the handle springs 230 to pivot the handle assembly 206 as represented by direction arrow A in FIG. 5D to force the first pin 228 into engagement with the first sector gear 156. At the same time, the coil spring 280 forces the elongated member 274 to pivot and place the second pin 264 into engagement with the second sector gear 268, as shown in FIG. 5D. As such, FIG. 5D shows the arm assembly of FIG. 5C with the arms, collar, and cam housing placed in a desired second starting position with the first pin re-engaged with the first sector gear and the second pin re-engaged with the second sector gear.

Figure 6A:
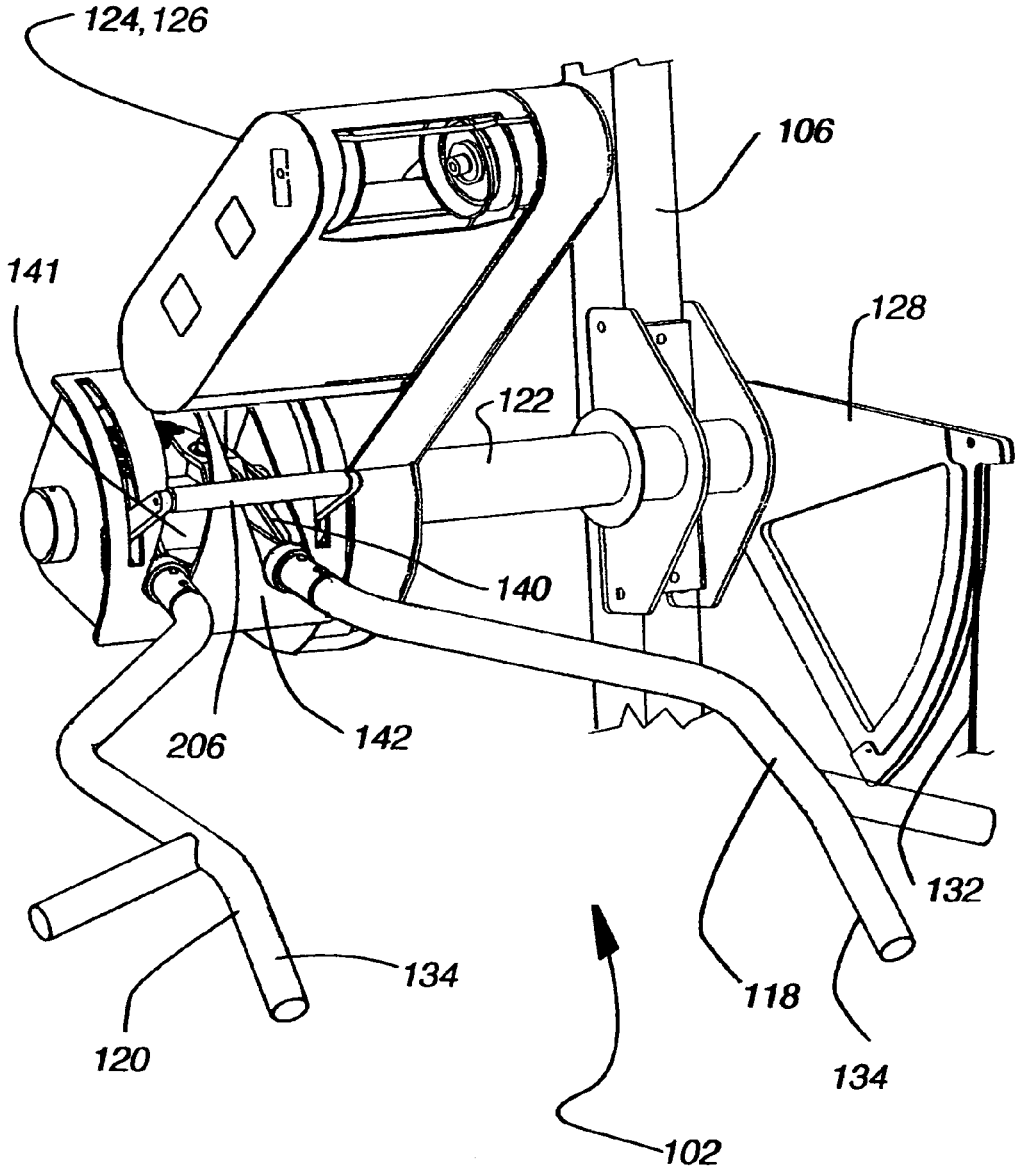
FIG. 6A is a view of the arm assembly shown in FIG. 2A with the arms pivoted to a new starting position.
Figure 6B:
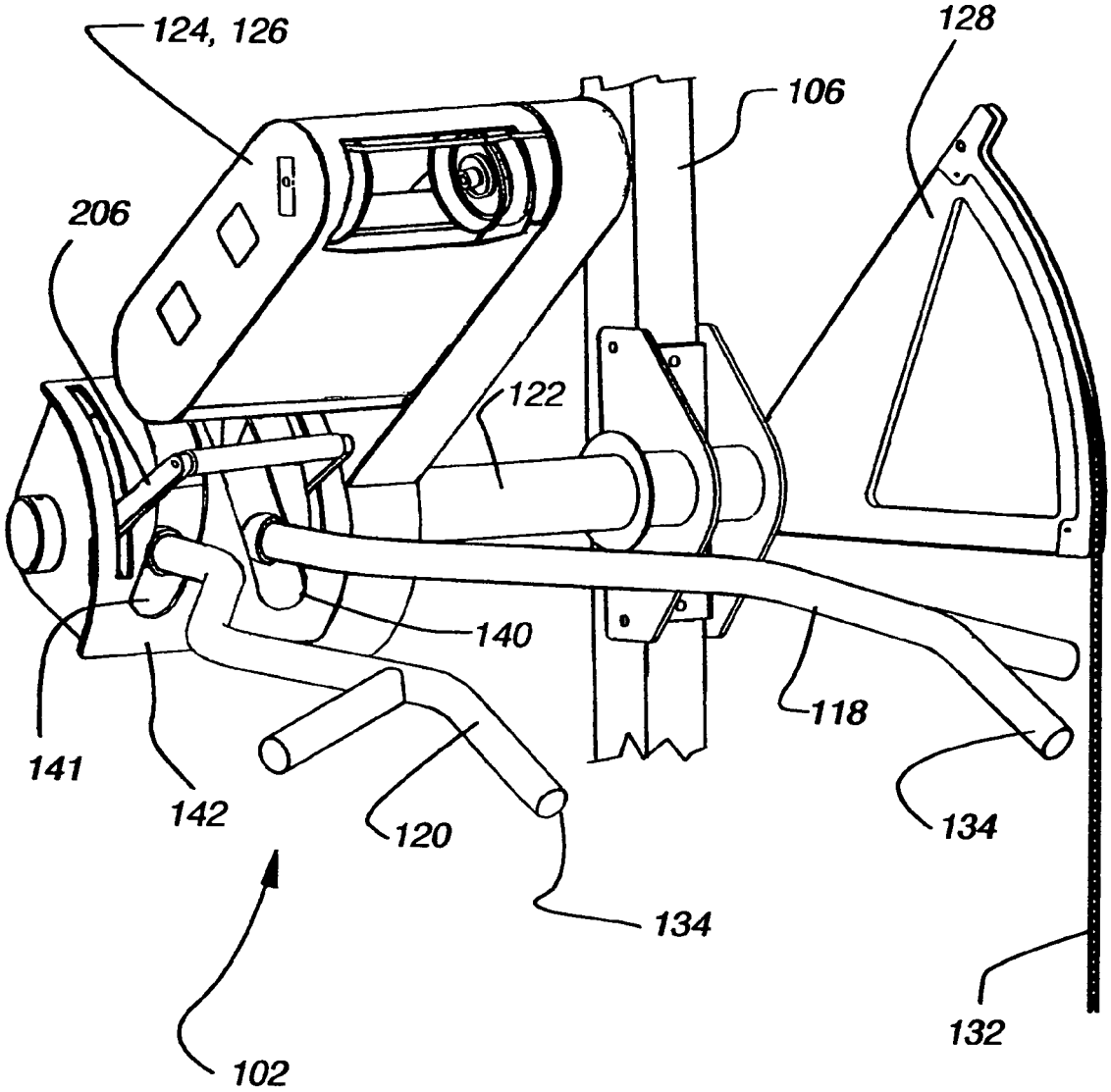
FIG. 6B is a view of the arm assembly shown in FIG. 2B with the arms pivoted upward relative to the cam housing.

FIG. 6A is a view of the arm assembly shown in FIG. 2A with the arms pivoted to a new starting position. FIG. 6B is a view of the arm assembly shown in FIG. 2B that illustrates the movement of the arms 118, 120 in use as the arms are pivoted upward through the cam slots 140, 141 in the cam housing 142. As shown in FIG. 6B, the cam slots guide the arms in a converging motion.

FIGS. 7A-8D show an alternative arm assembly 102' conforming to aspects of the present invention. The arm assembly 102' of FIGS. 7A-8D is similar to the arm assembly 102 of FIGS. 1A-6B. For example, the alternative arm assembly includes a releasable locking mechanism 146' used to simultaneously connect and disconnect two arms 118', 102' and a collar 164' with a drive shaft 130' as well as a cam housing 142' with an arm support member 122'. However, there are some structural differences between the arm assembly 102' of FIGS. 7A-8D and the arm assembly 102 of FIGS. 1A-6B. For example, the locking mechanism 146' of the alternative arm assembly 102' does not utilize a handle assembly pivotally connected with the collar to connect and disconnect the collar with the drive shaft and the cam housing with the frame. Instead, the locking mechanism 146' of the alternative arm assembly 102' utilizes two pop-pin assemblies simultaneously actuated by the linear movement of a pull handle. In addition, the cam housing 142' of the alternative arm assembly 102' is configured differently than the cam housing 142 of the embodiment described above with reference to FIGS. 1A-6B. For example, as opposed to having two separate cam slots, the cam housing 142' of the alternative embodiment 102' includes a single opening 282 in a face plate 244' through which the arms 118', 102' extend.

As previously mentioned, the alternative arm assembly 102' shown in FIGS. 7A-8D includes first and second arms 118', 120' pivotally coupled with the drive shaft 130' through the collar 164'. The drive shaft 130' of the alternative arm assembly 102' is also rotatably supported within the arm support member 122', and a sector member 128' is connected with a first end portion 150' of the drive shaft 130' as described above with reference to the first embodiment. The alternative arm assembly 102' also includes a first transmission member 154', shown as a first sector gear 156', connected with the drive shaft 130' adjacent a second end portion 158' of the arm support member 122'. As discussed in more detail below, the releasable locking mechanism 146' includes a first locking member 226', shown as a first pop-pin 284, adapted to engage the first sector gear 156' to selectively connect the arms 118', 120' with the drive shaft 130'. Although the first transmission member 154' is depicted and described as a first sector gear, it is to be appreciated that the first transmission member can be configured in other ways, as discussed above with reference to the first embodiment of the arm assembly. Further, it is to be appreciated that the first locking member 226' can also be configured in different ways depending upon how the first transmission member is configured, as discussed above with reference to the first embodiment of the arm assembly.

Figure 7A:
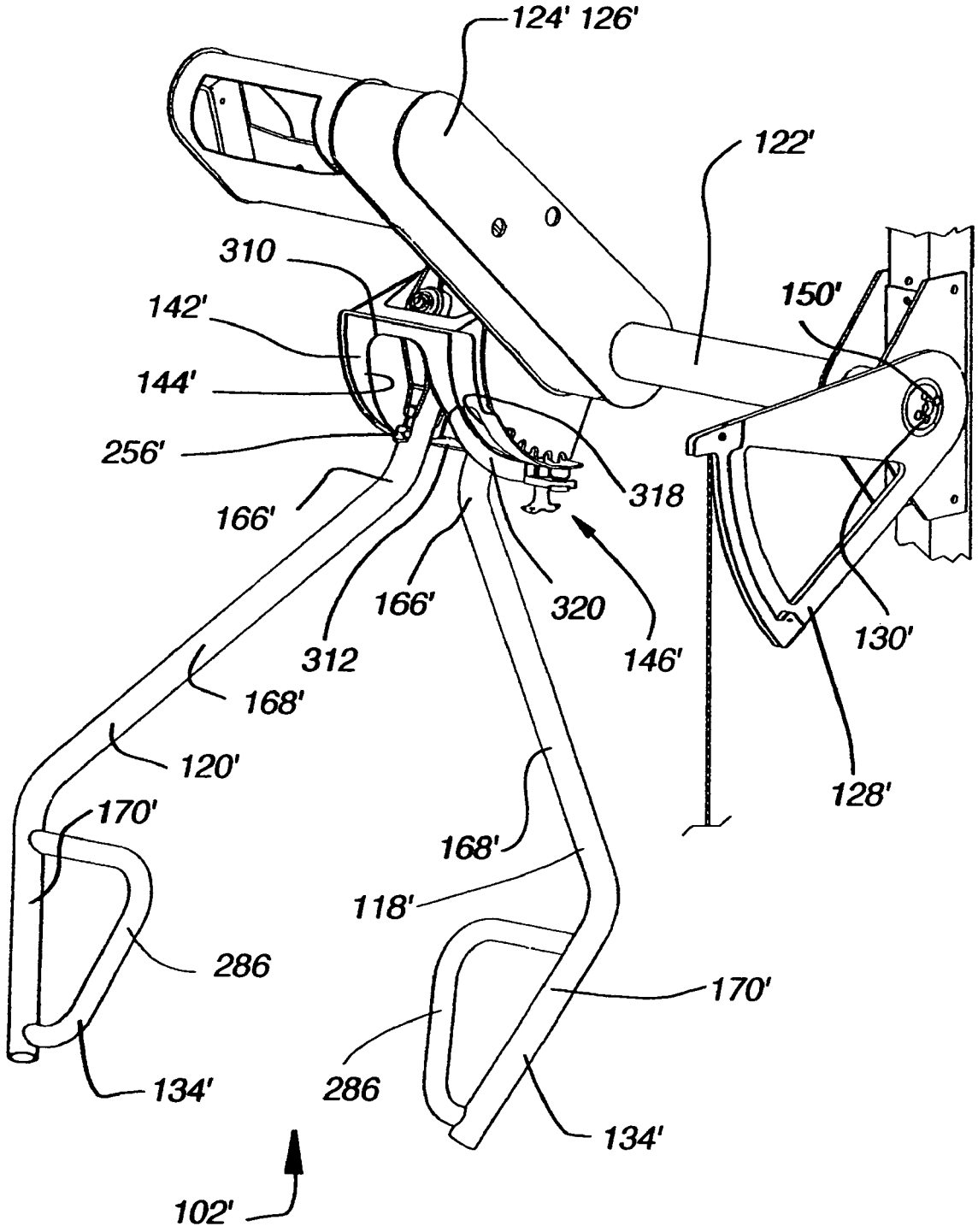
FIG. 7A is an isometric view of a first alternative embodiment of an arm assembly.
Figure 7B:
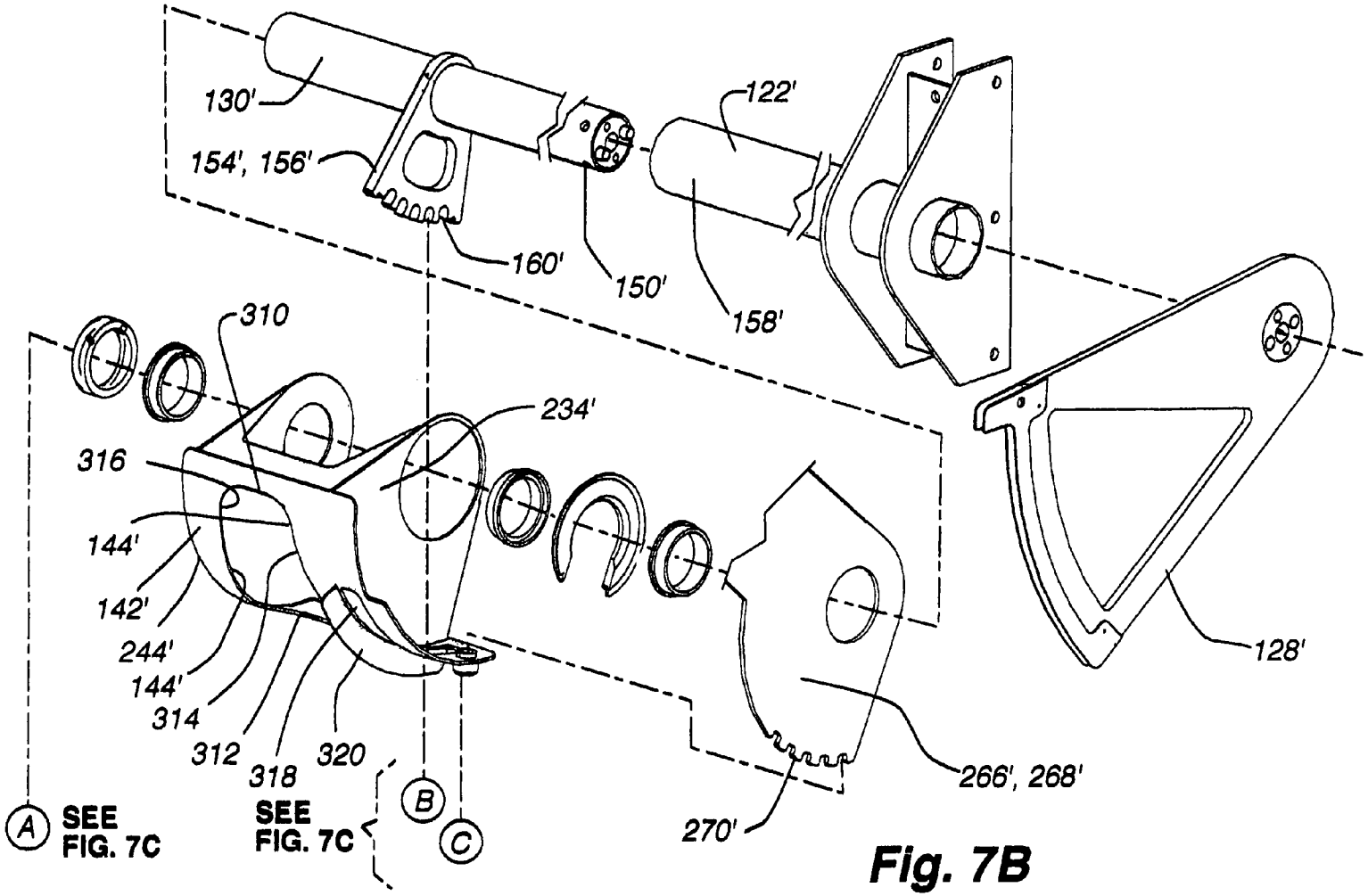
FIG. 7B is an exploded view of the arm assembly shown in FIG. 7A.
Figure 7C:
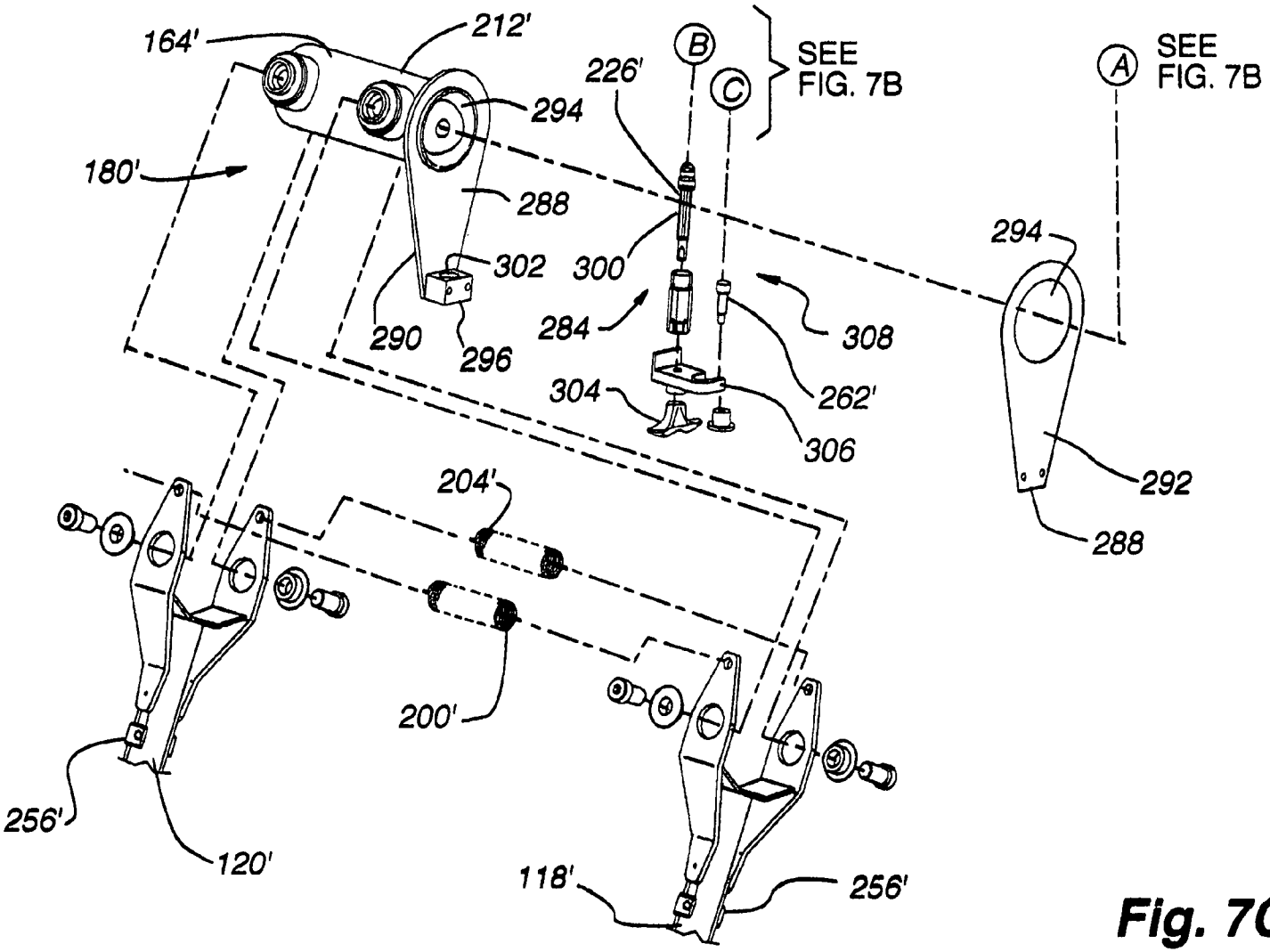
FIG. 7C is an exploded view of the arm assembly shown in FIG. 7A.

As shown in FIGS. 7B and 7C, the first and second arms 118', 120' are pivotally connected with the collar 164', which in turn, is selectively connected with the drive shaft 130'. The first and second arms 118', 120' are pivotally connected with the collar 130' through a pivot assembly 180' as described above with reference to the first embodiment. As described above with referenced to the first embodiment, the arm assembly 102' can also include first and second tension springs that are biased to force the arms to pivot relative to the collar in a direction that forces gripping portions 134' of the first and second arms 118', 120' away from each other. As such, the forces exerted on the arms by the first and second tension springs act to hold the arms in contact with outside edges or cam surfaces 144' of the cam aperture 282. From first end portions 166', the first and second arms 118', 120' extend from the collar 130' and through the cam aperture 282 in the cam housing 142'. With reference to FIG. 7A, the first end portions 166' of the first and second arms transition to angularly offset mid portions 168' outside of the cam housing 142'. From outside the cam housing, the mid portions 168' of the first and second arms 118', 120' extend in diverging relation to each other to angularly offset second end portions 170'. From the mid portions 168', the second end portions 170' extend in converging relation to each other. Handle grip members 286 are connected with the second end portions 170' of the first and second arms 118', 120', defining generally triangularly-shaped gripping portions 134' of the arms. It is to be appreciated that an exercise device conforming to the present invention may utilize arms having different shapes than what are depicted and described herein.

As previously mentioned, the releasable locking mechanism 146' utilizes the first pop-pin 284, which adapted to engage teeth 160' on the first sector gear 156' to selectively connect the arms 118', 120' with the drive shaft 130'. As shown in FIGS. 7B-8D, a first pop-pin support assembly 288 is connected with a first end portion 212' of the collar 164'. The first pop-pin support assembly 288 includes first and second radially extending support plates 290, 292 adjacent to opposing sides of the first sector gear 156'. The first and second support plates include apertures 294 adapted receive the drive shaft 130'. The first pop-pin is supported on a support base 296 arranged between outward end portions of the support plates 290, 292. The first pop-pin is arranged to selectively engage the teeth 160' on the first sector gear 156'. As shown in FIGS. 8C and 8D, the first pop-pin 284 includes a spring 298 that forces a pin 300 through an aperture 302 in the support base 296 and into engagement with the first sector gear 156'. When the first pop-pin 284 is engaged with the first sector gear 156', the collar 164' is connected with the drive shaft 130' such that the collar and the drive shaft rotate together. The first pop-pin 284 can be disengaged from the first sector gear 156' by pulling on a pull handle member 304 connected with the first pop-pin assembly 284. As such, when the handle member 304 is moved to disengage the first pop-pin 284 from the first sector gear 156' (direction arrow A in FIG. 8D), the collar 164' is decoupled from the drive shaft 130' such that the collar can rotate relative to the drive shaft. A collar bracket 306 is connected with the first pop-pin 284 and is adapted to connect the first pop-pin with a second locking member 262', shown as a second pop-pin 308, as discussed in more detail below.

With the exception of the face plate 244' and a first sector-shaped side 234', the cam housing 142' shown in FIGS. 7A and 7B is similar to the cam housing 142 described above with reference to FIGS. 2A and 2B. The cam housing 142' is also adapted to rotate about the drive shaft 130' when decoupled from the arm support member 122'. As previously mentioned, the first and second arms 118', 120' extend from the collar 164' through the cam aperture 282. As shown in FIGS. 7A and 7B, the cam aperture 282 is defined by a top edge 310 and a bottom edge 312 separated by first and second arcuate side edges 314, 316. The two arcuate side edges 314, 316 define the cam surfaces 144', which guide the converging and diverging motion of the first and second arms as the arms move relative to the cam housing. From the bottom edge 312, the arcuate side edges 314, 316 extend upwardly toward the top edge 310 while at the same time curving inwardly toward each other. Forces exerted by first and second tension springs 200', 204' on the arms act to hold the arms in contact with the arcuate side edges 314, 316. As the arms move relative to the cam housing 142', interface members 256' on the first and second arms 118', 120' slide along the cam surfaces 144' defined by the arcuate side edges 314, 316 of the cam aperture 282. It is to be appreciated that the interface members can be made from various types of materials, such as plastic as discussed above with reference to the first embodiment. It is also to be appreciated that the interface members can also be connected with the arms such that the interface members rolls along the cam surfaces as opposed to sliding.

Figure 8B:
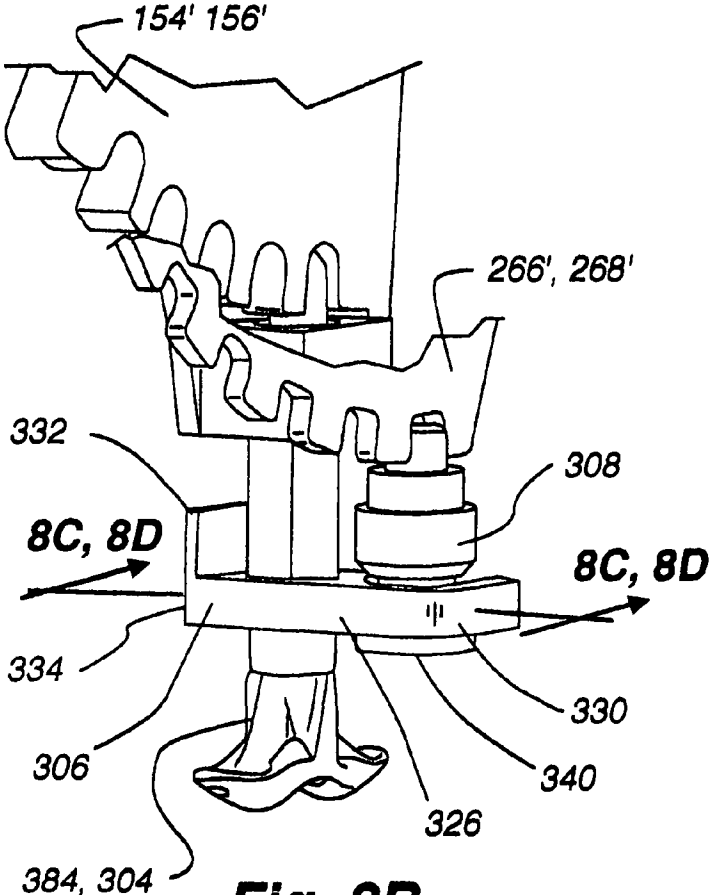
FIG. 8B is a detailed view of the arm assembly of FIG. 8A showing an interface between the first and second pop-pins with first and second sector gears.
Figure 8A:
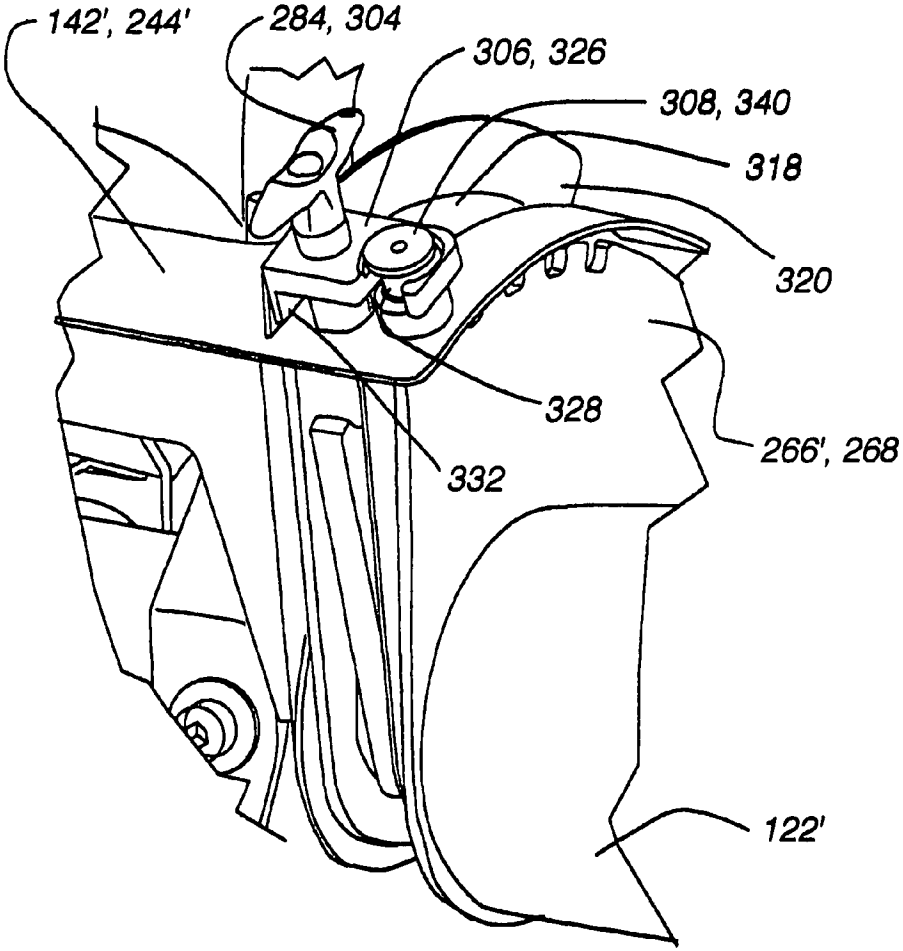
FIG. 8A is a detailed view of the arm assembly of FIG. 7A showing a cam housing, a first pop-pin, and a second pop-pin.
Figure 8C:
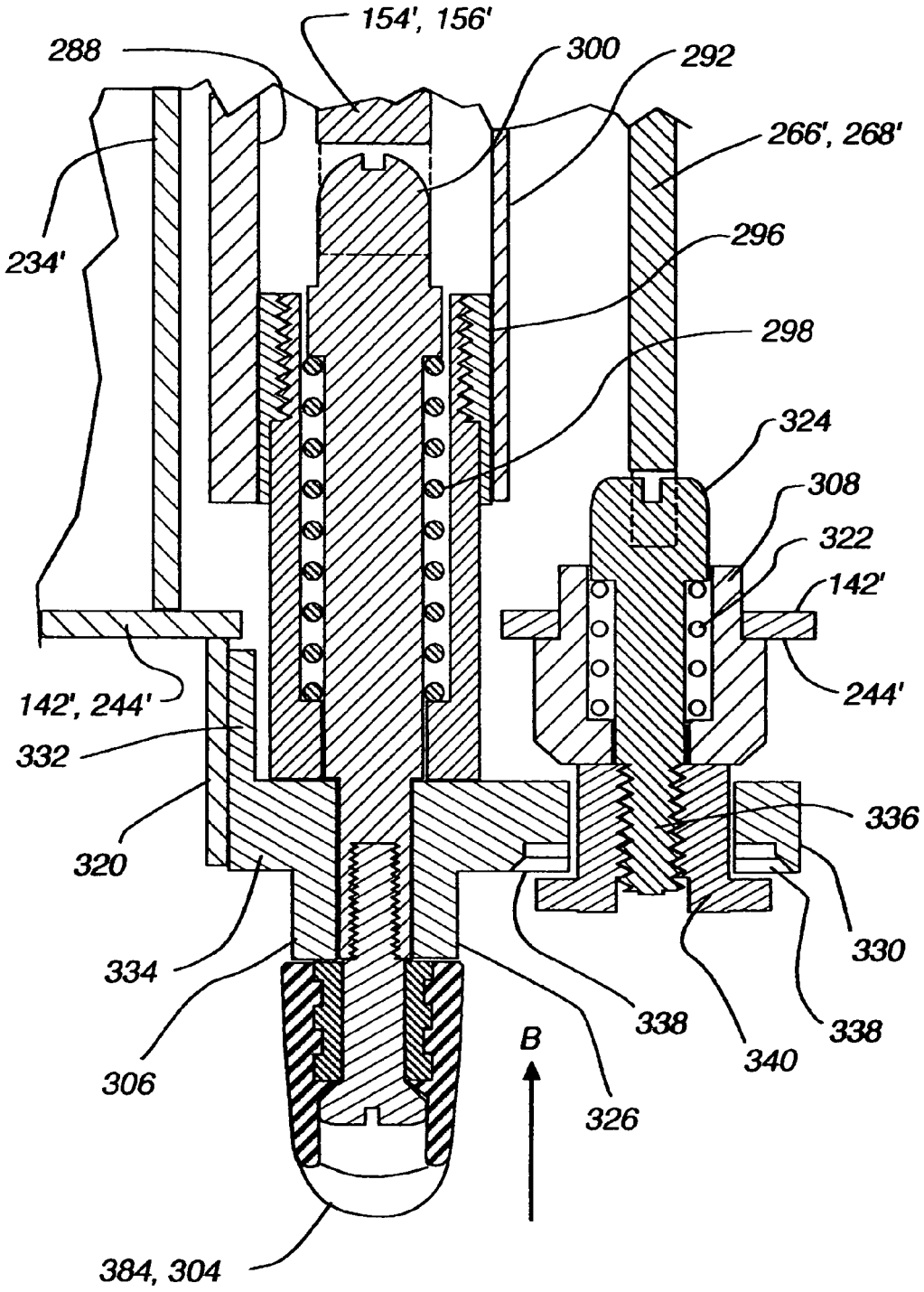
FIG. 8C is a cross-sectional view of the arm assembly shown in FIG. 8B, taken along line 8C-8C showing the first and second pop-pins engaged with the first and second sector gears, respectively.
Figure 8D:
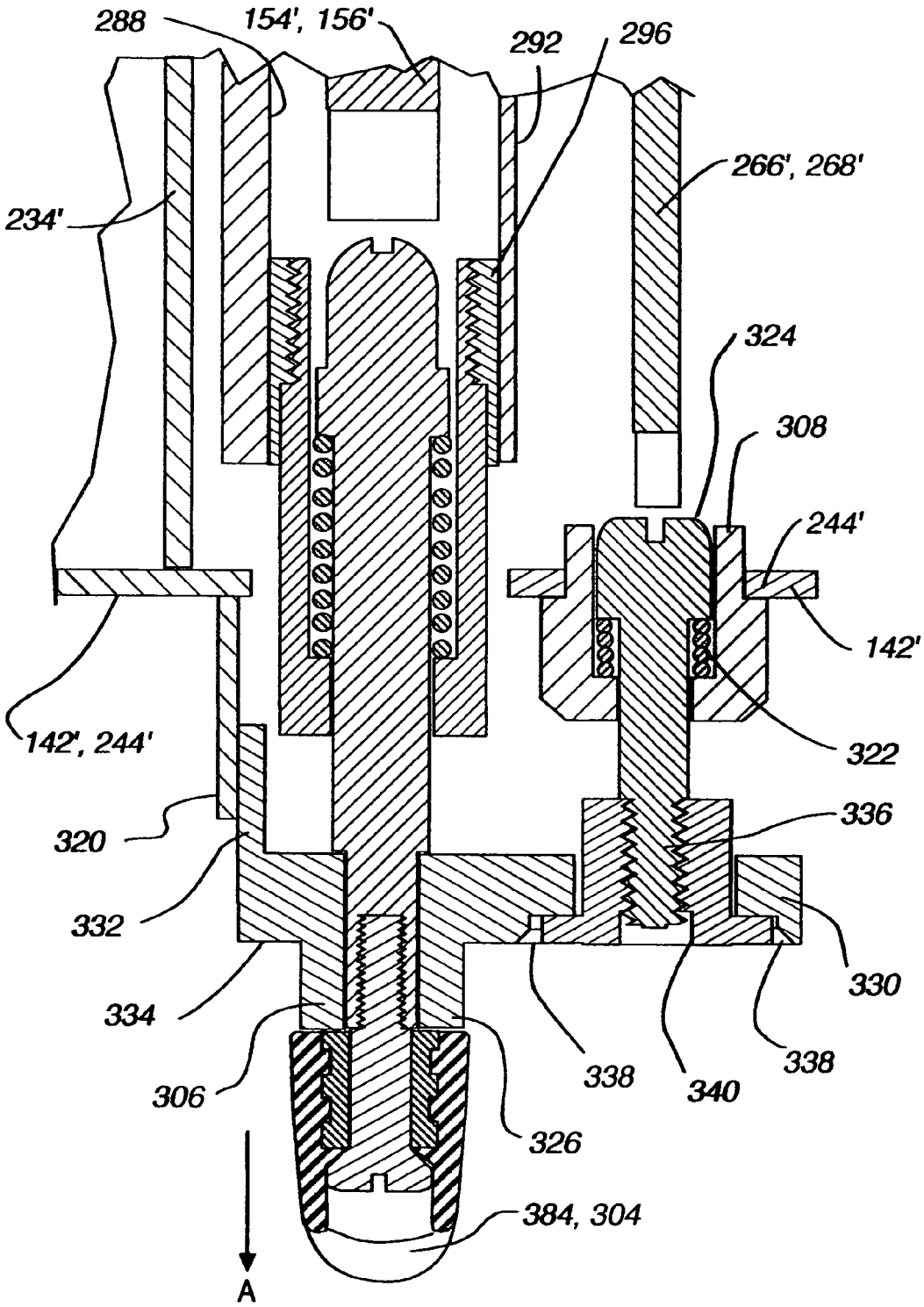
FIG. 8D is a cross-sectional view of the arm assembly shown in FIG. 8B, taken along line 8D-8D showing the first and second pop-pins disengaged from the first and second sector gears, respectively.

As shown in FIGS. 7B and 8A, a slot 318 in the face plate 244' of the cam housing 142' extends along the first side edge 314 of the cam aperture 282. As discussed in more detail below, a portion of the first pop-pin 284 extends through the slot 318. As such, during exercise, the first pop-pin travels back and forth along the slot as the arms 118', 120', the collar 164', and the drive shaft 130' pivot back and forth. The collar bracket 306 on the first pop-pin assembly 284 also moves back and forth along with the first pop-pin assembly during exercise. As discussed in more detail below, a guide plate 320 extending radially outward from the face plate 244' of the cam housing 142' acts to maintain the orientation of the collar bracket 306 with respect to the second pop-pin assembly 308.

As discussed above, during exercise, the cam housing 142' is held in a fixed position relative to the frame of the exercise device through the arm support member 122'. The cam housing 142' can also be decoupled from the arm support member 122' to rotate relative to the drive shaft 130' when changing the desired starting position of the arms 118', 120'. As described in more detail below, the cam housing 142' is selectively connected with the arm support member through the second pop-pin assembly 308, which is adapted to engage a second transmission member 266', shown as a second sector gear 268' fixedly connected with the arm support member 122'. The collar bracket 306 on the first pop-pin assembly 284 is configured such that when the user moves the handle member 306 to disengage the first pop-pin 284 from the first sector gear 156' (direction arrow A in FIG. 8D), the second pop-pin 308 simultaneously disengages from the second sector gear 268'. When the first pop-pin is disengaged from the first sector gear and the second pop-pin is disengaged from the second sector gear, the collar 164' and the cam housing 142' can pivot together about the drive shaft 130'. As discussed in more detail below, when the first pop-pin 284 is disengaged from the first sector gear 156', the collar bracket 306 engages the second pop-pin 308 to connect the cam housing 142' with the collar 164'. As such, when a user pivots the arms to the desired starting position, the cam housing 142' rotates with collar 164'.

As discussed above with reference to the first embodiment, the second transmission member 266' can be configured differently than as a sector gear. Further, it is to be appreciated that the second locking member 262' can be configured in different ways depending upon how the second transmission member is configured, as discussed above.

As shown in FIGS. 7B-8D, the second pop-pin assembly 308 is connected with the face plate 244' of the cam housing 142' adjacent the slot 318. The second pop-pin 308 includes a pin 322 extending radially inward from the face plate 244' to selectively engage teeth 270' on the second sector gear 268'. The second sector gear 268' is connected with the arm support member 122'. More particularly, the second sector gear 268' is formed in a side of a housing 124' for a pull-down exercise station 126'. The second pop-pin 308 also includes a spring 322 that forces a pin 324 into engagement with the second sector gear 268'. When the second pop-pin 308 is engaged with the second sector gear, the cam housing 142' is connected with the arm support member 122' and is prevented from rotating. Alternatively, when the second pop-pin 308 is disengaged from the second sector gear, the cam housing 142' can rotate about the drive shaft 130'.

As previously mentioned, the collar bracket 306 on the first pop-pin assembly 284 is configured such that when the user moves the pull handle 304 to disengage the first pop-pin 284 from the first sector gear 156' (direction arrow A in FIG. 8D), the second pop-pin 308 moves to simultaneously disengage from the second sector gear 268'. As shown in detail in FIGS. 8A-8D, the collar bracket 306 includes a generally rectangularly-shaped bracket base 326 with a hook slot 328 located in a first end portion 330 and a guide ledge 332 extending outwardly from a second end portion 334. The hook slot 328 is adapted to receive an actuator shaft 336 extending from the second pop-pin 308. A circular recess 338 is formed in the bracket base in an area surrounding the hook slot 328. The circular recess 338 is adapted to receive a disk member 340 connected with the actuator shaft 336 on the second pop-pin 308 when the first pop-pin 284 is moved to disengage from the first sector gear 156'. As such, engagement of the disk member 340 with the circular recess 338 acts to maintain a connection between the second pop-pin 308 and the collar bracket 306 when the first pop-pin 284 is disengaged from the first sector gear 156' and while the arms 118', 120' are being pivoted to a desired starting position.

As shown in FIGS. 8A-8D, the first pop-pin 284 is located adjacent to the second pop-pin 308 when the arm assembly 102' is in the "at rest" starting position ("at rest" being where the arms 118', 120' are located near the bottom edge 312 of the cam aperture 282). When the pull handle 304 on the first pop-pin 284 is moved to disengage the first pop-pin from the first sector gear 156' (direction A in FIG. 8D), the collar bracket 306 will also move to engage the second pop-pin 308. More particularly, the disk member 340 on the second pop-pin 308 is received within the circular recess 338 on the collar bracket 306. As the handle member 304 moves to disengage the first pop-pin 284 from the first sector gear 156', the collar bracket 306 will engage the disk member 340 on the second pop-pin 308 to move the second pop-pin from engagement with the second sector gear 268'.

As previously discussed, when the first pop-pin 284 is disengaged from the first sector gear 156', the collar 164' and the arms 118', 120' can pivot relative to the drive shaft 130'. In addition, the collar bracket 306 on the first pop-pin 284 is engaged with the disk member 340 on the second pop-pin 308, which couples the arms and the collar with the cam housing 142'. Further, collar bracket 306 engages the second pop-pin 308 to disengage the second pop-pin from the second sector gear 268', which decouples the cam housing 142' from the arm support member and allows the cam housing 142' to pivot relative to the drive shaft 130'. Therefore, the cam housing 142' can pivot along with the arms 118', 120' and collar 164' relative to the drive shaft 130'. A user can then pivot the arms 118', 120' relative to the drive shaft 130' in order to place the arms and associated gripping portions 134' into a desired starting position.

Once in the desired starting position, the handle member 304 on the first pop-pin 284 can be released, which allows the springs 298, 322 associated with the first and second pop-pins 284, 308 to force the first pop-pin into engagement with the first sector gear 156' (direction arrow B shown in FIG. 8C) and to force the second pop-pin into engagement with the second sector gear 268'. When exercising, the user applies forces to the arms 118', 120', causing the arms to pivot the drive shaft 130'. As the arms pivot upward from the bottom edge 312 of the cam aperture 282, the interface members 256 engage the arcuate side edges 314, 316 of the cam aperture 282 causing the arms to converge. The first pop-pin 284 also moves upward along the slot 318 in the face plate 244' of the cam housing 142'. The collar bracket 306 also moves with the first pop-pin. Further, the guide ledge 332 of the collar bracket 306 moves along the guide plate 320 on the cam housing. As such, the guide plate 320 maintains the orientation of the collar bracket relative to the cam housing so as maintain the hook slot 328 in the collar bracket 306 in alignment with the second pop-pin 308. Therefore, when the arms return to the starting position, the second pop-pin is received within the hook slot on the bracket collar.

FIGS. 9A-10B show a second alternative arm assembly 102" conforming to aspects of the present invention. The arm assembly 102" of FIGS. 9A-10B is similar to the arm assembly 102' of FIGS. 7A-8D. For example, the second alternative arm assembly includes a releasable locking mechanism 146" used to simultaneously connect and disconnect two arms 118", 120" and a collar 164" with a drive shaft 130" as well as a cam housing 142" with an arm support member 122". The releasable locking mechanism 146" also includes first and second locking members 226", 262" shown as first and second pop-pins 284", 308". The locking mechanism 146" also includes a handle member 304" and a collar bracket 306" connected with the first pop-pin 284" and adapted to connect the first pop-pin with the second pop-pin 308", as discussed above with reference to the first alternative arm assembly 102'. However, there are structural differences between the first alternative arm assembly 102' and the second alternative arm assembly 102" of FIGS. 9A-10B. For example, the cam housing 142" and locking mechanism 146" of the second alternative arm assembly 102" allow the arm assembly to be configured to perform exercises having a diverging arm motion and a converging arm motion. For example, the second alternative arm assembly can be configured for a press exercise and a reverse row exercise.

Figure 9A:
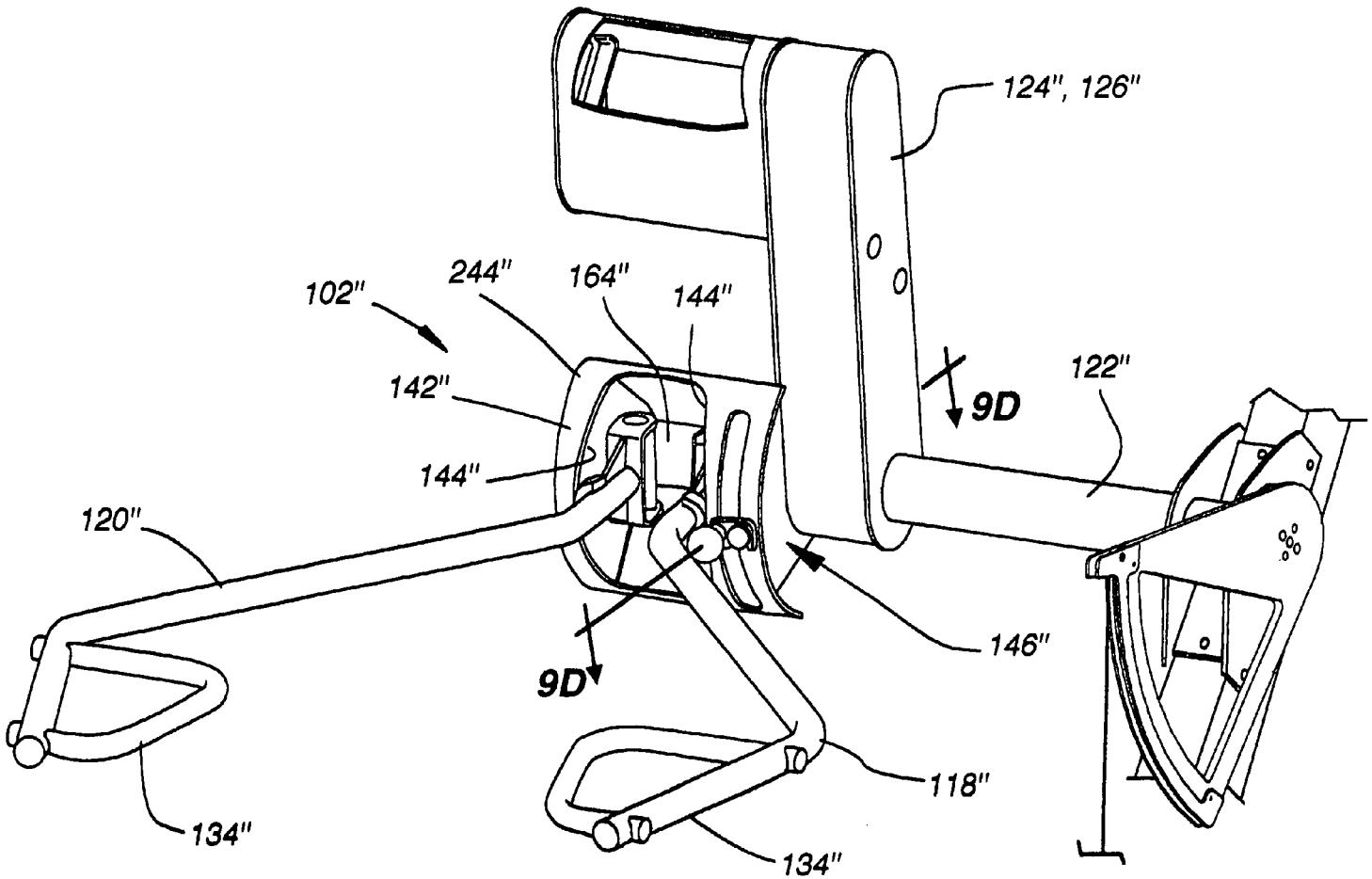
FIG. 9A is an isometric view of a second alternative embodiment of an arm assembly.
Figure 9B:
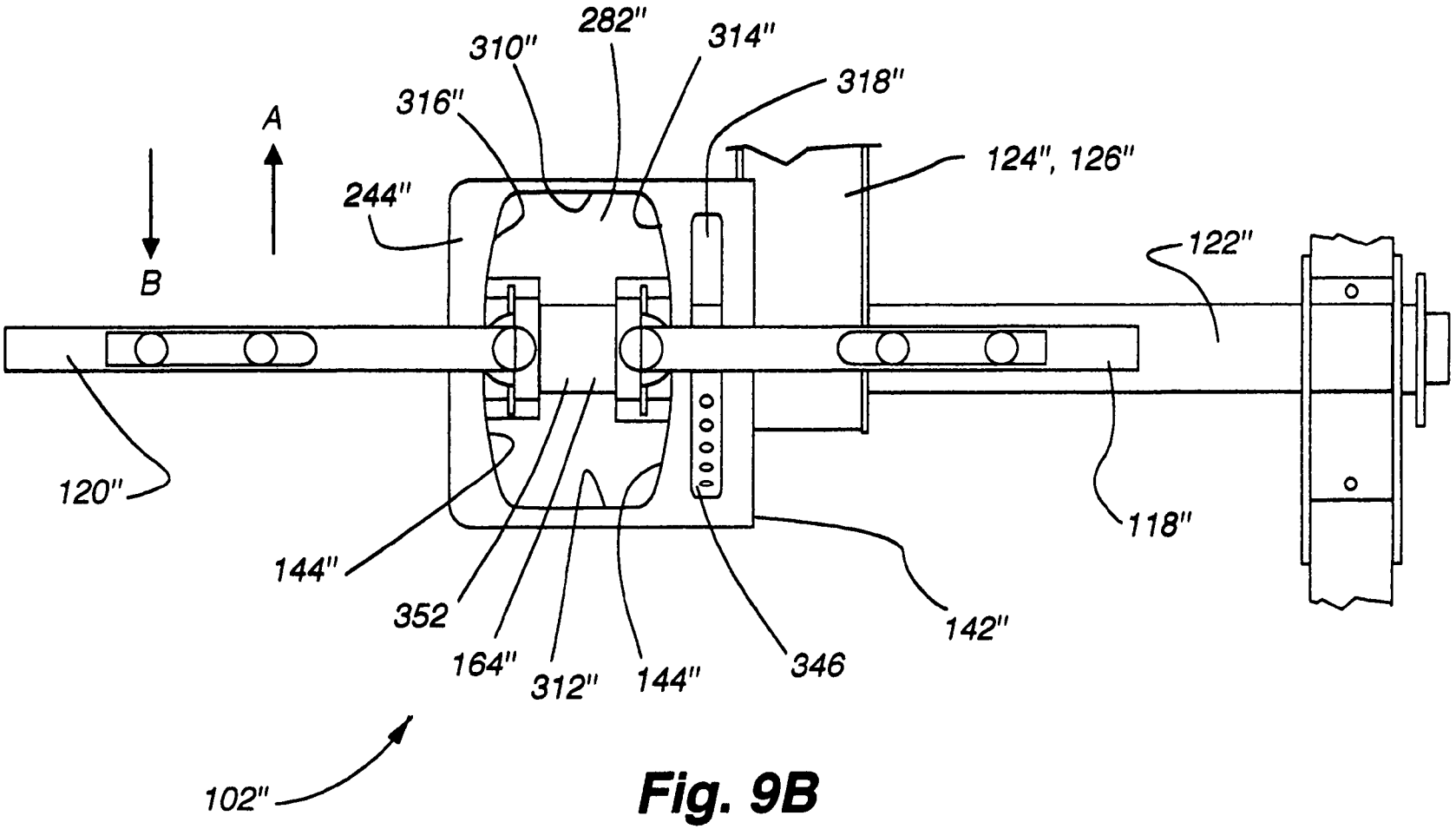
FIG. 9B is a detailed view of the arm assembly shown in FIG. 9A.
Figure 9C:
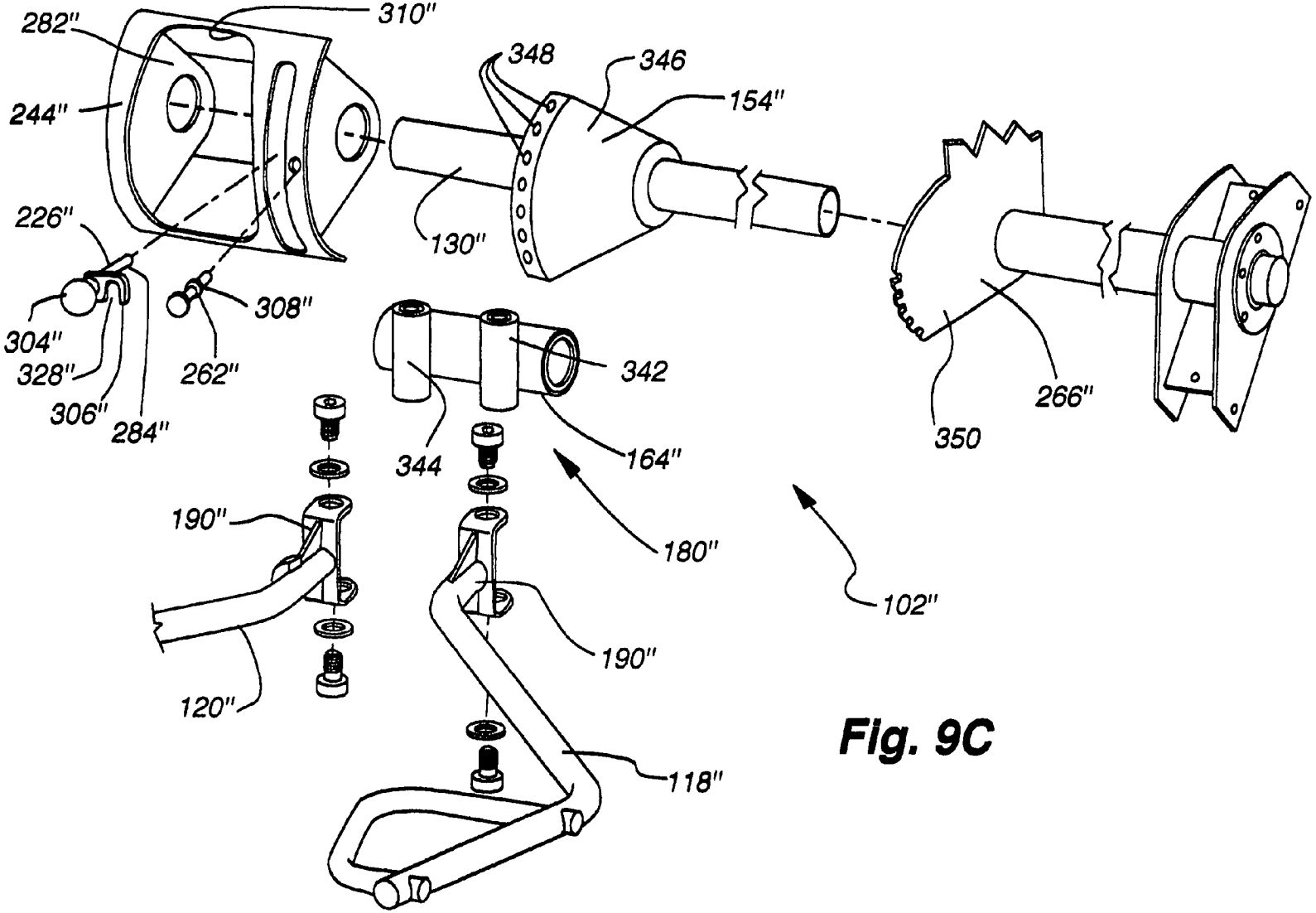
FIG. 9C is an exploded view of the arm assembly of FIG. 9A.
Figure 9D:
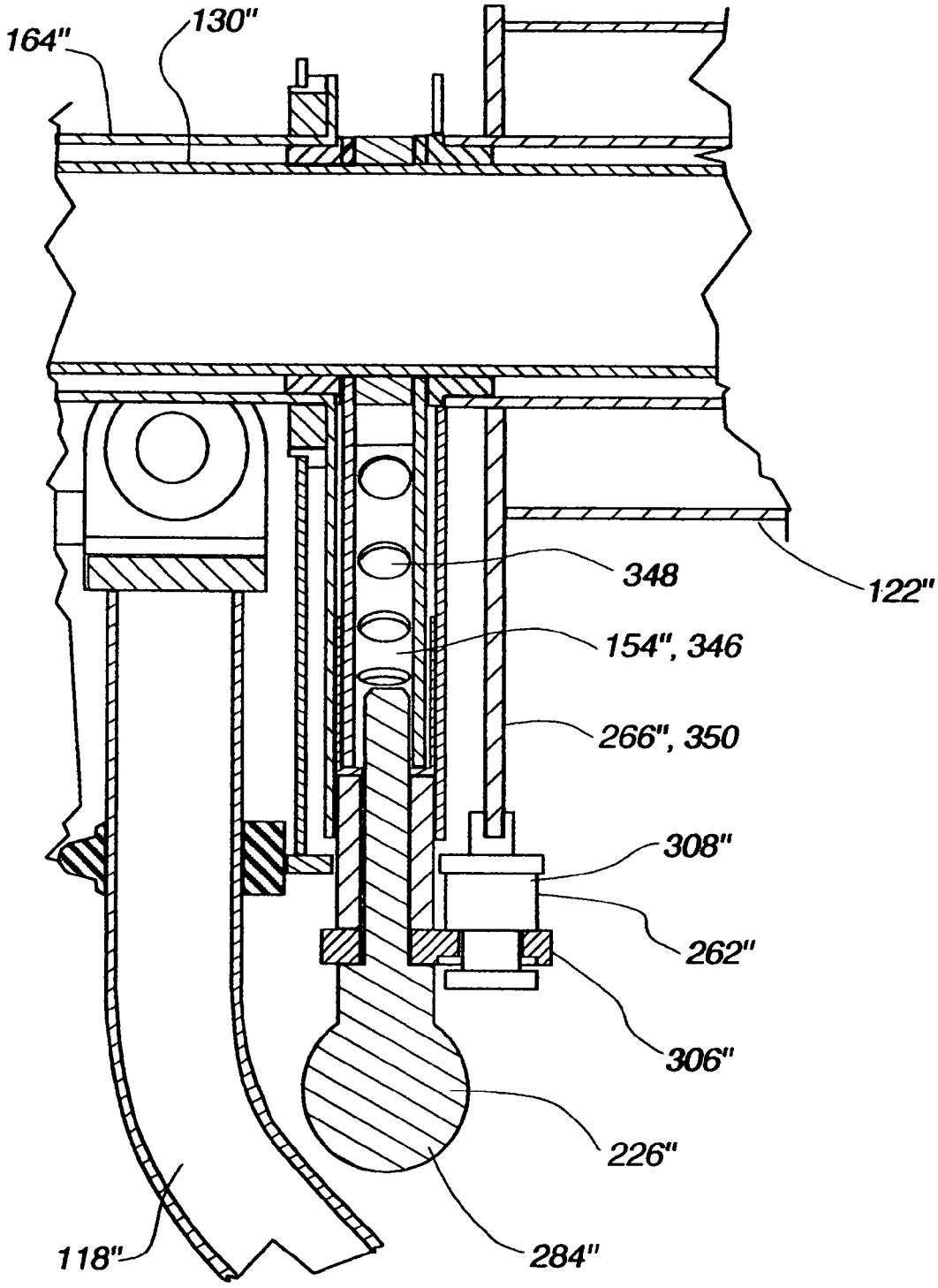
FIG. 9D is a cross-sectional view of the arm assembly shown in FIG. 9A, taken along line 9D-9D.

As shown in FIGS. 9A-9C, similar to the above described embodiments, the first and second arms 118", 120" are pivotally connected with the collar 164" through a pivot assembly 180". However, the pivot assembly 180" utilizes a different connection between the collar 164" and the first and second arms 118", 120" than previously described. More particularly, instead of having pivot axles supported on diametrically opposed pivot mounts extending from the outer surface of the collar, first and second axles 342, 344 are connected with the outside surface of the collar 164". C-shaped pivot brackets 190" connected with arms are, in turn, pivotally supported on respective axles.

As shown in FIG. 9C, the pivot brackets 190" are pivotally connected with opposing ends of the first and second axles 342, 344. The arm assembly 102" can also include a first coil spring (not shown) connected with the pivot bracket 190" of the first arm 118" and the first axle 342, and a second coil spring (not shown) connected with the second pivot bracket 190" of the second arm 120" and the second axle 344. The first and second coil springs function similarly to the first and second springs 200, 204 described above with reference to previous embodiments and act to pivotally force gripping portions 134" of the first and second arms 118", 120" away from each other. In addition, the forces exerted on the arms by the first and second coil springs act to hold the arms in contact with cam surfaces 144" on a cam aperture 282" in a face plate 244" of the cam housing 142".

The first and second pop-pins 284", 308" shown in FIGS. 9A-9D function in substantially the same manner as described above with reference to the first alternative arm assembly 102'. As such, the first and second pop-pins are adapted to selectively engage first and second transmission members 154", 266". However, the second transmission member 266" of the second alternative embodiment 102" is in the form of a sector disk 346 with circumferentially-spaced apertures 348 as opposed to the first sector gear 156' described above. The sector disk 346 functionally replaces the first sector gear 156' described above with reference to other embodiments. As such, the first pop-pin 284" is adapted to engage the apertures 348 in the sector disk 346 as opposed to teeth on the first sector gear. During exercise, the cam housing 142" is held in a fixed position relative to the frame of the exercise device through an arm support member 122". As with the previously described embodiments, the cam housing 142" can also be disconnected from the frame to rotate relative to the drive shaft 130", allowing a user to change the desired starting position of the arms 118", 120". The cam housing 142" is selectively coupled with the frame 122" through the second pop-pin assembly 308", which is adapted to engage the second transmission member 266", shown as a sector gear 350 fixedly connected with the arm support member 122". The collar bracket 306" on the first pop-pin assembly 284" is configured such that when the user moves the handle member 304" to disengage the first pop-pin 284" from the sector disk 346, the second pop-pin 308" simultaneously disengages from the sector gear 350. When the first pop-pin is disengaged from the first sector disk and when the second pop-pin is disengaged from the sector gear, the collar 164" and the cam housing 142" can pivot about the drive shaft 130". In addition, when the first pop-pin 284" is disengaged from the sector disk 346, the collar bracket 306" engages the second pop-pin 308" to couple the cam housing 142" with the collar 164". As such, when a user pivots the arms to the desired starting position, the cam housing rotates with collar.

As previously discussed with reference to earlier embodiments of the arm assembly, it is to be appreciated that the first and second transmission members 154", 266" can be configured in different ways. Further, it is to be appreciated that the first locking member 226" and the second locking member 262" can also be configured in differently depending upon how the first and second transmission members are configured.

With the exception of the face plate 244", the cam housing 142" shown in FIGS. 9A-9C is substantially similar to the cam housing 142' described above with reference to FIGS. 7A and 7B. As shown in FIGS. 9A-9C, the first and second arms 118", 120" extend from the collar 164" through the cam aperture 282" in the face plate 244" of the cam housing 142". As shown in FIG. 9B and 9C, the cam aperture is defined by a top edge 310" and a bottom edge 312" separated by two arcuate side edges 314", 316". The two arcuate side edges 314", 316" define cam surfaces 144", which guide the converging and diverging motions of the first and second arms 118", 120" as the arms move relative to the cam housing 142". From the bottom edge 312" of the cam aperture 282", the arcuate side edges 314", 316" curve outwardly away from each other as side edges extend upwardly, defining a relatively wide mid portion 352 of the cam aperture. From the relatively wide mid portion 352 of the cam aperture, the arcuate side edges 314", 316" curve inwardly toward each other while extending upward to the top edge 310" of the cam aperture.

Figure 10A:
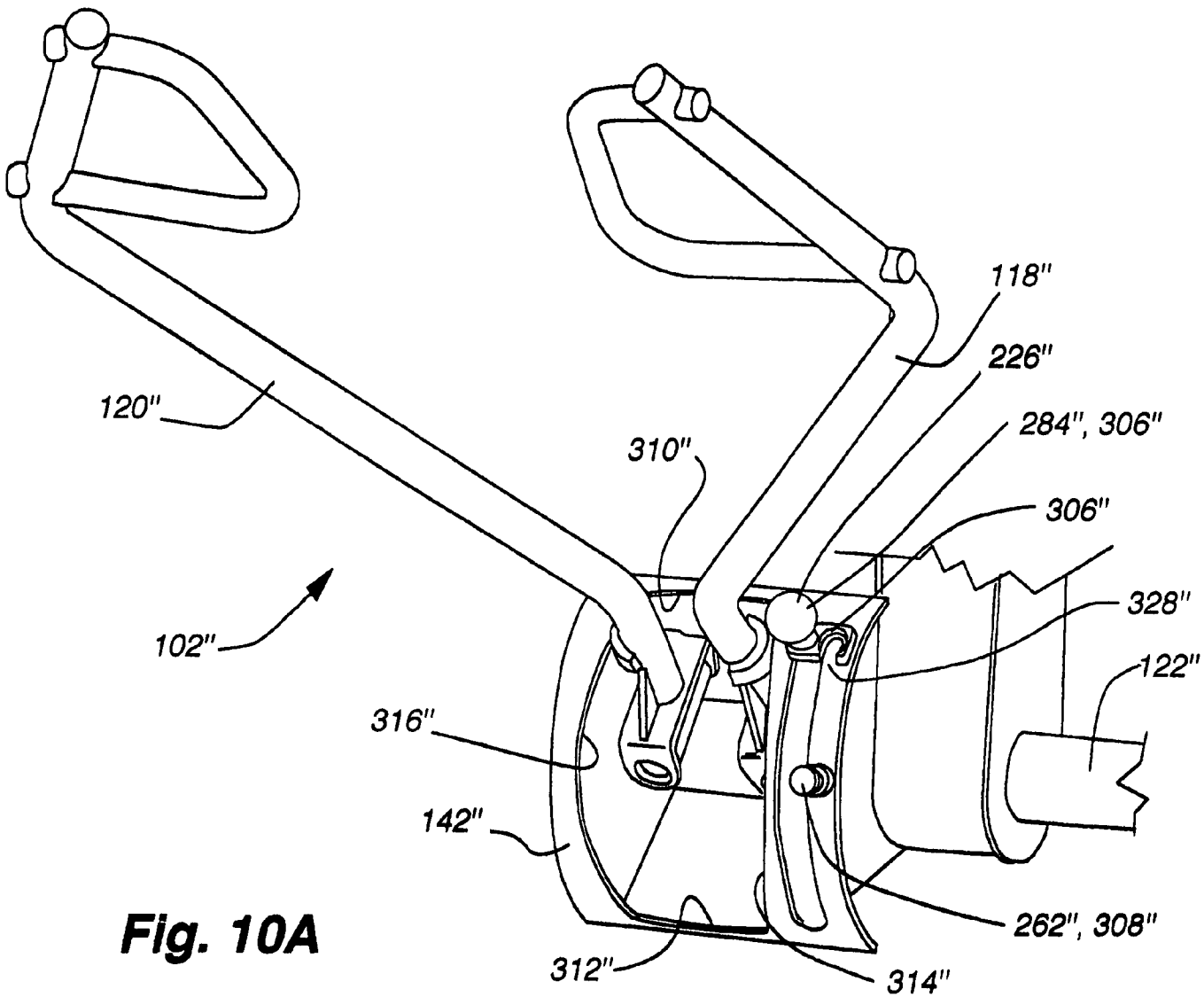
FIG. 10A is an isometric view of the arm assembly shown in FIG. 9A with the arms in an upward position.

As previously mentioned, the second alternative arm assembly 102" can be configured for a press exercise wherein as the user pushes the arms 118", 120" away from his body, the gripping portions 134" of the arms move in a converging motion toward each other. For example, the arms shown in FIG. 9B are illustrated in an "at rest" starting position for a press exercise. Moving the arms upward (direction A in FIG. 9B) toward the top edge 310 of the cam aperture 282" will cause the arms 118", 120" to converge, as shown in FIG. 10A. A press exercise could also be performed by moving the arms downward (direction B in FIG. 9B) toward the bottom edge 312" of the cam aperture 282", which would also cause the arms to converge. However, the collar bracket 306" on the first pop-pin 284" would have to be rotated relative to the first pop-pin in order to disengage the hook slot 328" on the collar bracket from the second pop-pin 308" before moving the arms in direction B.

Figure 10B:
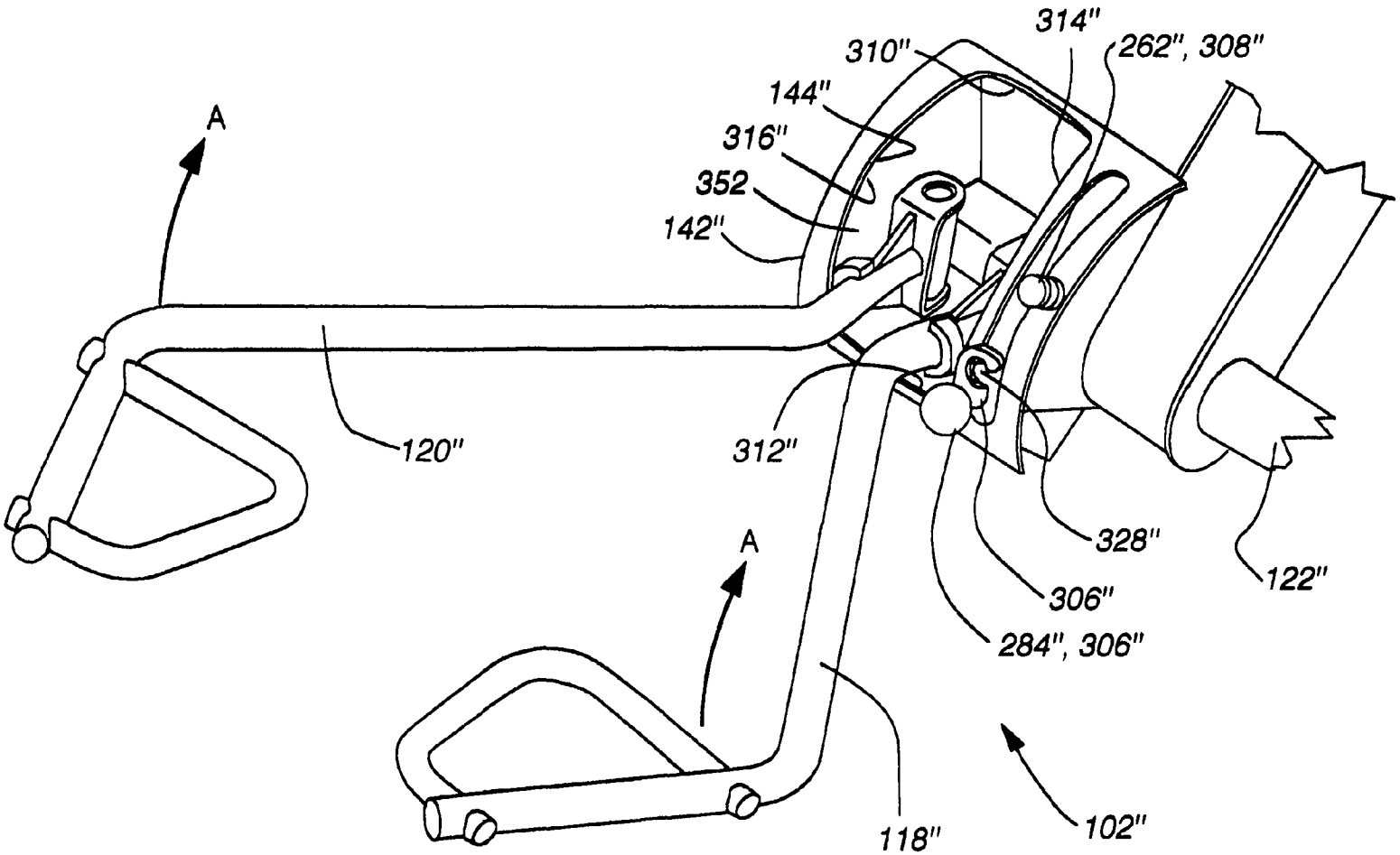
FIG. 10B is an isometric view of the arm assembly shown in FIG. 9A with the arms in a downward position.

The second alternative arm assembly 102" can also be configured for a reverse row exercise wherein the user pulls the arms 118", 120" toward his body and the arms move in a diverging motion away from each other. From the "at rest"

position shown in FIG. 9B, the arm assembly 102" can be configured to perform a reverse row exercise as shown in FIG. 10B by first rotating the collar bracket 306" relative to the first pop-pin 284" to disengage the hook slot 328" on the collar bracket from the second pop-pin 308". Next, the handle member on the first pop-pin 304" is pulled to disengage the first pop-pin from the sector disk 346, which decouples the collar 164" and arms 118", 120" from the drive shaft 130". Because the collar bracket has been rotated to disengage the hook slot from the second pop-pin 308", the second pop-pin does not disengage from the sector gear 350 when handle member 304" on the first pop-pin is pulled. Therefore, the cam housing 142" remains coupled with the arm support member 122" through the engagement of the second pop-pin with the sector gear. With the first pop-pin 284" disengaged from the sector disk 346, the arms and collar can be pivoted relative to the drive shaft and cam housing. As shown in FIG. 10B, the arms have been placed in a starting position near the bottom edge of the cam aperture. Once the arms are placed in the desired starting position, the first pop-pin 284" can be released to reengage the sector disk 346. From the starting position shown in FIG. 10B, a user can perform a reverse row exercise by pivoting the arms upward (direction A in FIG. 10B). The gripping portions 134" of the arms 118", 120" diverge as the arms pivot upward from the bottom edge 312" of the cam aperture 282" toward the relative wide mid portion 352 of the cam aperture 282". It is to be appreciated that the arm assembly could also be configured for a reverse row exercise by placing the arms in a starting position adjacent to the top edge 310" of the cam aperture 282".

FIGS. 11A-15C show a third alternative arm assembly 102'" conforming to aspects of the present invention. The arm assembly 102'" of FIGS. 11A-15C is similar to previously described the arm assemblies. For example, the third alternative arm assembly 102'" includes a releasable locking mechanism 146" used to allow first and second arms 118'", 120'" and a cam housing 142'" to simultaneously pivot when selecting a desired starting position of the arms. As described in more detail below, the releasable locking mechanism 146'" also includes first and second locking members 226'", 262'", in the form of first and second pop-pins 284'", 308'", to selectively engage first and second transmission members 154'", 266'". However, there are some structural differences between the third alternative arm assembly 102'" and the previously described arm assemblies. For example, the first and second pop-pin assemblies are simultaneously actuated through cables connected with a trigger assembly 354 located on a gripping portion 134'" of one of the arms. In addition, the arms are pivotally connected directly with a drive shaft 130'", as opposed to being pivotally connected with a collar that is rotatably mounted on the drive shaft. As described below, the first pop-pin 284'" is adapted to engage the first transmission member 154'", shown as a sector gear 356 formed in a sector member 128'" to selectively couple the drive shaft 130'" with the sector member, as opposed to selectively coupling the collar with the drive shaft. Further, the second pop-pin 308'" is configured to selectively couple the cam housing 142'" with either an arm support member 122'" or the drive shaft 130'".

The components of the third alternative arm assembly 120'" also interact differently with each other as compared to the previously described arm assemblies. For example, when pivoting the arms 118'", 120'" to a desired starting position, a user first actuates the trigger assembly 354 to activate the first pop-pin 284'" to decouple the drive shaft 130'" from the sector member 128'". Simultaneously, the trigger assembly 354 activates the second pop-pin 308'" to decouple the cam housing 142'" from the arm support member 122'" and couple the cam housing with the drive shaft 130'". As such, the drive shaft 130'" can pivot along with the arms 118'", 120'" while the sector member 128'" remains in a fixed position. At the same time, the cam housing 142'" pivots along with the drive shaft 130'". Once the arms are pivoted to a desired starting position, the trigger 354 can be released, which allows springs associated with the first and second pop-pins 284'", 308'" to reengage the first and second transmission members 154'", 266'" to recouple drive shaft 130'" with the sector member 128'" and recouple the cam housing 142'" with the arm support member 122'".

Figure 11A:
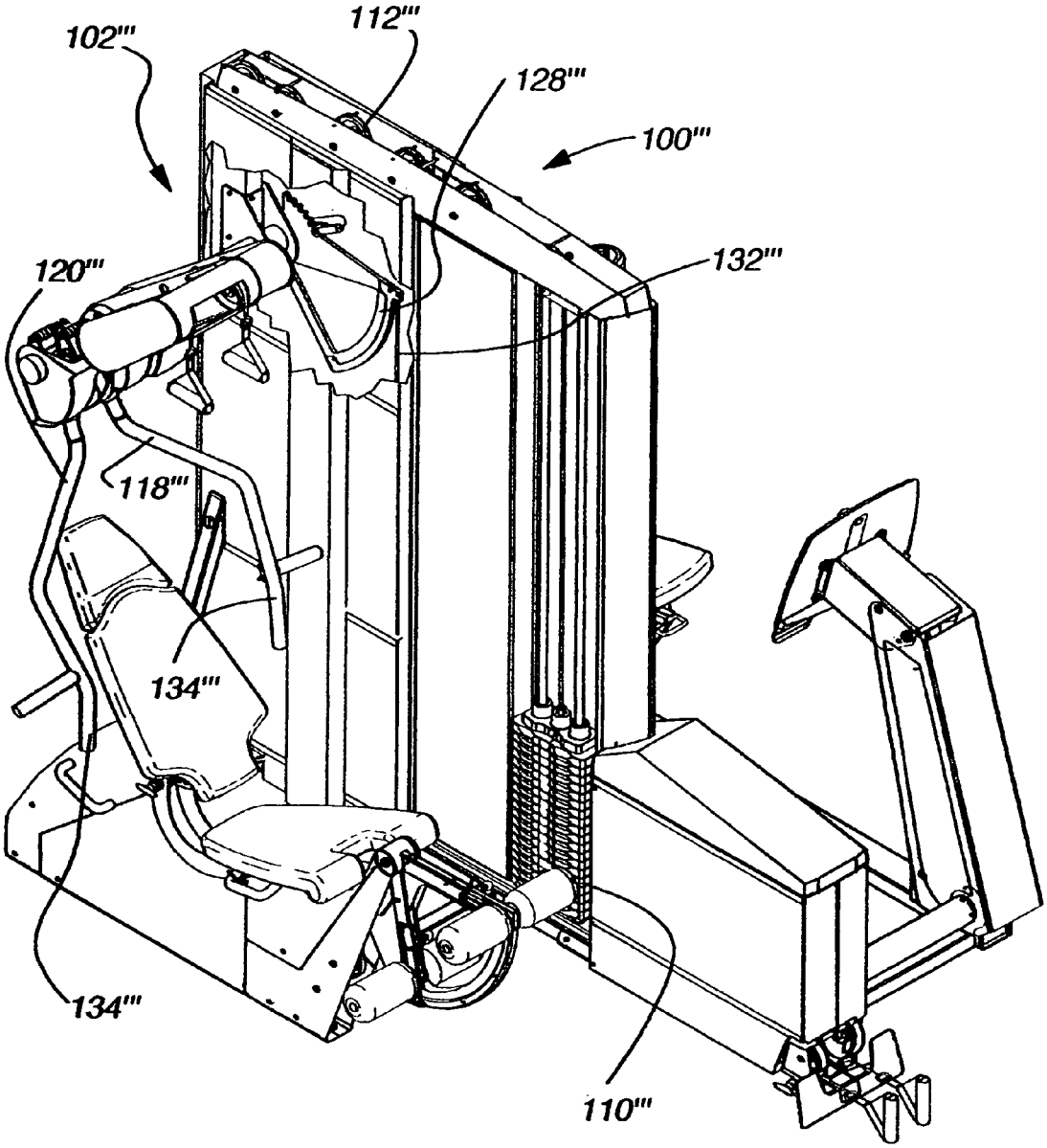
FIG. 11A is a front left isometric view of a third alternative embodiment of the arm assembly connected with an exercise device.

FIG. 11A shows the third alternative embodiment 102'" of the arm assembly connected with an exercise device 100'", which is similar to the exercise device 100 described above with respect to FIGS. 1A-1B. The arm assembly 102'" shown in FIG. 11A is operably coupled with a cable-pulley assembly 112'", and in turn, a resistance system 110'" through the sector member 128'" connected with the drive shaft 130'". During exercise, a user exerts force on gripping portions 134'" of the first and second arms 118'", 120'" connected with the drive shaft 130'", which causes the drive shaft and the sector member to pivot relative to the arm support member 122'". As the sector member pivots, a portion of a resistance cable 132'" wraps onto an arced portion 136'" of the sector member 128'", which in turn, pulls against the resistance system, providing resistance to the user.

Figure 11B:
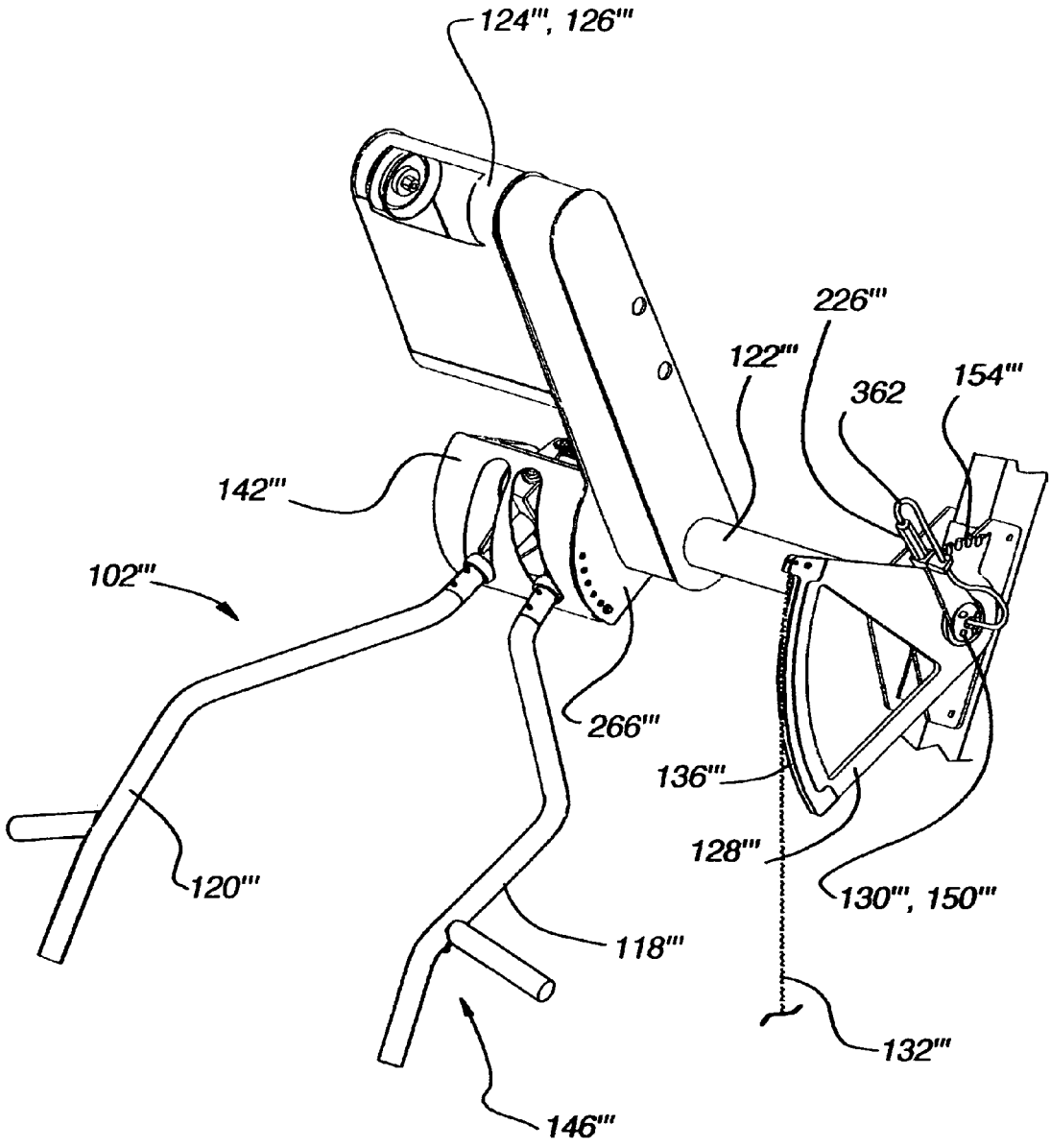
FIG. 11B is a detailed isometric view of the arm assembly shown in FIG. 11A.
Figure 11C:
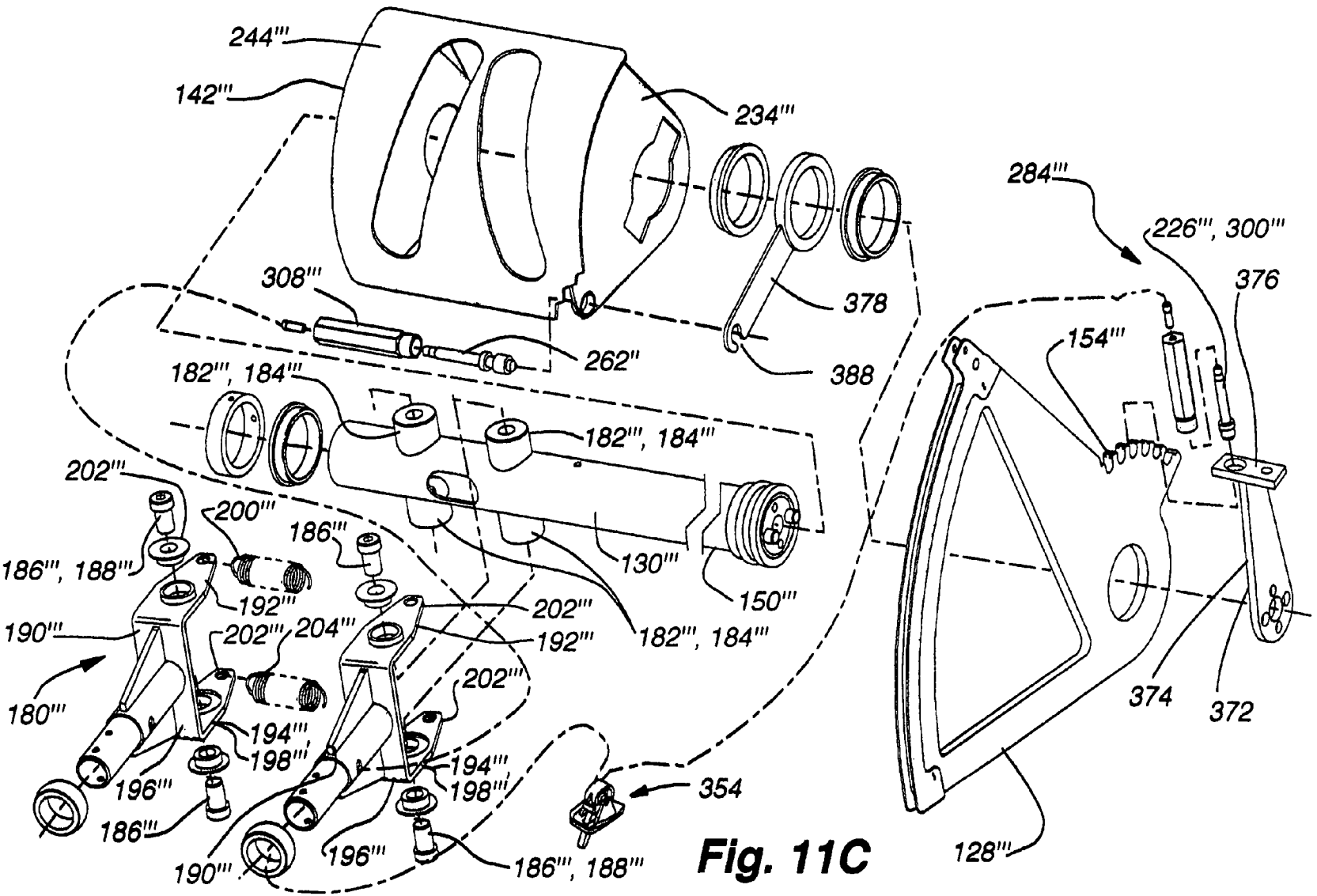
FIG. 11C is an exploded view of the arm assembly shown in FIG. 11B.

As mentioned above, the first and second arms 118'", 120'" are pivotally connected directly with the drive shaft 130'" as opposed to be being pivotally connected with a collar supported on the drive shaft, as described above with reference to previous embodiments. The arms are connected with the drive shaft through a pivot assembly 180'" that is similar the pivot assembly 180 described above. As shown in FIGS. 11B and 11C, the first arm 118'" and the second arm 120'" are pivotally connected with the drive shaft 130'" through the pivot assembly 180'" utilizing diametrically opposed pivot mounts 182'" on the drive shaft. The pivot mounts 182'" are cylindrically-shaped and extend radially outward from the outer surface of the drive shaft 130'" to define substantially flat circular bearing surfaces 184'". The pivot assembly also includes axle bolts 186'" defining pivot axles 188'" to pivotally connect C-shaped pivot brackets 190'" with the drive shaft 130'".

As shown in FIG. 11C, the C-shaped pivot brackets 190'" each include first and second pivot plates 192'", 194'" extending from opposing ends of a base portion 196'". Substantially flat mid portions 198'" of the pivot plates are adapted to engage the circular bearing surfaces 184'" on the pivot mounts 182'". As shown in FIG. 11C, the axle bolts 186'" extend through the pivot plates 192'", 194'" and threadedly engage the pivot mounts 182'" acting to pivotally connect the pivot plates with the pivot mounts. The pivotal connections between C-shaped brackets 190'" and the drive shaft 130'" allow the arms 118'", 120'" to pivot relative to the drive shaft during use as the hand grip portions 134'" move in a converging and/or diverging relationship to each other. A first spring 200'" is connected with end portions 202'" of the first pivot plates 192'", and a second spring 204'" is connected with end portions 202'" of the second pivot plates 194'". As discussed above with reference to either embodiments, the first and second springs 200'", 204'" are tension springs that pull the end portions 202'" of the pivot plates 192'", 194'" toward each other. As such, the first and second springs are biased to force the arms to pivot about the axle bolts in a direction that forces the gripping portions 134'" of the first and second arms 118'", 120''' away from each other. It is to be appreciated that other embodiments of the arm assembly do not include first and second springs.

Figure 13A:
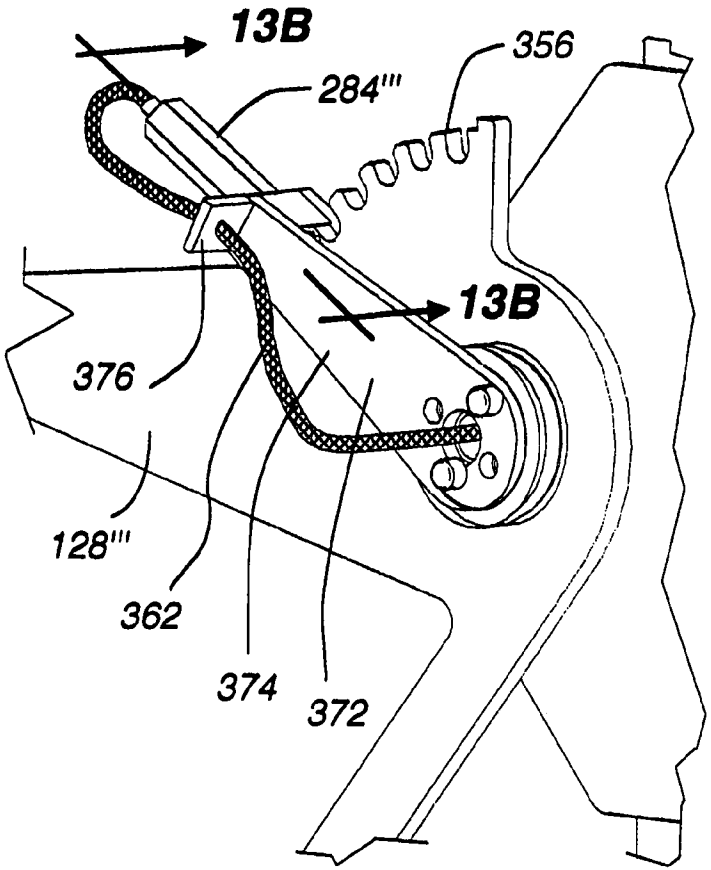
FIG. 13A is a detailed view of the first pop-pin and sector member.
Figure 14A:
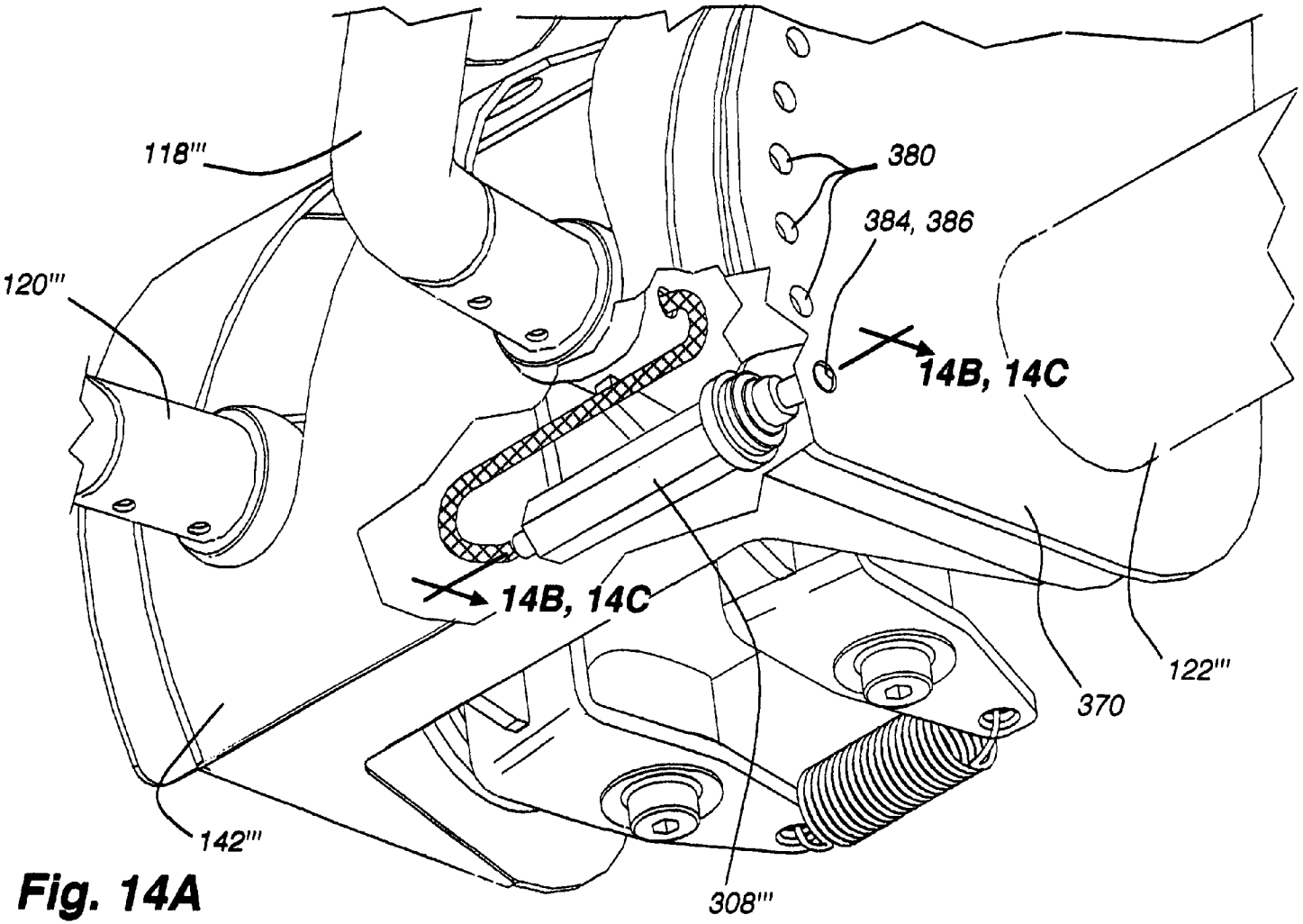
FIG. 14A is a detailed view of the arm assembly of FIG. 11B with the cam housing partially cut away to show a second pop-pin.

As shown in FIGS. 11C-12C, the trigger assembly 354 used to actuate the first and second pop-pins 284''', 308''' is mounted near the gripping portion 134''' of the first arm 118'''. As discussed in more detail below, first and second cables 358, 360 operably connect the trigger assembly 354 with the first and second pop-pins, respectively. As shown in FIGS. 12A and 13A, the first cable 358 extends from the trigger assembly 354 through the inside of the first arm 118''' and into the drive shaft 130'''. The first cable 358 extends through the drive shaft 130''' and exits into a cable conduit 362 adjacent the sector member 128'''. As shown in FIGS. 12A-12C and 14A, the second cable 360 extends from the trigger assembly 354 through the inside of the first arm 118'''. The second cable 360 exits the first arm 118''' and connects with the second pop-pin 308''' inside the cam housing 142''', as shown in FIG. 14A. FIG. 12B shows a detailed view of the trigger assembly, which includes a switch member 364 connected with a reel 366. The first and second cables 358, 360 are connected with the reel 366, and the reel is rotatably connected with a trigger base 368. Movement of the switch member 364 in direction A, causes the reel 366 to rotate in direction A', which in turn, causes the first and second cables to simultaneously be pulled in direction A".

As explained in more detail below with reference to FIGS. 12A-15C, pulling the first cable 358 in direction A" disengages the first pop-pin 284''' from the sector gear 356, which decouples the drive shaft 130''' from the sector member 128'''. Pulling the second cable 360 in direction A" disengages the second pop-pin 308''' from the second transmission member 266''', shown in the form of a sector plate 370, which decouples the cam housing 142''' from the arm support member 122''' and couples the cam housing with the drive shaft 130'''. As discussed in more detail below, when the switch member 364 of the trigger assembly 354 is released, springs associated with the pop-pins cause the first pop-pin 284''' to reengage the sector gear 356 and the second pop-pin 308''' to reengage the sector plate 370. Reengagement of the first pop-pin with the sector gear connects the drive shaft 130''' with the sector member 128''', and reengagement of the second pop-pin with the sector plate disconnects the cam housing 142''' from the drive shaft 130''' and reconnects the cam housing with the arm support member 122'''. Movement of the pop-pins caused by the springs acts to pull the first and second cables 358, 360 in direction B", which in turn, rotates the reel 366 in direction B'. Rotation of the reel 366 in direction B' causes the switch member 364 to move in direction B.

As previously discussed with reference to earlier embodiments of the arm assembly, it is to be appreciated that the first and second transmission members 154''', 266''' can be configured in different ways. Further, it is to be appreciated that the first locking member 226''' and the second locking member 262''' can also be configured in differently depending upon how the first and second transmission members are configured.

As previously mentioned, the first pop-pin 284''' selectively couples the drive shaft 130''' with the sector member 128''' through the sector gear 356 formed in the sector member. As shown in FIGS. 11B-12A and 13A, a first pop-pin support assembly 372 connected with the drive shaft 130''' supports the first pop-pin. The first pop-pin support assembly includes a radially extending support plate 374 connected with a first end portion 150''' of the drive shaft adjacent to the sector member 128'''. The first pop-pin 284''' is connected with a support base 376 connected with the support plate 374. As shown in FIG. 13B, the first pop-pin 284''' includes a spring 298''' that forces a pin 300''' through the support base and into engagement with the sector gear 356. When the first pop-pin 284''' is engaged with the sector gear 356, the drive shaft 130''' is connected with the sector member 128'' such that the drive shaft and the sector member pivot together. As previously mentioned, the first pop-pin 284''' can be disengaged from the sector gear 356 by moving the switch member 364 on the trigger assembly 354 (direction A in FIG. 12B). As such, when the first pop-pin is disengaged from the sector gear, the drive shaft 130''' can rotate relative to the sector member 128'''. FIG. 13A also shows the first cable 358 exiting the drive shaft 130''' and extending upward into the cable conduit 362 to connect with the first pop-pin 284'''.

The cam housing 142''' shown in FIGS. 11B and 11C is similar to the cam housing 142 described above. However, the cam housing includes a different face plate 244''' and first sector-shaped side 234''' than described above with reference to other embodiments. As shown in FIGS. 11A-11C, the first and second arms 118''', 120''' extend from the drive shaft 130''' through first and second cam slots 140''', 141''' in the face plate 244''' of the cam housing 142'''. Forces exerted by the first and second tension springs 200''', 204''' on the arms act to hold the arms in contact with arcuate cam surfaces 144''' on the cam slots 140''', 141'''. As shown in FIGS. 11C, 12C, and 14A-14C, the second pop-pin 308''' is connected with the first side 234''' of the cam housing 142'''. As discussed in more detail below, the second pop-pin 308''' extends through the first side of the cam housing to selectively engage a hook plate 378 connected with the drive shaft 130''' or the sector plate 370 connected with the arm support member 122'''.

When the trigger assembly 354 discussed above with reference to FIG. 12B is released such that the switch member 364 is in position B, the second pop-pin 308''' is engaged with the sector plate 370. As shown in FIGS. 14A-15C, the sector plate includes a plurality of apertures 380 extending circumferentially adjacent an arced edge 382 thereof. A pin 324''' extending from the second pop-pin 308''' includes a head portion 384 connected with an extended end portion 386. The apertures 380 in the sector plate 370 are adapted to receive the extended end portion 386 of the pin 324'''. As such, because the second pop-pin 308''' is connected with the cam housing 142''' and the sector plate 370 is connected with the arm support member 122''', when the extended end portion 386 of the second pop-pin is received within one of the apertures 380 in the sector plate 370, the cam housing 142''' is connected with the arm support member 122''' and cannot rotate.

Figure 12A:
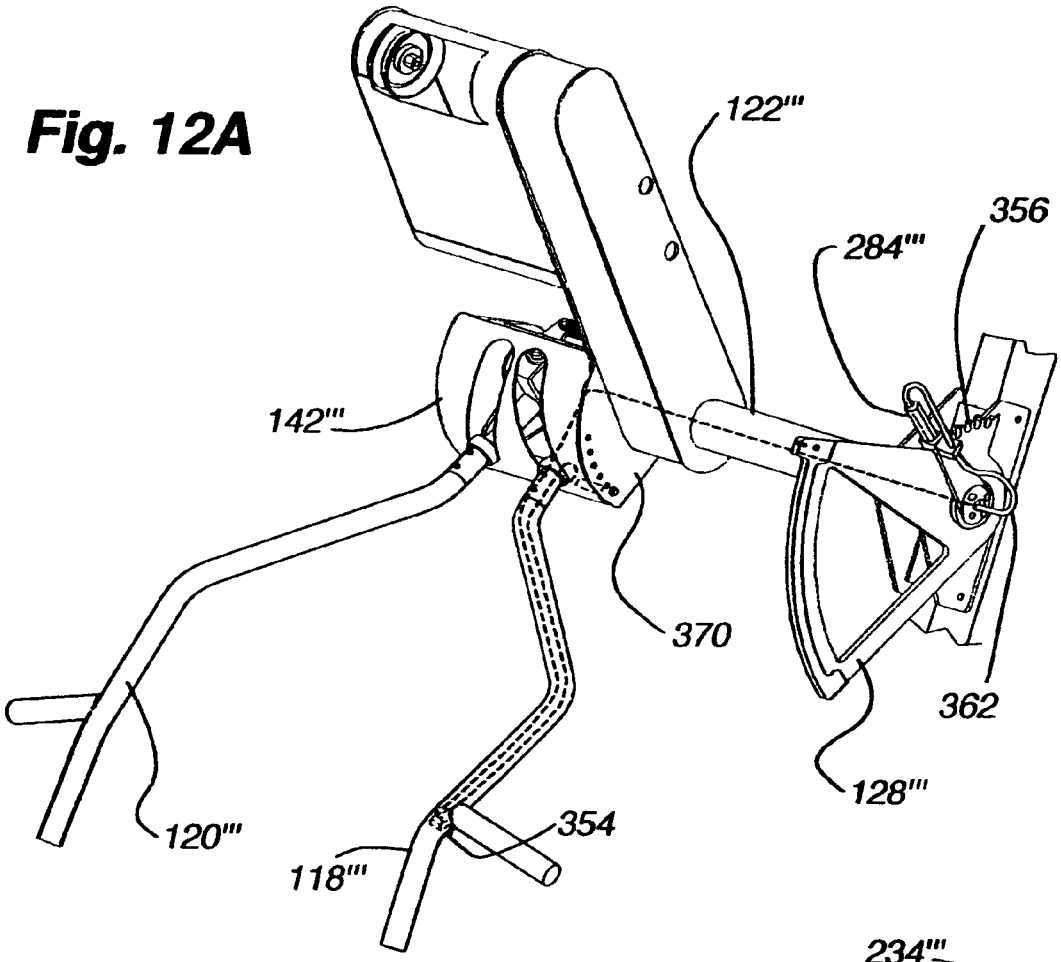
FIG. 12A is an isometric view of the arm assembly shown in FIG. 11B showing a cable routing from a trigger assembly to a first pop-pin and a second pop-pin.
Figure 12B:
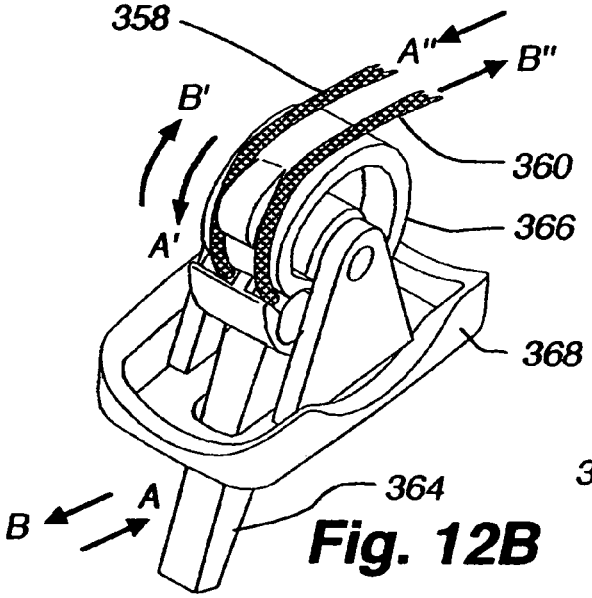
FIG. 12B is a detailed view of the trigger assembly shown in FIG. 12A.
Figure 12C:
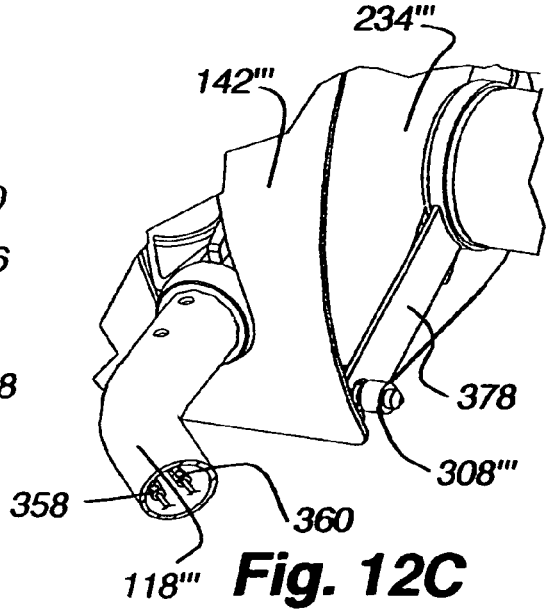
FIG. 12C is a break-away view showing the cable routing through a first arm.
Figure 13B:
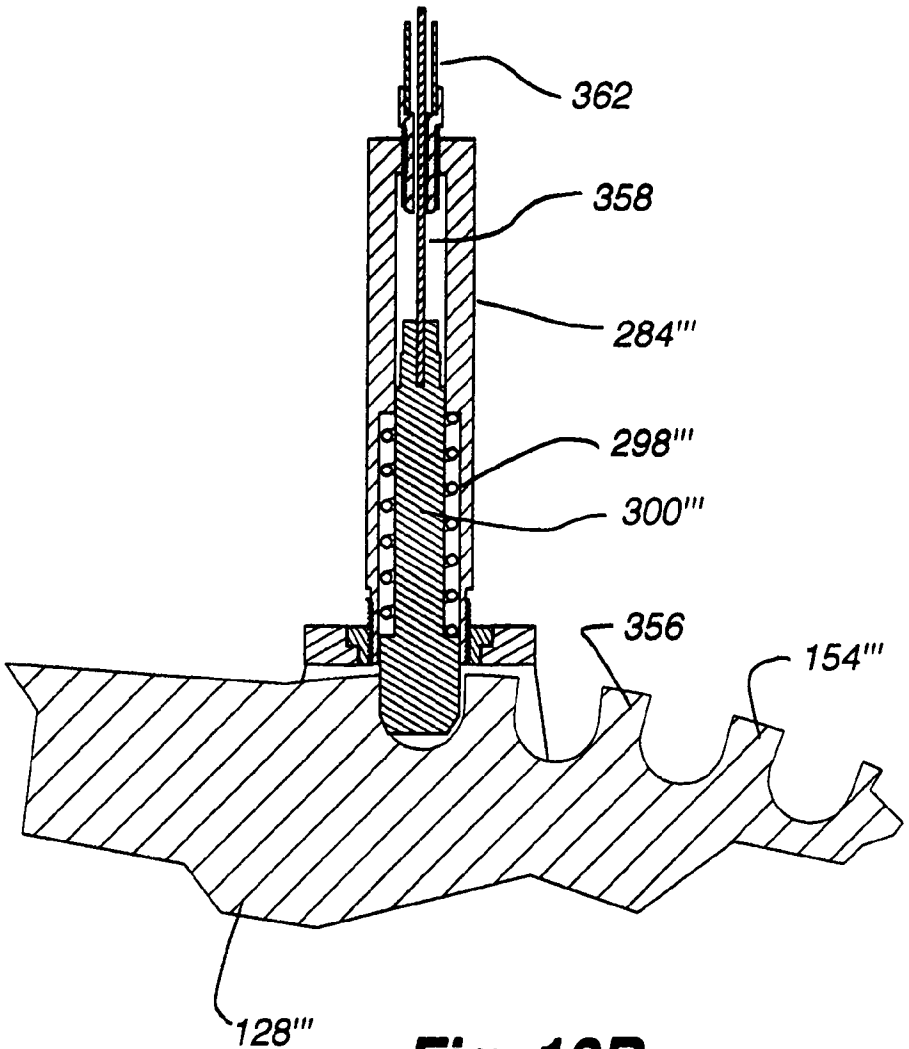
FIG. 13B is a cross-sectional view of the first pop-pin and sector member shown in FIG. 13A, taken along line 13B-13B showing the first pop-pin engaged with the first sector gear.
Figure 14B:
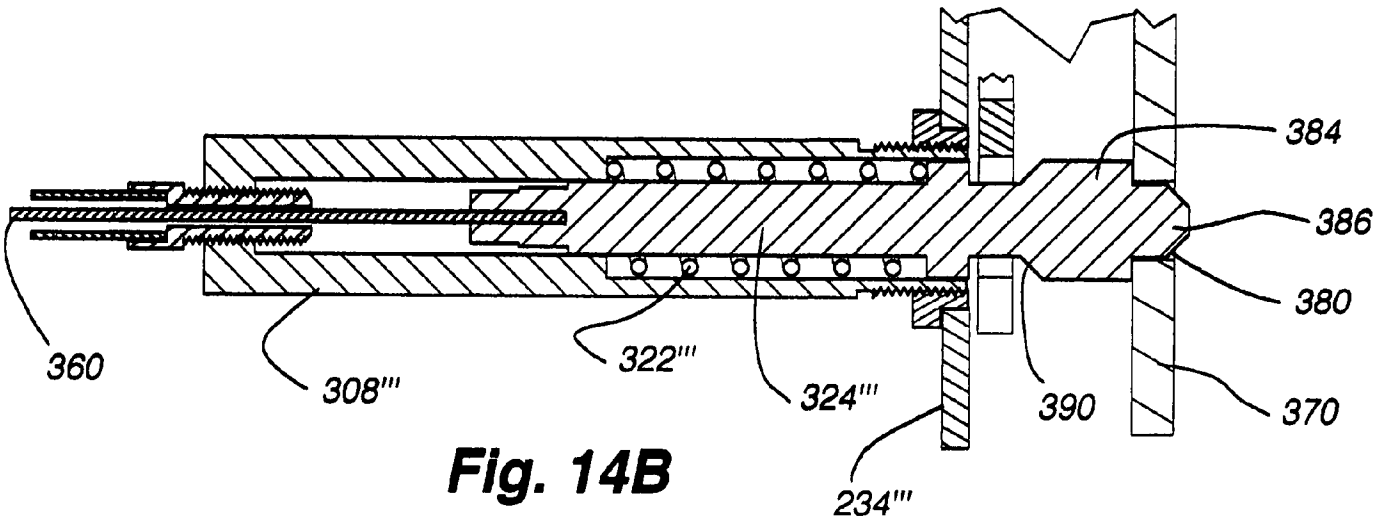
FIG. 14B is a cross-sectional view of the second pop-pin and sector plate shown in FIG. 14A, taken along line 14B-14B showing the second pop-pin engaged with the sector plate.
Figure 14C:
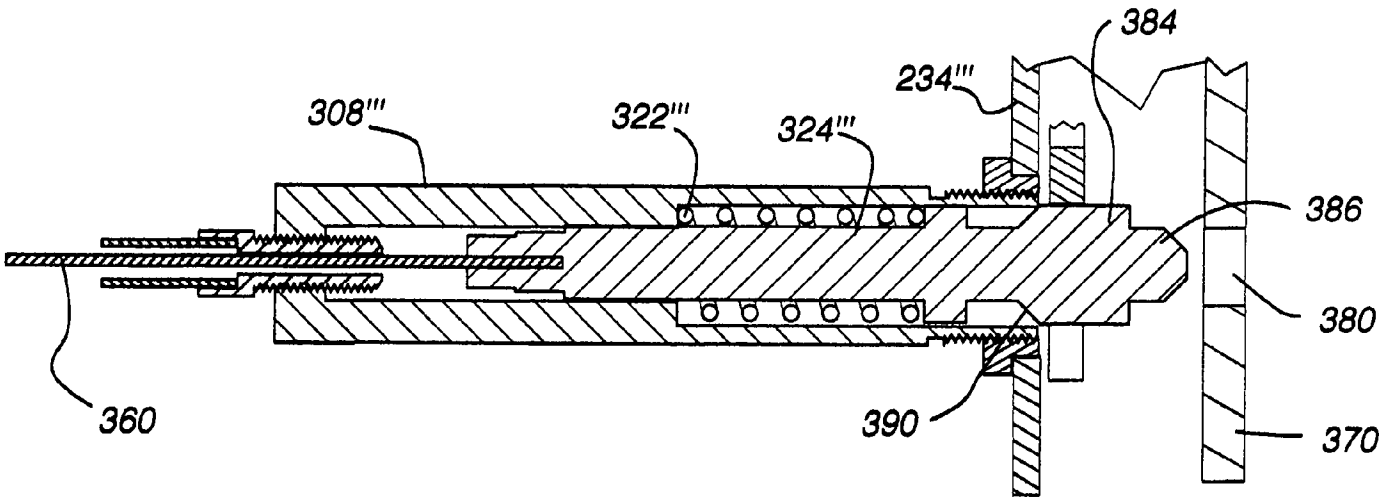
FIG. 14C is a cross-sectional view of the second pop-pin and sector plate shown in FIG. 14A, taken along line 14C-14C showing the second pop-pin disengaged from the sector plate and engaged with a hook plate.
Figures 15A, 15B, 15C:
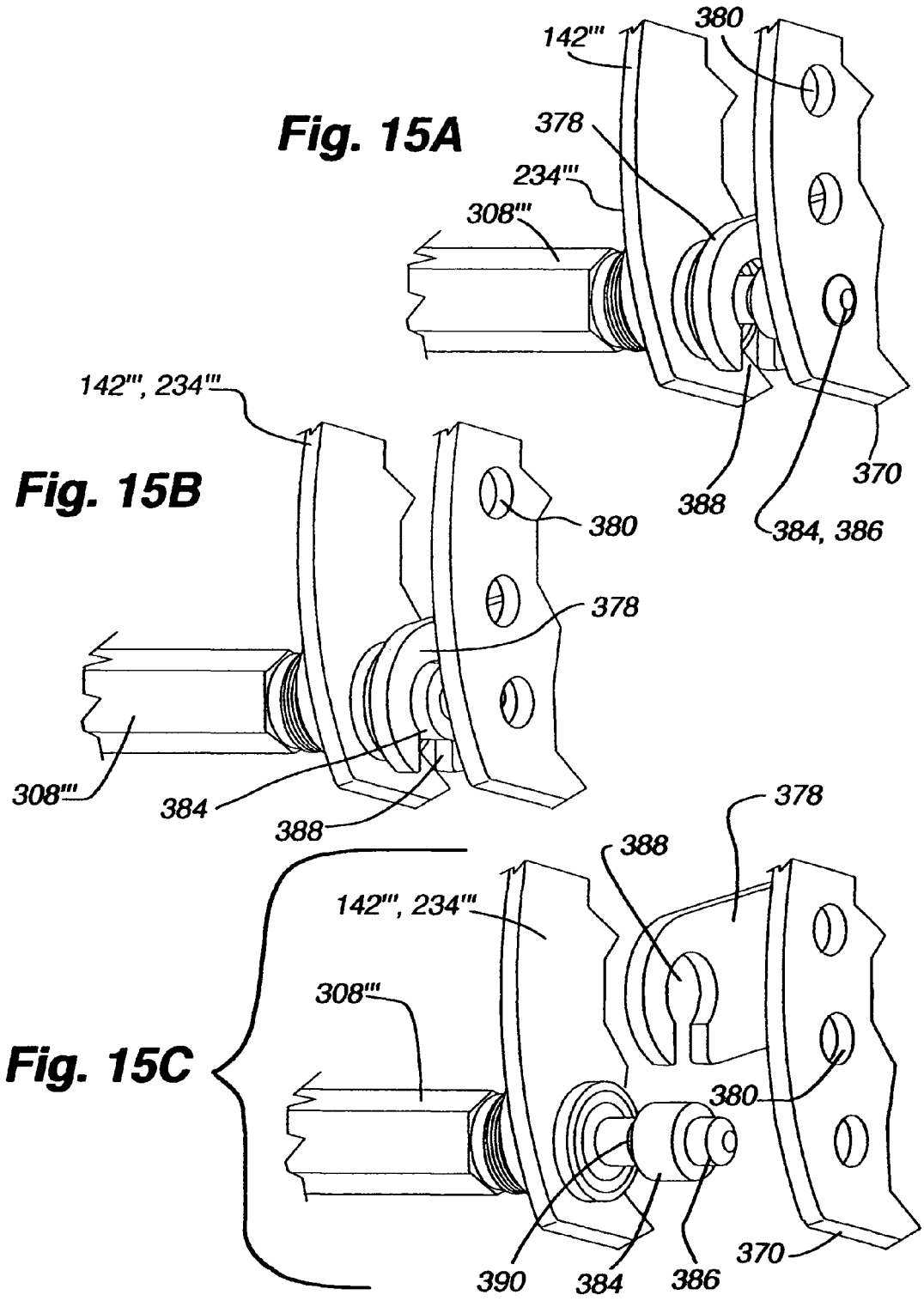
FIG. 15A is a detailed view of the second pop-pin of the arm assembly of FIG. 11B engaged with the sector plate.
FIG. 15B is a detailed view of the second pop-pin of the arm assembly of FIG. 11B disengaged from the sector plate and engaged with the hook plate.
FIG. 15C is a detailed view of the second pop-pin of the arm assembly of FIG. 11B disengaged from the sector plate and the hook plate and also showing the hook plate pivoted upward.

When the switch member 364 of the trigger assembly 354 is moved in direction A as shown in FIG. 12B, the second pop-pin 308''' is disengaged from the sector plate 370 and is engaged with the hook plate 378 connected with the drive shaft 130''' as shown in FIGS. 14C and 15B. As shown in FIGS. 11C, 12C, and 15A-15C, the hook plate 378 is connected with and extends radially from the drive shaft 130'''. A hook slot 388 located in an end portion of the hook plate 378 is adapted to engage the second pop-pin 308'''. More particularly, as shown in FIGS. 14B and 14C, the head portion 384 of the second pop-pin includes a beveled portion 390 that is adapted to engage the hook slot 388 on the hook plate. As such, because the second pop-pin 308''' is connected with the cam housing 142''' and the hook plate 378 is connected with the drive shaft 130''', when the beveled portion 390 of the second pop-pin 308''' is received within the hook slot in the hook plate, the cam housing 142''' is connected with and can pivot with the drive shaft 130'''.

When changing the desired starting position of the arms 118''', 120''', the drive shaft 130''' is decoupled from the sector member 128'''. As discussed above, during exercise, the cam housing 142''' is held in a fixed position relative to the arm support member 122'''. The cam housing 142''' can also be decoupled from the frame to rotate with the drive shaft 130''' when changing the desired starting position of the arms. More particularly, to change the desired starting positions of the arms, the switch member 364 on the trigger assembly 354 is moved in direction A, as shown in FIG. 12B. Movement of the switch member disengages the first pop-pin 284''' from the sector gear 356, which disconnects the drive shaft 130''' from the sector member 128'''. Movement of the switch member also simultaneously disengages the second pop-pin 308''' from the sector plate 370 as shown in FIGS. 14C and 15B, which decouples the cam housing 142''' from the arm support member 122'''. The second pop-pin 308''' is also moved into engagement with the hook plate 378, which couples the cam housing 142''' with the drive shaft 130'''. Therefore, the cam housing will pivot along with the arms and drive shaft relative to the sector member. A user can then pivot the arms in order to place the arms and associated gripping portions into a desired starting position.

Once in the desired starting position, the switch member 364 on the trigger assembly 354 can be released, which allows the spring 298''' associated with the first pop-pin 284''' to force the first pop-pin into engagement with the sector gear 356, as shown in FIG. 13B. At the same time, the spring 322''' associated with the second pop-pin 308''' forces the second pop-pin into engagement with the sector plate 370, as shown in FIG. 14B. Movement of the pop-pins also pulls on the first and second cables 358, 360 in direction B", causing the switch member to move in direction B, shown in FIG. 12B. As discussed above, when exercising, the user applies force to the arms, causing the arms to pivot the drive shaft. As the drive shaft pivots back and forth, the hook slot 388 on hook plate 378 pivots in and out of engagement with the second pop-pin 308'''. For example, FIG. 15C shows the hook plate pivoted upward from the second pop-pin.

It will be appreciated from the above noted description of various arrangements and embodiments of the present invention that an arm assembly has been described which includes first and second arms, a cam housing, a releasable locking mechanism, and a drive shaft. The arm assembly can be formed in various ways and operated in various manners depending upon on how the arms and cam housing are constructed and coupled with the drive shaft. It will be appreciated that the features described in connection with each arrangement and embodiment of the invention are interchangeable to some degree so that many variations beyond those specifically described are possible. For example, in any of the embodiments described herein, the cam housing may be configured to provide a diverging arm motion. It is to be further appreciated that the arm assembly can be configured to work various types of exercise devices other than what is described and depicted herein.

Although various representative embodiments of this invention have been described above with a certain degree of particularity, those skilled in the art could make numerous alterations to the disclosed embodiments without departing from the spirit or scope of the inventive subject matter set forth in the specification and claims. All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. An exercise device comprising:

a frame;

a drive shaft rotatably coupled to the frame for relative movement therewith;

a first arm and a second arm supported on the drive shaft and selectively engageable therewith;

a guide supported on the frame and defining an arm path; and an adjustment mechanism that selectively engages and disengages the first and second arms with the drive shaft and selectively engages and disengages the guide with the frame, wherein the adjustment mechanism operates to disengage the first and second arms from the drive shaft when the first and second arms move from a first initial position to a second initial position and thereafter engages the first and second arms to the drive shaft for movement of the first and second arms along the arm path.

2. The exercise device of claim 1, wherein operation of the adjustment mechanism further disengages the guide from the frame so that the guide moves relative to the frame when the first and second arms move from the first initial position to the second initial position.

3. The exercise device of claim 2, wherein operation of the adjustment mechanism further engages the guide to the first and second arms and the guide moves with the first and second arms when the first and second arms move from the first initial position to the second initial position.

4. The exercise device of claim 3, further comprising a selectable resistance operatively associated with the drive shaft, wherein movement of the first and second arms when the first and second arms are engaged with the drive shaft moves the drive shaft against the resistance as the first and second arms move along the arm path and movement of the first and second arms when the first and second arms are disengaged from the drive shaft does not move the drive shaft against the resistance.

5. The exercise device of claim 1, further comprising an initial distance between a grip portion of the first arm and a grip portion of the second arm when the first and second arms are at an initial position, wherein the initial distance is substantially equal when the first and second arms are in the first initial position and in the second initial position.

6. The exercise device of claim 5 further comprising a forward distance that is a distance between the grip portion of the first arm and the grip portion of the second arm when the first and second arms are located at a forward position and wherein the arms move from the initial position to the forward position during operation of the exercise device, and wherein the forward distance is not equal to the initial distance.

7. The exercise device of claim 6, wherein the arm path comprises a first path that guides the first arm and a second path that guides the second arm and wherein the first and second paths converge so that the initial distance between the grips when the first and second arms are at an initial position is greater than the forward distance between the grips when the first and second arms are at the forward position.

8. The exercise device of claim 7, further comprising a collar rotatably coupled to the drive shaft and wherein the first and second arms are pivotally coupled to the collar such that the arms pivot relative to the collar when the arms move along the respective arm paths.

9. An exercise device comprising:

a frame, a drive shaft coupled to the frame for relative movement thereto, a first arm and a second arm coupled to the shaft for selective engagement therewith, a guide that constrains movement of the first and second arms along respective guide paths, and a locking mechanism including a first transmission element to selectively engage and disengage the first and second arms with the drive shaft and a second transmission element to selectively engage and disengage the guide with the frame, wherein movement of the first and second arms from a first initial position to a second initial position when the first and second transmission elements are disengaged moves the arms relative to the drive shaft without operable engagement with the drive shaft and without substantial relative movement of the first and second arms along the guide paths.

10. The exercise device of claim 9, wherein the second transmission element further engages the guide to the first and second arms when the guide is disengaged from the frame.

11. The exercise device of claim 10, wherein operation of the locking mechanism sequentially configures the first transmission element to disengage the arms from the drive shaft and configures the second transmission element to disengage the guide from the frame and engage the guide with the first and second arms.

12. The exercise device of claim 11, further comprising a grip distance between grip portions of the first arm and the second arm and wherein the grip distance is substantially equal when the arms are located in the first initial position and in the second initial position.

13. The exercise device of claim 12, wherein the respective guide paths are convergent so that the grip distance decreases as the first and second arms move along the guide paths.

14. An adjustment mechanism for an exercise machine, comprising:

a shaft coupled to a frame;

an arm mechanism, including two lever arms, selectively coupled to the shaft by a first coupler;

a guide mechanism that restricts movement of the lever arms along a predetermined path, the guide mechanism selectively coupled to at least one of the frame or arm mechanism by a second coupler; and a first configuration of the first and second couplers wherein a force applied to the lever arms moves the lever arms along the path and moves the shaft, and a second configuration of the first and second couplers wherein a force moves the arm mechanism and the guide mechanism without moving the shaft thereby adjusting the lever arms from a first initial position to a second initial position.

15. The adjustment mechanism of claim 14, wherein the first configuration comprises the first coupler coupling the arm mechanism to the shaft and the second coupler decoupling the guide mechanism from the arm mechanism and coupling the guide mechanism to the frame.

16. The adjustment mechanism of claim 14, wherein the second configuration comprises the first coupler decoupling the arm mechanism from the shaft and the second coupler decoupling the guide mechanism from the frame and coupling the guide mechanism to the arm mechanism.

17. The adjustment mechanism of claim 14, wherein the first and second couplers are operatively associated such that operation of the first coupler to decouple the arm mechanism from the shaft decouples the guide mechanism from the frame and couples the guide mechanism to the arm mechanism.

18. The adjustment mechanism of claim 14, wherein the first coupler includes a user grip and actuation of the user grip concurrently operates the first coupler to decouple the arm mechanism from the shaft and the second coupler to decouple the guide mechanism from the frame and couple the guide mechanism to the arm mechanism.

19. The adjustment mechanism of claim 14, wherein the arm mechanism comprises the lever arms coupled to a collar that is selectively rotatable about the shaft and the first coupler couples and decouples the collar to the shaft.

20. The adjustment mechanism of claim 19, wherein the lever arms are pivotally connected to the collar so that distal ends of the lever arms can move relative to each other as the lever arms move along the predetermined path.

* * * * *